US010756420B2

(12) United States Patent
Kosaka

(10) Patent No.: US 10,756,420 B2
(45) Date of Patent: Aug. 25, 2020

(54) MULTI-BAND ANTENNA AND RADIO COMMUNICATION DEVICE

(71) Applicant: NEC Corporation, Minato-ku, Tokyo (JP)

(72) Inventor: Keishi Kosaka, Tokyo (JP)

(73) Assignee: NEC CORPORATION, Tokyo (JP)

( * ) Notice: Subject to any disclaimer, the term of this patent is extended or adjusted under 35 U.S.C. 154(b) by 511 days.

(21) Appl. No.: 15/562,038

(22) PCT Filed: Apr. 1, 2016

(86) PCT No.: PCT/JP2016/060963
§ 371 (c)(1),
(2) Date: Sep. 27, 2017

(87) PCT Pub. No.: WO2016/159369
PCT Pub. Date: Oct. 6, 2016

(65) Prior Publication Data

US 2018/0090833 A1 Mar. 29, 2018

(30) Foreign Application Priority Data

Apr. 2, 2015 (JP) ..... 2015-075790

(51) Int. Cl.
*H01Q 1/52* (2006.01)
*H01Q 15/14* (2006.01)
(Continued)

(52) U.S. Cl.
CPC ..... *H01Q 1/52* (2013.01); *H01Q 1/007* (2013.01); *H01Q 1/2291* (2013.01); *H01Q 9/04* (2013.01);
(Continued)

(58) Field of Classification Search
CPC ..... H01P 5/107; H01Q 7/00; H01Q 13/16; H01Q 13/10
See application file for complete search history.

(56) References Cited

U.S. PATENT DOCUMENTS 5,629,266 A * 5/1997 Lithgow ..... H01P 7/084 505/210
7,205,941 B2 * 4/2007 Wang ..... H01Q 3/44 343/700 MS
(Continued)

FOREIGN PATENT DOCUMENTS

JP S60-180115 U 11/1985
JP H11-27042 A 1/1999
(Continued)

OTHER PUBLICATIONS

Toyohisa Takano et al., "Triple-Band Polarization Diversity Antenna with Loop Elements", SEI Technical Review, Jul. 2013, No. 183, pp. 96 to 99.
(Continued)

*Primary Examiner* — Graham P Smith
*Assistant Examiner* — Jae K Kim

(57) ABSTRACT

A multi-band antenna includes: a conductor reflecting plate having a plate surface; a first antenna element that extends along the plate surface of the conductor reflecting plate to a length according to a first wavelength; and a second antenna element that extends along the plate surface of the conductor reflecting plate to a length according to a second wavelength shorter than the first wavelength. A distance between the first antenna element and the plate surface in a perpendicular direction is equal to a distance between the second antenna element and the plate surface in the perpendicular direction, the perpendicular direction being a direction perpendicular to the plate surface.

9 Claims, 49 Drawing Sheets

(51) Int. Cl.

| | |
|---|---|
| ***H01Q 19/10*** | (2006.01) |
| ***H01Q 21/06*** | (2006.01) |
| ***H01Q 21/24*** | (2006.01) |
| ***H01Q 21/28*** | (2006.01) |
| ***H01Q 1/22*** | (2006.01) |
| ***H01Q 1/00*** | (2006.01) |
| ***H01Q 13/10*** | (2006.01) |
| ***H01Q 9/04*** | (2006.01) |

(52) U.S. Cl.
CPC ..... *H01Q 13/10* (2013.01); *H01Q 15/14* (2013.01); *H01Q 19/10* (2013.01); *H01Q 21/06* (2013.01); *H01Q 21/24* (2013.01); *H01Q 21/28* (2013.01)

(56) References Cited

U.S. PATENT DOCUMENTS

| | | | | |
|---|---|---|---|---|
| 8,314,740 | B2 * | 11/2012 | Blumberg, Jr. ..... | H01Q 9/0464 343/741 |
| 8,502,741 | B2 * | 8/2013 | Lin ..... | H01Q 1/243 343/700 MS |
| 8,711,897 | B2 * | 4/2014 | Miles ..... | H01P 7/08 333/204 |
| 2010/0053019 | A1 | 3/2010 | Ikawa et al. | |
| 2013/0241779 | A1 * | 9/2013 | Korva ..... | H01Q 1/243 343/700 MS |
| 2013/0249769 | A1 * | 9/2013 | Higaki ..... | H01Q 1/50 343/876 |
| 2014/0333504 | A1 * | 11/2014 | Basirat ..... | H01Q 9/42 343/893 |
| 2015/0130669 | A1 * | 5/2015 | Sonoda ..... | H01Q 7/00 343/702 |
| 2015/0288071 | A1 * | 10/2015 | Toyao ..... | H01Q 1/48 343/700 MS |
| 2015/0380810 | A1 * | 12/2015 | Miura ..... | H01Q 5/10 343/700 MS |

FOREIGN PATENT DOCUMENTS

| | | | | | |
|---|---|---|---|---|---|
| JP | 2005-072670 | A | | 3/2005 | |
| JP | 2007155597 | A | * | 6/2007 | |
| JP | 2012-165355 | A | | 8/2012 | |
| WO | 2008/136530 | A1 | | 11/2008 | |
| WO | 2014/059946 | A1 | | 4/2014 | |
| WO | 2014/073703 | A1 | | 5/2014 | |
| WO | 2015/029383 | A1 | | 3/2015 | |
| WO | WO-2015151430 | A1 | * | 10/2015 | ..... H01Q 1/24 |

OTHER PUBLICATIONS

International Search Report for PCT Application No. PCT/JP2016/060963, dated May 31, 2016.

Eun Young Kim, et al. "Low Profile Dual-band Reflector Antenna with Dual Resonant AMC", 2011 IEEE International Symposium on Antennas and Propagation, 2011, pp. 1800-1803, Spokane, WA, USA.

Japanese Office Action for JP Application No. 2017-510262 dated May 19, 2020 with English Translation.

* cited by examiner

MULTI-BAND ANTENNA AND RADIO COMMUNICATION DEVICE

This application is a National Stage Entry of PCT/JP2016/060963 filed on Apr. 1, 2016, which claims priority from Japanese Patent Application 2015-075790 filed on Apr. 2, 2015, the contents of all of which are incorporated herein by reference, in their entirety.

TECHNICAL FIELD

The present invention relates to a multi-band antenna and a radio communication device.

BACKGROUND ART

In recent years, for example, as a mobile communication base station or an antenna device for a Wi-Fi communication device, a multi-band antenna capable of communicating in a plurality of frequency bands is provided for practical use in order to ensure communication capacity (Wi-Fi is a registered trademark).

For example, a multi-band antenna is disclosed in FIG. 11, FIG. 12, and FIG. 13 of Patent Document 1, or Patent Document 2 and the like. In particular, in the multi-band antenna disclosed in Patent Document 1, there is disclosed a technique for realizing a multi-band antenna by using a plurality of dipole antenna elements supporting each frequency band.

In this multi-band antenna, crossed-dipole antenna elements for high band and low band are arranged alternately on the antenna reflector so as to form arrays. In addition, central conductor fences are provided between the arrays to reduce mutual coupling.

PRIOR ART DOCUMENTS

Patent Documents

[Patent Document 1] PCT International Publication No. WO 2014/059946

[Patent Document 2] Japanese Unexamined Patent Application, First Publication No. 2005-072670

SUMMARY OF INVENTION

Problem to be Solved by the Invention

However, each of the plurality of antenna elements supporting different frequencies is composed of a metal. Therefore, if each antenna element is disposed close to each other as disclosed in Patent Document 1, each antenna element influences each other's radiation pattern, and each radiation pattern is disturbed.

An exemplary object of the present invention is to provide a multi-band antenna and a radio communication device capable of suppressing the influence of respective antenna elements supporting different frequencies, on mutual radiation patterns.

Means for Solving the Problem

A multi-band antenna according to an exemplary aspect of the present invention includes: a conductor reflecting plate having a plate surface; a first antenna element that extends along the plate surface of the conductor reflecting plate to a length according to a first wavelength; and a second antenna element that extends along the plate surface of the conductor reflecting plate to a length according to a second wavelength shorter than the first wavelength. A distance between the first antenna element and the plate surface in a perpendicular direction is equal to a distance between the second antenna element and the plate surface in the perpendicular direction, the perpendicular direction being a direction perpendicular to the plate surface.

A radio communication device according to an exemplary aspect of the present invention includes the multi-band antenna described above.

Effect of the Invention

According to the multi-band antenna and the radio communication device mentioned above, it is possible to suppress the influence of respective antenna elements supporting different frequencies, on mutual radiation patterns.

EMBODIMENTS FOR CARRYING OUT THE INVENTION

First Exemplary Embodiment

Hereunder, a multi-band antenna according to a first exemplary embodiment will be described in detail, with reference to FIG. 1 to FIG. 27. However, in each of the exemplary embodiments described below, technically preferable limitations are made to implement the present invention, but the scope of the invention is not limited to only the following exemplary embodiments. In the following description, the shapes, positional relationships, and the like of the constituents may be described using expressions such as upper, lower, left, and right depending on the figure to be referred to. These expressions are used only to make the description easier to understand with reference to the figures, and the exemplary embodiments described below do not limit the directions to be actually implemented.

Figure 1:
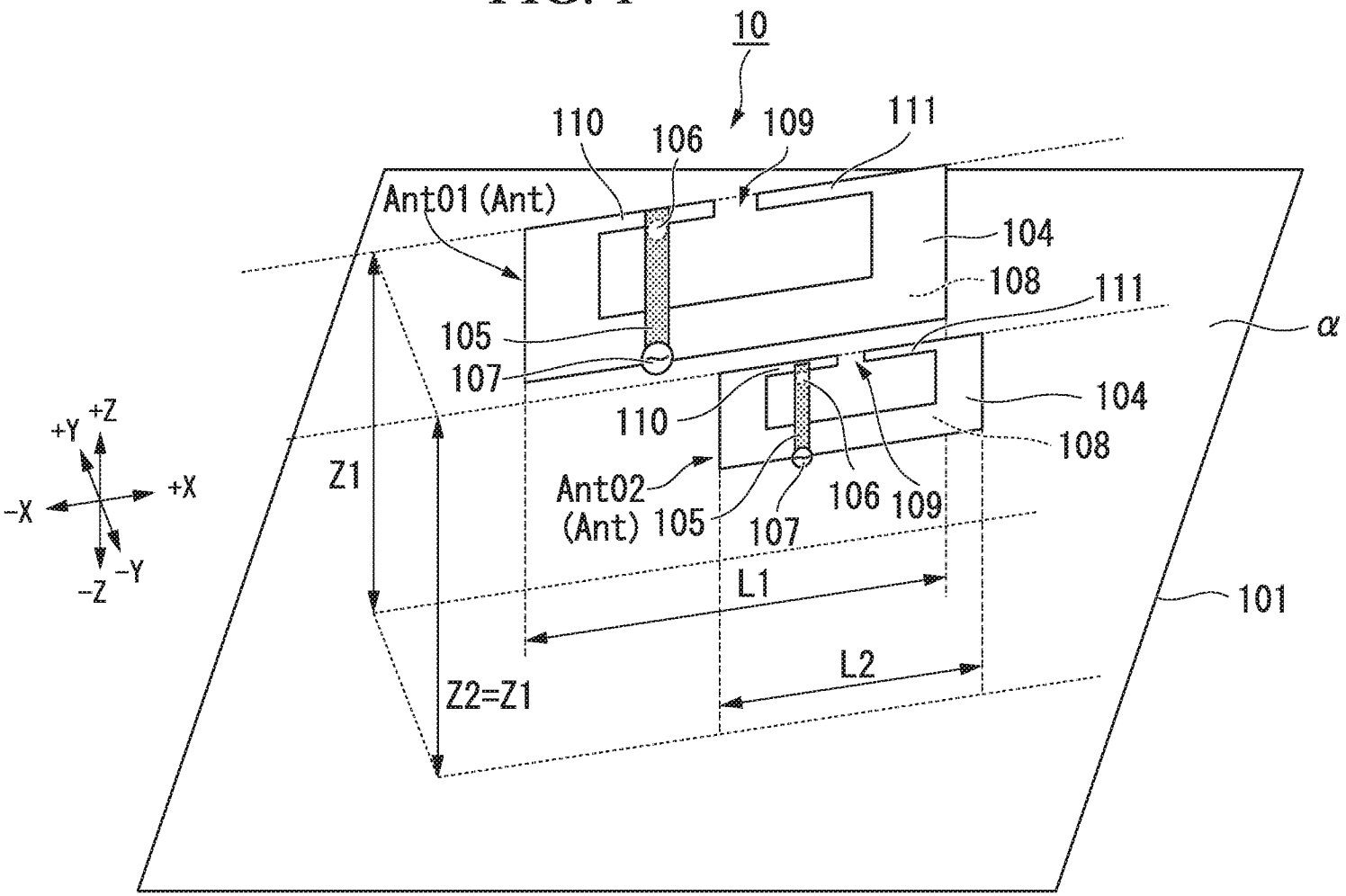
FIG. 1 is a perspective view of a multi-band antenna according to a first exemplary embodiment.

FIG. 1 is a perspective view of a multi-band antenna according to the first exemplary embodiment.

Figure 2:
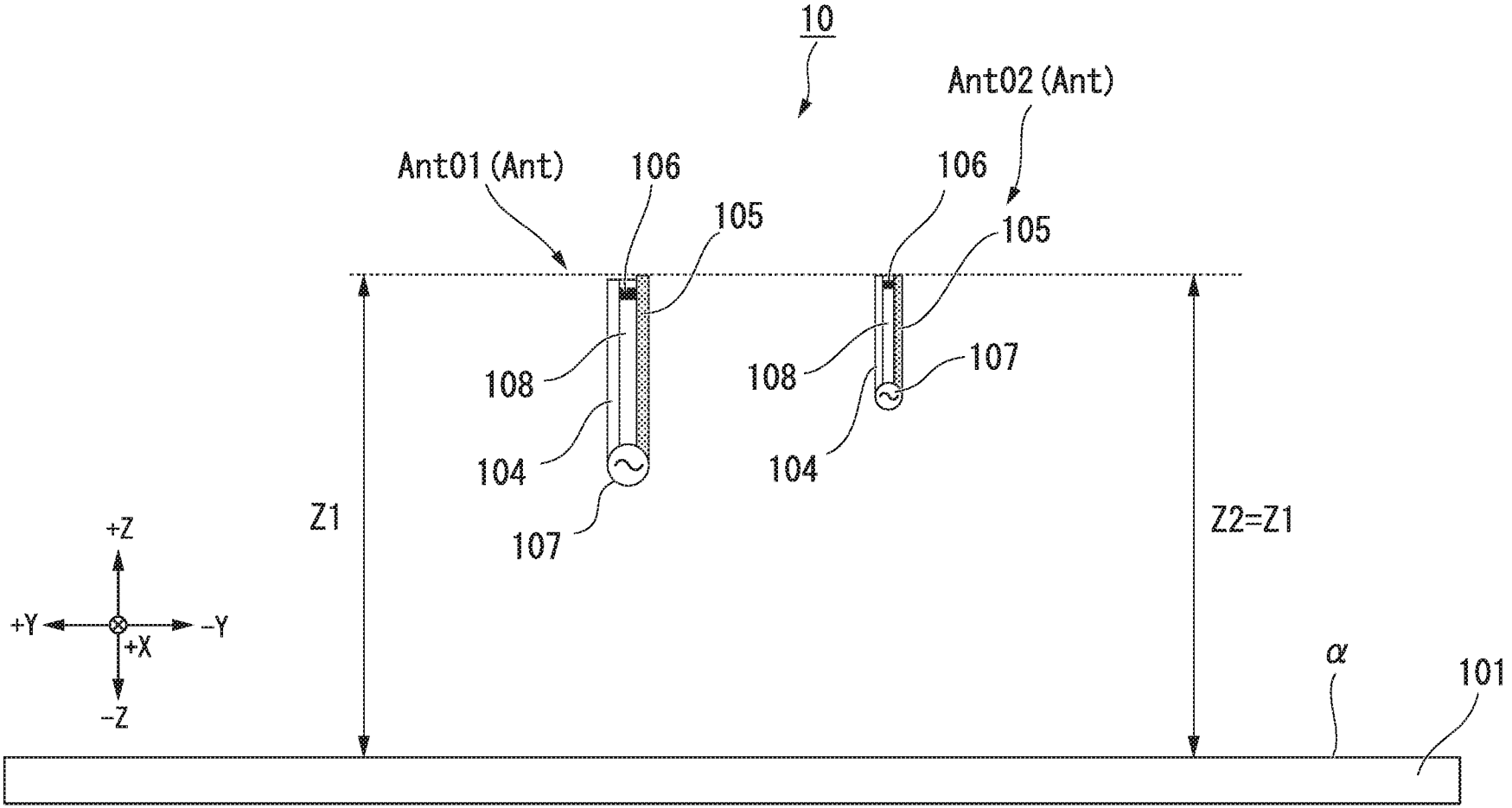
FIG. 2 is a front elevation view of a multi-band antenna according to the first exemplary embodiment.

FIG. 2 is a front elevation view of the multi-band antenna according to the first exemplary embodiment.

In FIG. 1 and FIG. 2, for the purpose of description, the X axis and the Y axis are defined in the in-plane direction of the plate surface of a conductor reflecting plate 101, which will be described later, and the Z axis is defined in the perpendicular direction (normal direction) of the plate surface of the conductor reflecting plate 101. The X axis, the Y axis, and the Z axis (X' axis, Y' axis, Z' axis) are similarly defined also in other figures, which are described later.

As shown in FIG. 1 and FIG. 2, a multi-band antenna 10 includes a first antenna element Ant01, a second antenna element Ant02, and a conductor reflecting plate 101. In the following description, the first antenna element Ant01 and the second antenna element Ant02 may also be collectively referred to as antenna elements Ant in some cases.

The first antenna element Ant01 and the second antenna element Ant02 are antenna elements that extend along a predetermined in-plane direction (X axis direction) of a plate surface α of the conductor reflection plate 101.

The first antenna element Ant01 is characterized in that it uses an operating frequency f1 according to a wavelength λ1 as its resonance frequency, and is capable of transmitting and receiving electromagnetic waves of the wavelength λ1 (operating frequency f1) through the atmosphere.

Similarly, the second antenna element Ant02 is characterized in that it uses an operating frequency f2 according to a wavelength λ2 as its resonance frequency, and is capable of transmitting and receiving electromagnetic waves of the wavelength λ2 (operating frequency f2) through the atmosphere.

In the first exemplary embodiment, the wavelength λ2 is shorter than the wavelength λ1 (λ1>λ2). Therefore, the length of extension of the second antenna element Ant02 is shorter than the length of extension of the first antenna element Ant01.

Specific aspects of the two antenna elements Ant (the first antenna element Ant01 and the second antenna element Ant02) are described.

As shown in FIG. 1 and FIG. 2, the two antenna elements Ant each include an annular conductor part 104, a conductor feeder line 105, a conductor via 106, a feeding point 107, and a dielectric layer 108. In FIG. 1, a clear illustration of the dielectric layer 108 is omitted in order to facilitate understanding of the arrangement of other configurations. Also in the figures which will be described later, a clear illustration of the dielectric layer 108 may be omitted in some cases.

As shown in FIG. 1 and FIG. 2, the annular conductor part 104 is a conductor formed annularly on one surface of the dielectric layer 108. More specifically, the annular conductor part 104 is formed in a substantially rectangular annular shape having long edges in the direction along the plate surface α (X axis direction). Furthermore, the annular conductor part 104 has a split part 109 in which a circumferential part is missing. The split part 109 is a part constituting a long edge of the circumferentially upper side (the Z axis positive direction side) of the annular conductor part 104, and is formed at the center in the extending direction of the long edge thereof (the X axis direction). Portions of the annular conductor part 104 that are in contact with the split part 109 in the circumferential direction thereof and that extend in the extending direction (the X axis direction) along the plate surface α (the upper long edges of the annular conductor part 104) are respectively referred to as a conductor end part 110 and a conductor end part 111. The conductor end part 110 and the conductor end part 111 are opposed to each other via a gap (split part 109). The two antenna elements Ant are formed in a C shape on the basis of the annular conductor part 104 having the split part 109 and constitute a split ring resonator that uses the operating frequencies f1, f2 of electromagnetic waves as its resonance frequencies.

The length L1 in the extending direction (X axis direction) of the annular conductor part 104 of the first antenna element Ant01 is, for example, approximately ¼ of the wavelength λ1. The length L2 in the extending direction (X axis direction) of the annular conductor part 104 of the second antenna element Ant02 is, for example, approximately ¼ of the wavelength λ2.

The wavelength λ1 and the wavelength λ2 indicate the wavelengths at which the electromagnetic waves of the operating frequencies f1, f2 coinciding with the resonance frequencies of the first antenna element Ant01 or the second antenna element Ant02, travel through a substance that fills a region.

The conductor feeder line 105 is formed on the other surface (the surface opposite to the surface on which the annular conductor part 104 is formed) of the dielectric layer 108, and is arranged with a space from the annular conductor part 104. The conductor feeder line 105 forms an electrical circuit for feeding electric power from the feeding point 107 to the annular conductor part 104. The conductor feeder line 105 extends in the perpendicular direction (Z axis direction) of the plate surface α by a length equal to the length in the short edge direction (Z axis direction) of the annular conductor part 104.

The conductor via 106 passes through the dielectric layer 108 in its plate thickness direction (Y direction) and electrically connects a part of the annular conductor part 104 and one end of the conductor feeder line 105. Specifically, the conductor via 106 is connected to the conductor end part 110 of the annular conductor part 104.

The feeding point 107 electrically excites between the other end of the conductor feeder line 105 (the end on the opposite side of the one end where the conductor via 106 is disposed) and the annular conductor part 104 that is in the proximity thereof at predetermined operating frequencies (operating frequencies f1, f2).

More specifically, the feeding point 107 is a point at which high-frequency electric power from a power supply (not shown in the figure) is supplied. As shown in FIG. 1 and FIG. 2, the feeding point 107 can excite between the other end of the conductor feeder line 105 and a part of the long edge on the opposite side (on the lower side (in the Z axis negative direction) side) of the long edge on the upper side (in the Z axis positive direction) of the annular conductor part 104, to which the conductor via 106 is connected.

The feeding point 107 is connected to a radio communication circuit unit 114 and the like which will be described later. As a result, the radio communication circuit unit 114 can transmit and receive radio communication signals to/from the multi-band antenna 10 via the feeding point 107.

The dielectric layer 108 is a plate-shaped dielectric body having the annular conductor part 104 and the conductor feeder line 105 on each of both surfaces thereof. That is to say, the annular conductor part 104 and the conductor feeder line 105 are opposed to each other with a space therebetween via the dielectric layer 108.

The surface of the dielectric layer 108 is arranged (in the XZ plane) so as to be inclined (perpendicularly) with respect to the plate surface α of the conductor reflecting plate 101. Thereby, the two antenna elements Ant are arranged so that the annular surface of the annular conductor part 104 is inclined perpendicular to the plate surface α.

Next, the conductor reflecting plate 101, and the positional relationship between the antenna elements Ant and the conductor reflecting plate 101 will be described.

The conductor reflecting plate 101 is a plate-shaped conductor having a conductor plate surface α on one plane (XY plane) in the space.

The first antenna element Ant01 is disposed apart from the plate surface α of the conductor reflecting plate 101 by a predetermined gap (distance Z1) in the perpendicular direction (Z axis direction). Similarly, the second antenna element Ant02 is disposed apart from the plate surface α in the perpendicular direction by a predetermined gap (distance Z2). The two antenna elements Ant (the first antenna element Ant01 and the second antenna element Ant02) are arranged so that distances from this plate surface α in the perpendicular direction of the plate surface α are substantially equal to each other (Z1=Z2).

More specifically, as shown in FIG. 1 and FIG. 2, the antenna elements Ant are arranged so that the distances Z1, Z2 from the plate surface α of the conductor reflecting plate 101 to the outer periphery on the upper side (in Z axis positive direction) of the annular conductor part 104 of each antenna element Ant are substantially equal to each other. In other words, the two antenna elements Ant are arranged so that the distances from the plate surface α to the portions of the annular conductor part 104 that are furthest away from the plate surface α in the perpendicular direction (the upper side long edges of the annular conductor part 104, that is, the portions that are most distanced) are substantially equal to each other.

The conductor reflecting plate 101, the annular conductor parts 104, the conductor feeder lines 105, the conductor vias 106 (and those further described as conductors in the following description) are composed of metal materials such as copper, silver, aluminum, and nickel, or other types of good conductor materials.

The annular conductor part 104, the conductor feeder line 105, the conductor via 106, and the dielectric layer 108 are generally manufactured by means of a normal process for manufacturing a substrate such as a printed substrate and a semiconductor substrate. However, they may be manufactured by means of other methods.

Generally, the conductor via 106 is formed by plating a through hole that is drill-formed in the dielectric layer 108. However, it may be of any kind as long as the layers can be electrically connected. For example, the conductor via 106 may be formed of a laser via that is formed by means of a laser, or may be formed with a copper wire or the like.

The dielectric layer 108 may also be embodied as an air layer (hollow layer). The dielectric layer 108 may also be composed only of a partial dielectric supporting member and at least a part of it may be hollow.

The conductor reflecting plate 101 is generally formed of a sheet metal or a copper foil bonded to a dielectric substrate. However, it may also be formed of an other material as long as it is a conductive material.

The action and effect of the multi-band antenna according to the first exemplary embodiment will be described with reference to FIG. 3.

Normally, in an antenna with a reflecting, the plate surface α of the conductor reflecting plate 101 is a short-circuited plane. Therefore, it is preferable that ordinary antennas such as dipole antenna elements d100, d200 in FIG. 3 are approximately ¼ of the wavelength of the electromagnetic waves of the operating frequencies f1 and f2 respectively, and are arranged so as to be distanced from the plate surface α of the conductor reflecting plate 101 in the perpendicular direction (in the Z axis direction).

Figure 3:
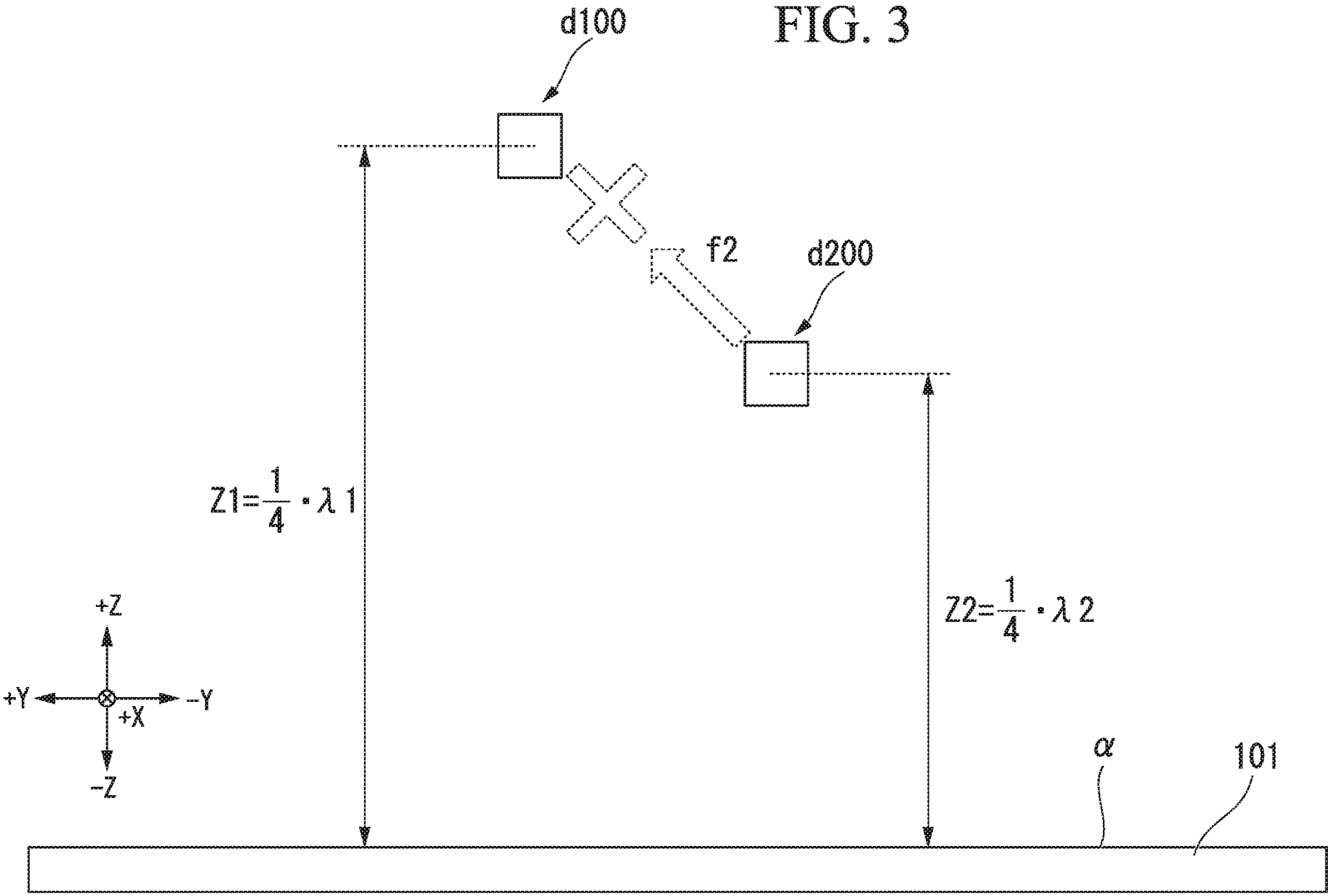
FIG. 3 is a diagram for describing the action and effect of the multi-band antenna according to the first exemplary embodiment.

However, as shown in FIG. 3, in this type of arrangement, the dipole antenna element d100 is positioned on the radiation direction of the electromagnetic wave (on the hemispheric surface in the Z axis positive direction) as viewed from the dipole antenna element d200. As a result, the dipole antenna element d100 becomes a factor of disturbing the electromagnetic wave radiation pattern of the operating frequency f2 emitted from the dipole antenna element d200, as a metal body.

Therefore, in the multi-band antenna 10 according to the first exemplary embodiment, as shown in FIG. 1 and FIG. 2, the first antenna element Ant01 and the second antenna element Ant02 are arranged so that the distances Z1, Z2 from the plate surface α of the conductor reflecting plate 101 are substantially equal to each other. With this type of arrangement, it is possible to suppress the influence of the antenna elements Ant on the mutual radiation pattern.

As described above, it is possible to provide a multi-band antenna in which the influence of the respective antenna elements supporting different frequencies, on mutual radiation patterns is suppressed.

From the viewpoint of reducing the casing size of the entire multi-band antenna 10 when arranging the distances Z1, Z2 from the plate surface α of the respective antenna elements Ant so as to be equal to each other, it is preferable that the distance Z1 from the first antenna element Ant01 operating at the operating frequency f1 to the plate surface α of the conductor reflecting plate 101 is made shorter than ¼ of the wavelength λ1 to make the distances equal to each other. That is to say, the distance Z2 from the plate surface α of the second antenna element Ant02 that operates at the operating frequency f2 (>f1) remains the same as the distance (=λ2·¼) at which the influence on the resonance characteristic is reduced most. Meanwhile, the distance Z1 from the plate surface α of the conductor reflecting plate 101 of the first antenna element Ant01 is matched with ¼ of the wavelength λ2 (<λ1), which is shorter than ¼ of the wavelength λ1 (=Z2).

At this time, the influence of the conductor reflecting plate 101 on the resonance characteristics of the first antenna element Ant01 is increased. In this case, it is preferable that fine adjustment is made to the normal design of the first antenna element Ant01 where the distance Z1 is approximately ¼ of the wavelength λ1, so that even if the distance Z1 becomes "Z1<λ1·¼", the desired antenna characteristic can still be achieved.

In addition to the distance Z1, the distance Z2 may also be made shorter than ¼ of the wavelength λ2 so that "Z1=Z2" is yielded.

Figure 4:
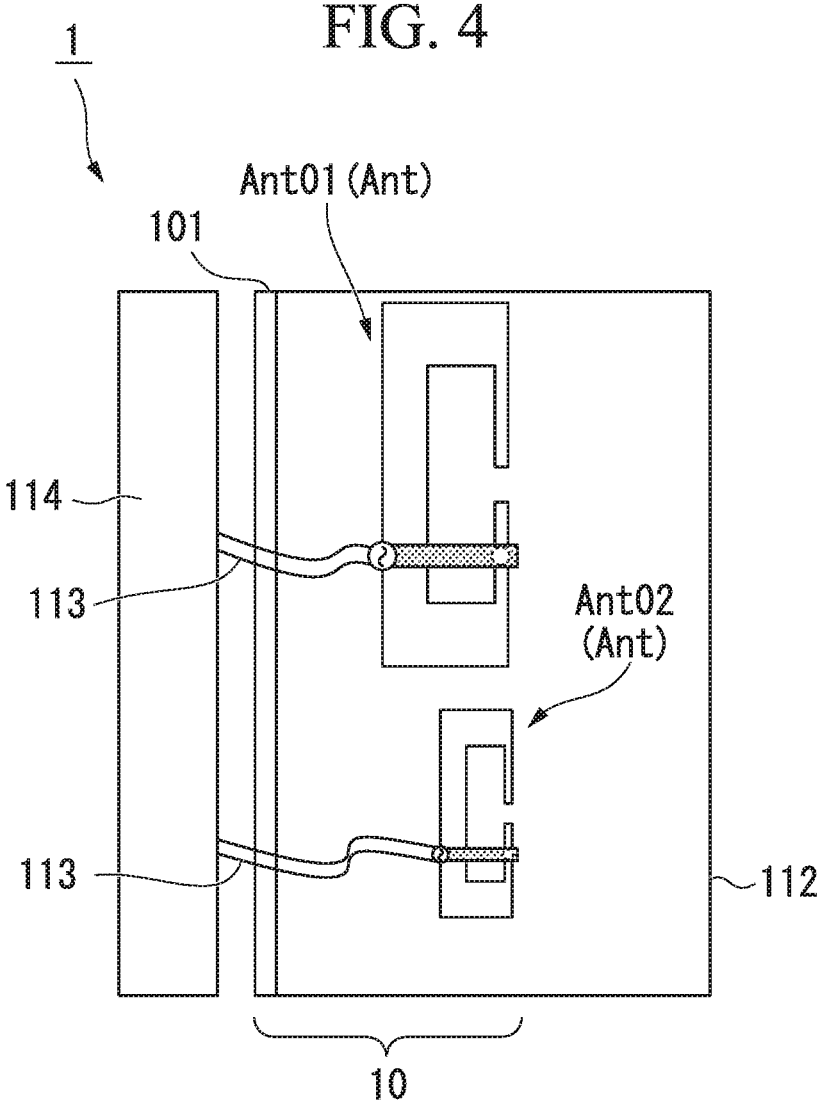
FIG. 4 is a diagram showing a functional configuration of a radio communication device according to the first exemplary embodiment.

FIG. 4 is a diagram showing a functional configuration of a radio communication device according to the first exemplary embodiment.

The multi-band antenna 10 according to the first exemplary embodiment may be appropriately incorporated as an antenna part in a radio communication device such as a Wi-Fi or in a mobile communication base station.

As shown in FIG. 4, the radio communication device 1 has the multi-band antenna 10, a dielectric radome 112, the radio communication circuit unit 114, and a transmission line 113. The dielectric radome 112 mechanically protects the multi-band antenna 10. The transmission line 113 transmits radio signals between each antenna element Ant in the multi-band antenna 10 and the radio communication circuit unit 114. In FIG. 4, the dielectric radome 112 is illustrated as being transparent to simplify the illustration. With this type of configuration, for the radio communication device 1 that uses the multi-band antenna 10, it is possible to suppress the influence on mutual radiation patterns between the multiple antenna elements operating at mutually different frequencies (operating frequencies f1 and f2).

Figure 5:
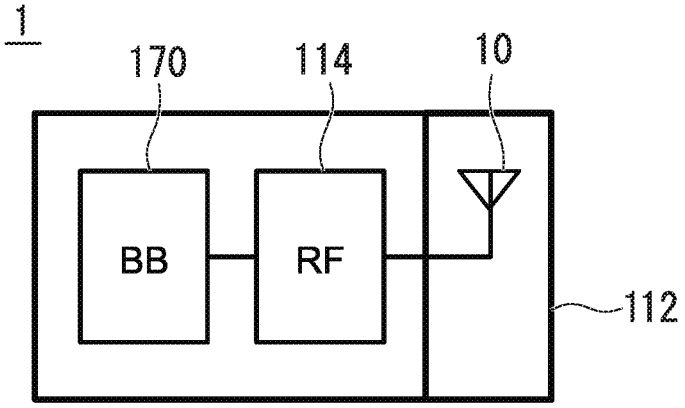
FIG. 5 is a diagram showing a modified example of the radio communication device according to the first exemplary embodiment.

The radio communication device 1 may be used as, for example, a radio communication device, a mobile communication base station, or a radar. In addition to this, for example, as shown in FIG. 5, the radio communication device 1 may include a baseband processing unit (BB) 170 that performs baseband processing.

Modified Example of First Exemplary Embodiment

Figure 6:
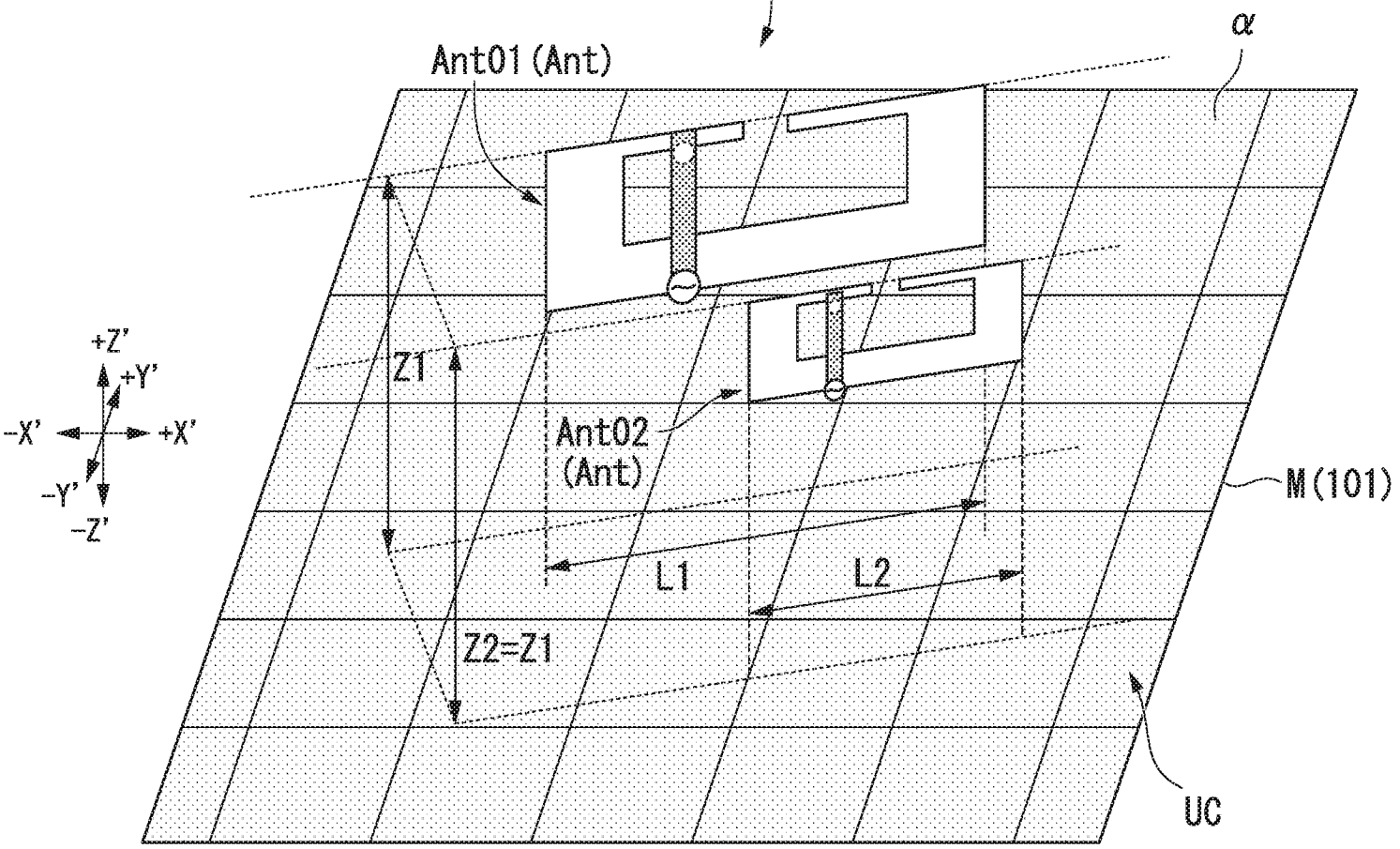
FIG. 6 is a perspective view of a multi-band antenna according to a first modified example of the first exemplary embodiment.

FIG. 6 is a perspective view of a multi-band antenna according to a first modified example of the first exemplary embodiment.

As described above, when making the distances Z1, Z2 from the plate surface α of the conductor reflecting plate 101 of each antenna element Ant equal, it is more preferable to consider the influence of the conductor reflecting plate 101, which is a short-circuited plane, on the resonance characteristic of each antenna element Ant, by changing the design of the configuration of the antenna elements Ant as described above.

In this case, for example, as shown in FIG. 6, a metamaterial reflecting plate M may be used as the conductor reflecting plate 101 shown in FIG. 1 and FIG. 2. The metamaterial reflecting plate M refers to a reflecting plate in which a periodic structure UC composed of small pieces of conductor or small pieces of dielectric body formed in a predetermined shape is periodically arranged in the longitudinal direction (Y' axis direction) and the lateral direction (X' axis direction) of the plate surface α. The metamaterial reflecting plate M is also referred to as an artificial magnetic conductor or a high impedance surface. In this manner, the value of phase rotation due to the reflection of electromagnetic waves reflected on the metamaterial reflecting plate M can differ from the reflection phase 180°, which is yielded by a normal metal plate. Using this metamaterial reflecting plate M, the reflection phase is controlled at operating frequencies f1 and f2 respectively. As a result, even when the distance Z1 or the distance Z2 is shorter than ¼ of the wavelength λ1 or ¼ of the wavelength λ2, it is possible to suppress changes in the resonance characteristics of the first antenna element Ant01 and the second antenna element Ant02.

Figure 7:
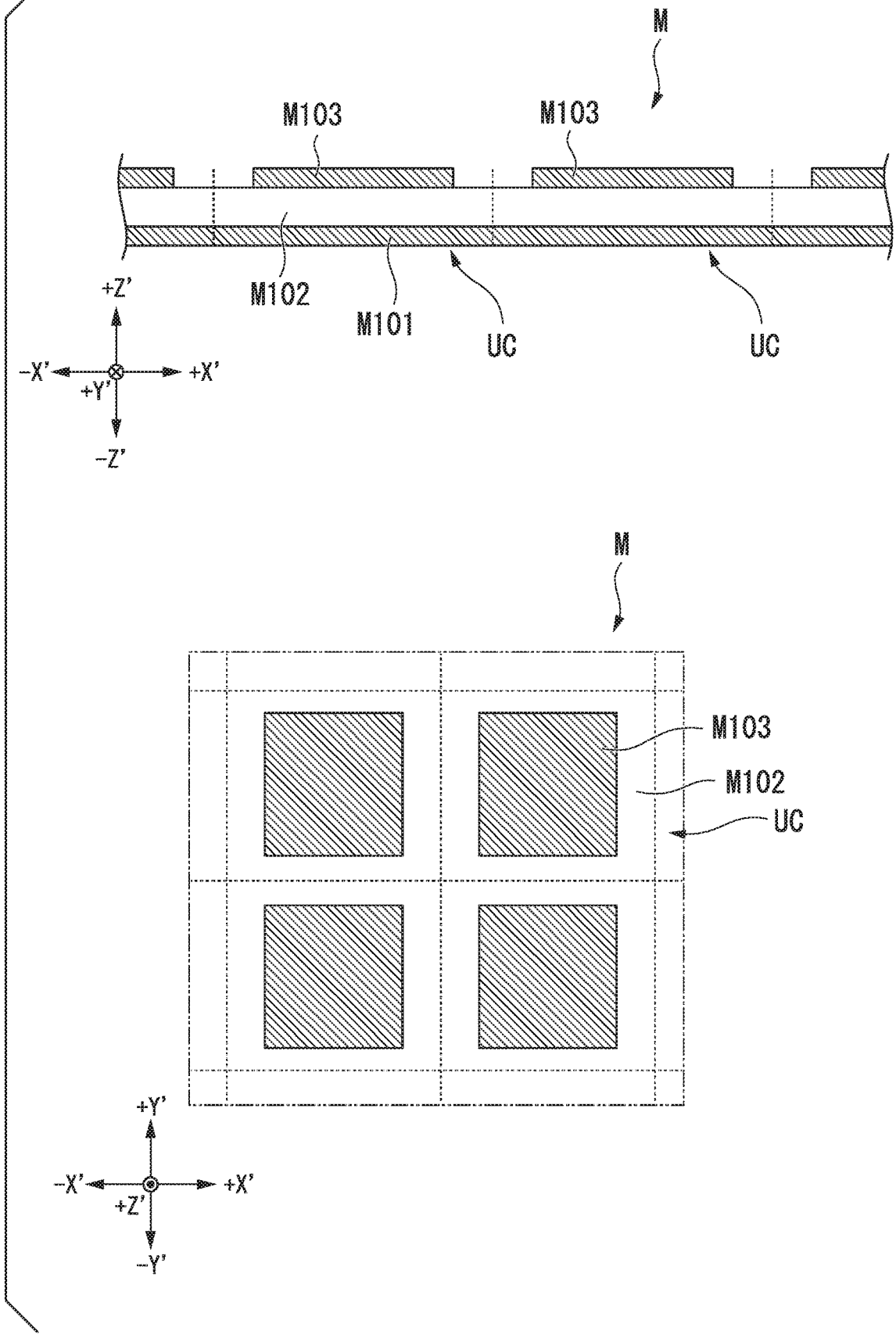
FIG. 7 is a diagram showing a first example of a structure of a metamaterial reflecting plate according to the first modified example of the first exemplary embodiment.

FIG. 7 is a diagram showing a first example of a structure of the metamaterial reflecting plate according to the first modified example of the first exemplary embodiment.

As an example of a specific structure of the metamaterial reflecting plate M described in FIG. 6, a structure as shown in FIG. 7 may be employed. As shown in FIG. 7, the metamaterial reflecting plate M includes a conductor plate M101, a dielectric plate M102, and a plurality of small conductor plates M103 (small conductor pieces).

The conductor plate M101 is arranged on the entire surface of one surface (the surface on the Z' axis negative direction side) of the dielectric plate M102. The plurality of small conductor plates M103 are provided on the other surface (the surface on the Z' axis positive direction side, that is, the plate surface α shown in FIG. 6) of the dielectric plate M102, and are formed in a rectangular shape of the same size. In addition, the plurality of small conductor plates M103 are periodically arranged with predetermined intervals in each of the longitudinal direction (Y' axis direction) and the lateral direction (X' axis direction) of the other surface. One small conductor plate M103, and a part of the conductor plate M101 and the dielectric plate M102 constitute a periodic structure UC that is a minimum repetitive unit structure. A capacitance is formed between the plurality of small conductor plates M103, so that the amount of phase rotation of the electromagnetic wave reflected on the metamaterial reflecting plate M changes.

Figure 8:
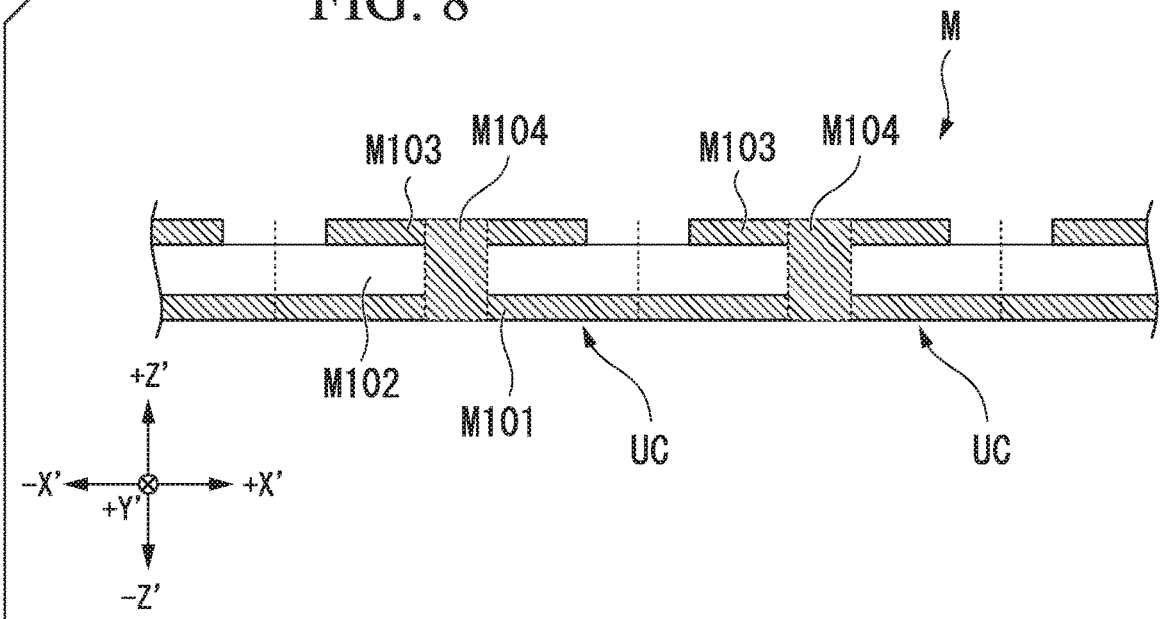
FIG. 8 is a diagram showing a second example of the structure of the metamaterial reflecting plate according to the first modified example of the first exemplary embodiment.
Figure 8:
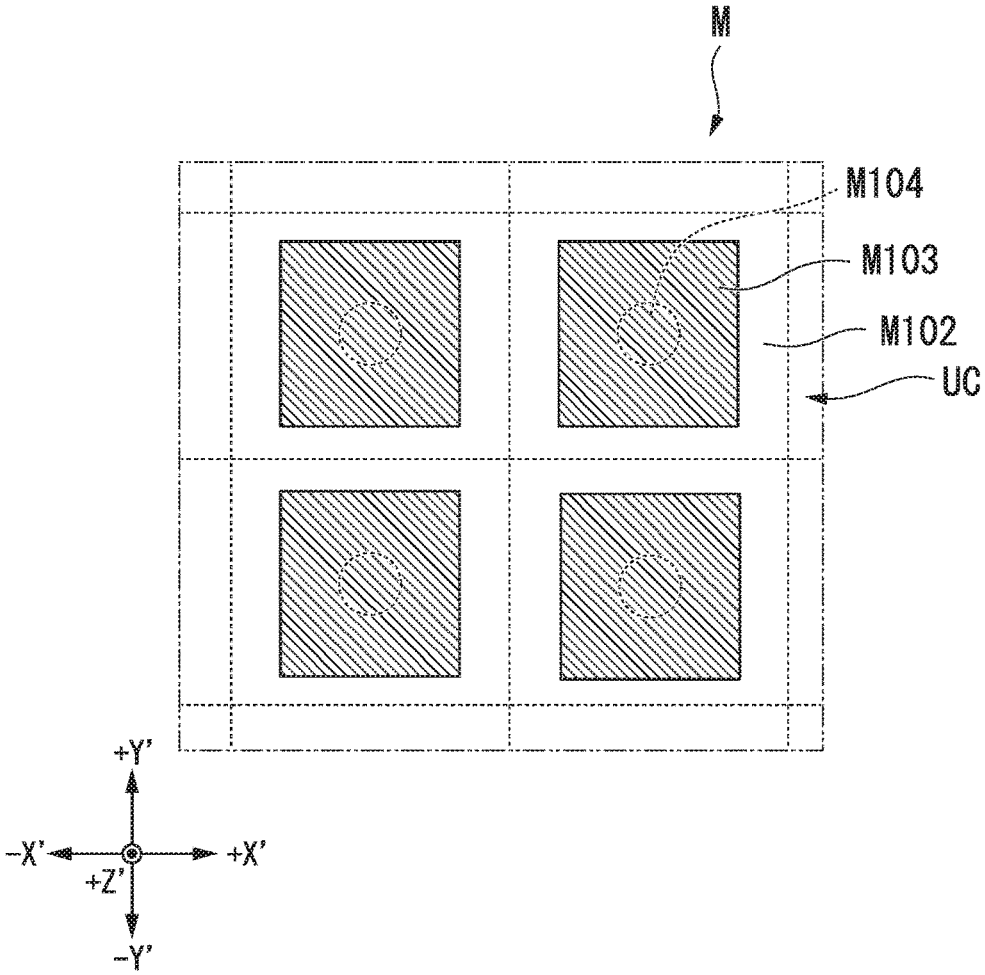

FIG. 8 is a diagram showing a second example of the structure of the metamaterial reflecting plate according to the first modified example of the first exemplary embodiment.

As shown in FIG. 8, a metamaterial reflecting plate M according to another example may include a plurality of conductor vias M104 that extend in the thickness direction (Z' axis direction) of the dielectric plate M102 while one end thereof is connected to the conductor plate M101 and the other end thereof is connected to each small conductor plate M103.

In this manner, the phase rotation by the small conductor plate M103 can be further changed by the conductor vias M104.

Figure 9:
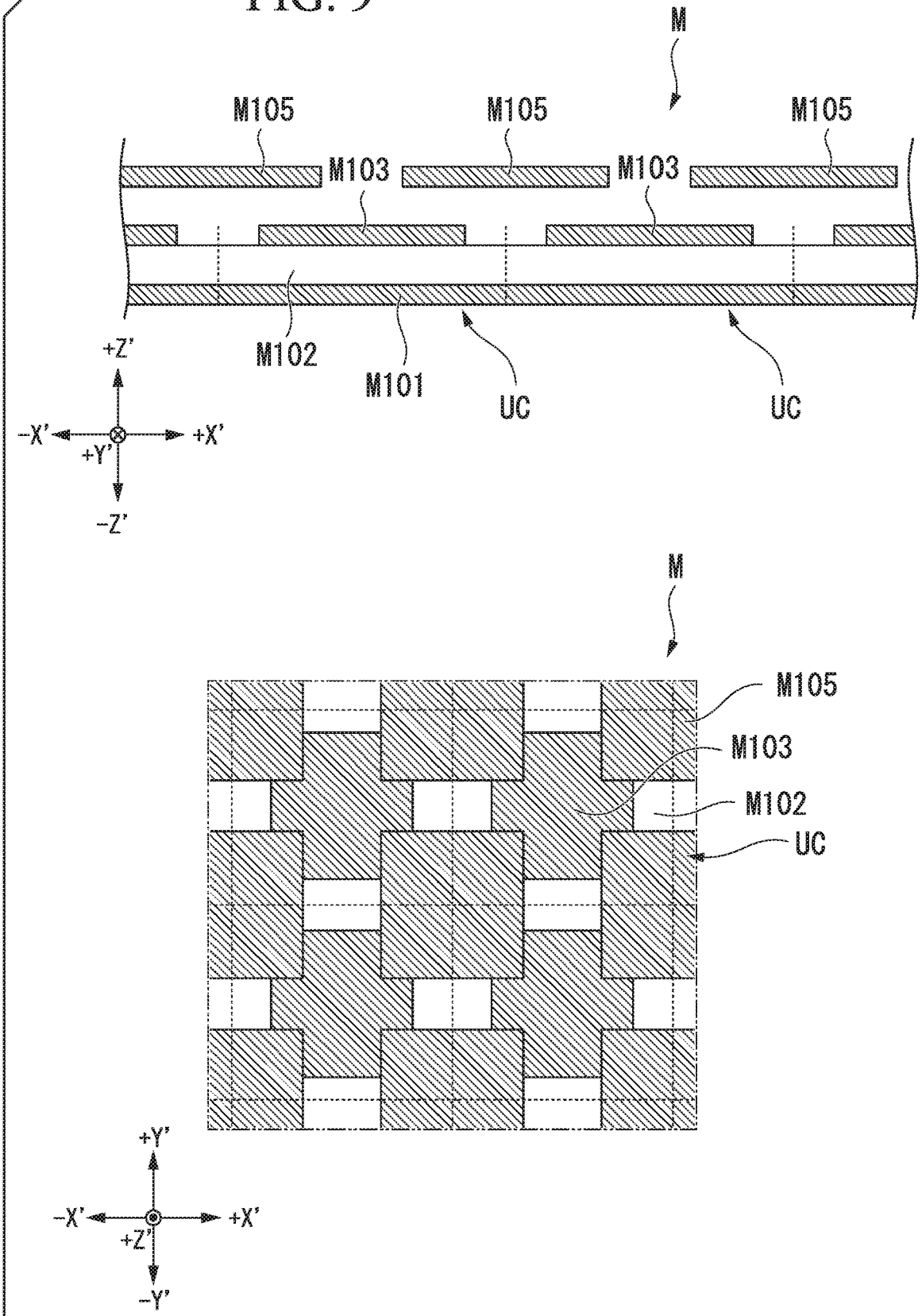
FIG. 9 is a diagram showing a third example of the structure of the metamaterial reflecting plate according to the first modified example of the first exemplary embodiment.

FIG. 9 is a diagram showing a third example of the structure of the metamaterial reflecting plate according to the first modified example of the first exemplary embodiment.

In the metamaterial reflecting plate M according to still another example, as shown in FIG. 9, the small conductor plate M 103 is periodically arranged inside the dielectric plate M 102. On one surface of the dielectric plate M102 opposite to the surface on which the conductive plate M101 is disposed, a plurality of small conductor plates M105 formed in the same shape and size as the small conductor plate M103 are periodically arranged. One small conductor plate M105 is disposed at a middle position in the longitudinal direction and the lateral direction of the periodically arranged plurality of small conductor plates M103, on one surface of the dielectric plate M102. That is to say, the small conductor plates M105 are arranged shifted by half a period in the longitudinal direction and the lateral direction respectively with respect to the arrangement period of the small conductor plates M103.

In this manner, the capacitance can be formed larger and the amount of phase rotation can be increased due to the presence of the small conductor plates M105.

In the multi-band antenna 10 according to the first exemplary embodiment and the modified example thereof, the first antenna element Ant01 and the second antenna element Ant02 are dual-band antennas that support respectively the two operating frequencies f1 and f2.

On the other hand, the multi-band antenna 10 according to another exemplary embodiment may be a multi-band antenna that supports three or more operating frequencies. In this case, each of the antenna elements Ant supporting the three or more operating frequencies is arranged so that distances from the plate surface α of the conductor reflecting plate 101 are equal to each other.

According to the multi-band antenna 10 according to the first exemplary embodiment and the modified example thereof, the extending directions of the first antenna element Ant01 and the second antenna element Ant02 are arranged substantially parallel (both along the X axis direction). However, they need not necessarily be placed in parallel.

Figure 10:
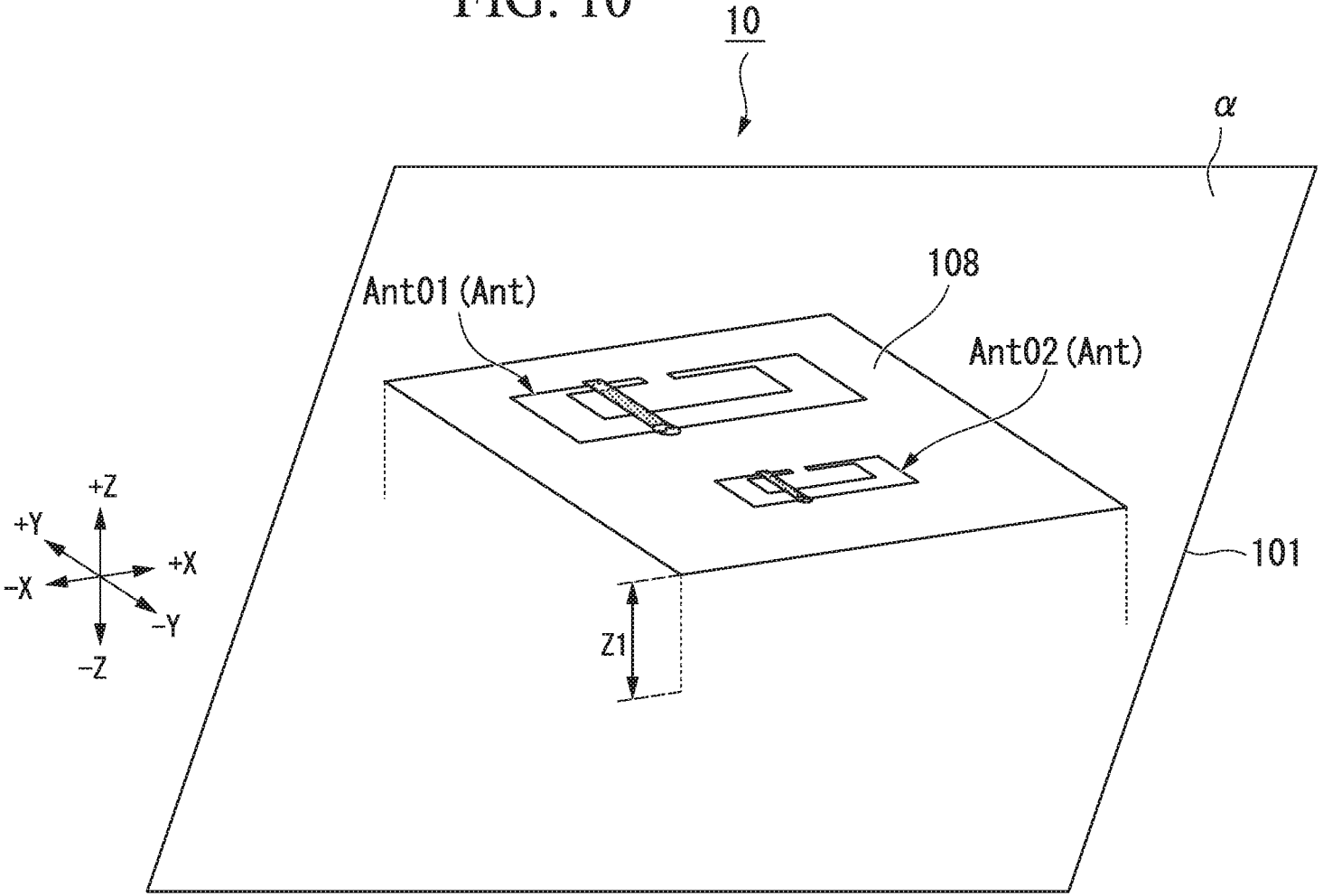
FIG. 10 is a perspective view of a multi-band antenna according to a second modified example of the first exemplary embodiment.

FIG. 10 is a perspective view of a multi-band antenna according to a second modified example of the first exemplary embodiment.

According to the multi-band antenna 10 according to the first exemplary embodiment and the modified example thereof, each antenna element Ant is arranged in an inverted orientation with respect to the plate surface α of the conductor reflecting plate 101 (in an orientation perpendicular to the plate surface α of the dielectric layer 108) (FIG. 1, FIG. 2). In other exemplary embodiments, it is not limited to this manner.

For example, as shown in FIG. 10, the first antenna element Ant01 and the second antenna element Ant02 may be arranged in an orientation in parallel with the plate surface α of the conductor reflecting plate 101 (in an orientation where the surface of the dielectric layer 108 is parallel with the plate surface α). In this case, as shown in FIG. 10, the first antenna element Ant01 and the second antenna element Ant02 may be formed on the same substrate and share the dielectric layer 108 that is provided parallel to and distanced by a predetermined distance Z1 from the plate surface α.

Figure 11:
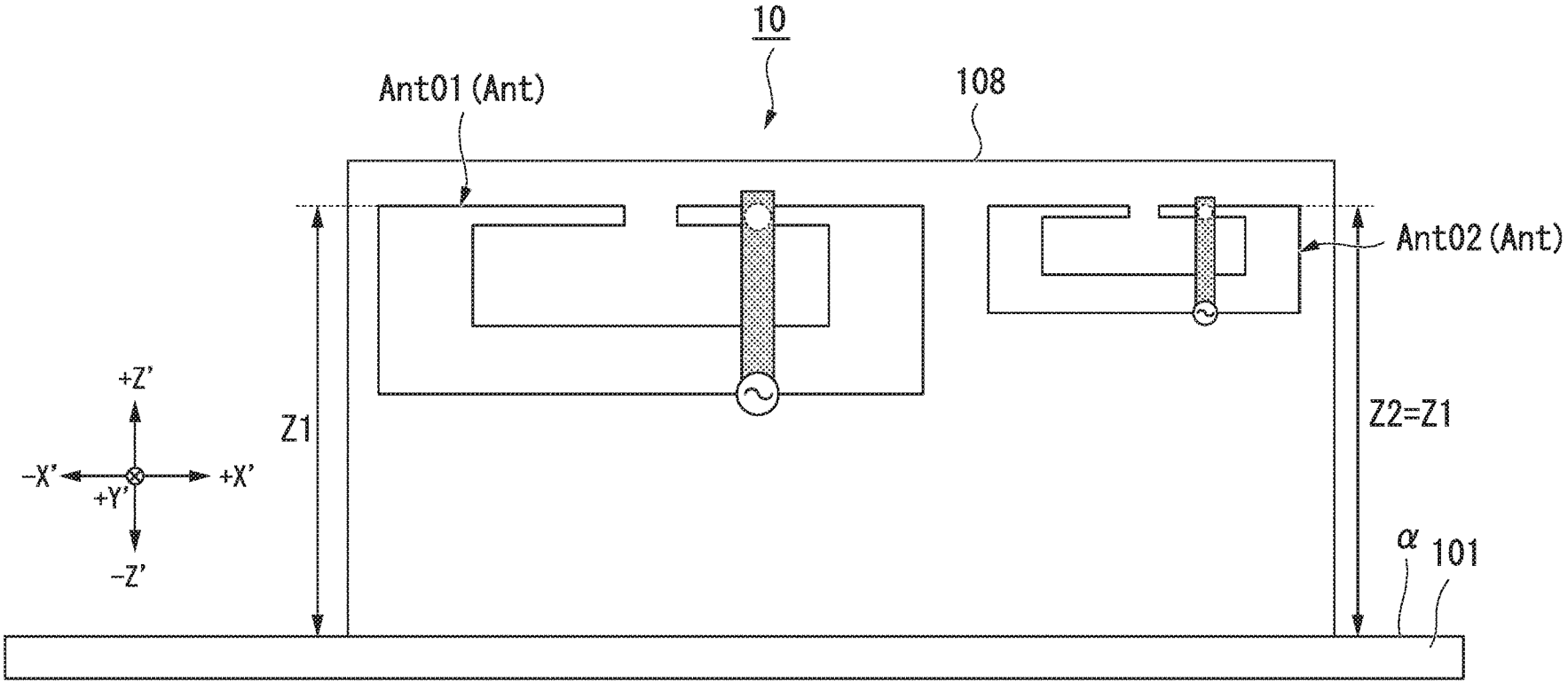
FIG. 11 is a front elevation view of a multi-band antenna according to a third modified example of the first exemplary embodiment.

FIG. 11 is a front elevation view of a multi-band antenna according to a third modified example of the first exemplary embodiment.

According to the multi-band antenna 10 according to the first exemplary embodiment and the modified example thereof, the first antenna element Ant01 and the second antenna element Ant02 are not arranged on the same plane (FIG. 1 and FIG. 2). In other exemplary embodiments, it is not limited to this manner.

For example, as shown in FIG. 11, the first antenna element Ant01 and the second antenna element Ant02 may be arranged on the same plane (which is parallel to the XZ plane). In this case, as shown in FIG. 11, the first antenna element Ant01 and the second antenna element Ant02 may be formed on the same substrate and share the dielectric layer 108 that is provided perpendicular to the plate surface α.

FIG. 12 to FIG. 16 are diagrams showing structures of antenna elements according to the third to seventh modified examples of the first exemplary embodiment.

The plurality of antenna elements Ant need not necessarily be of the structures shown in FIG. 1 and FIG. 2, and may have further structural improvements therein.

Figure 12:
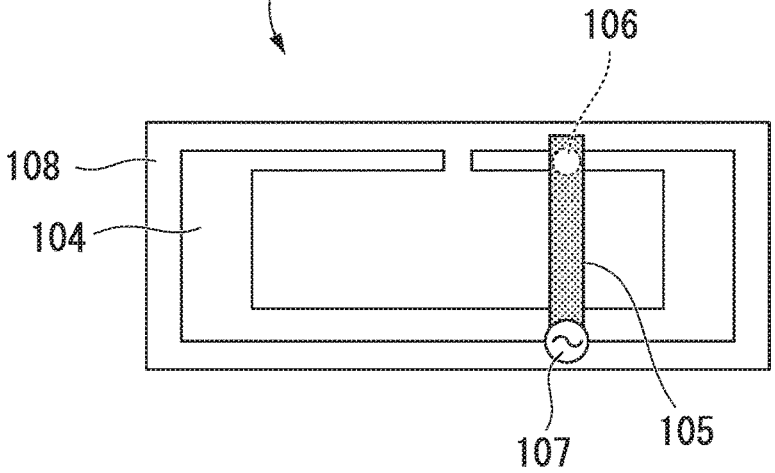
FIG. 12 is a diagram showing a structure of an antenna element according to the third modified example of the first exemplary embodiment.

For example, in antenna elements Ant according to another exemplary embodiment, as shown in FIG. 12, the surface of the dielectric layer 108 may be made large in size with respect to the rectangular annular surface of the annular conductor part 104. In this way, when allowing the dielectric layer 108 to be larger than the annular conductor part 104, it is possible to prevent cutting of the outer periphery of the dielectric layer 108 accompanying the formation of the dielectric layer 108, from causing a degradation in the dimensional accuracy of the annular conductor part 104.

Figure 13:
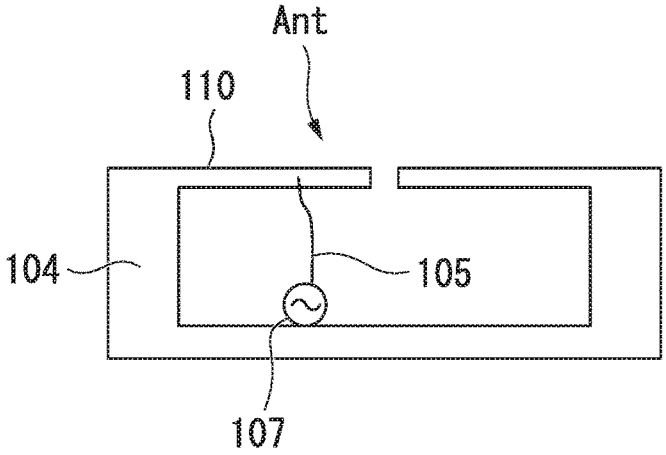
FIG. 13 is a diagram showing a structure of an antenna element according to a fourth modified example of the first exemplary embodiment.

In the antenna element Ant according to another exemplary embodiment, the conductor via 106 may be omitted by directly and electrically connecting one end of the conductor feeder line 105 to the upper long edge (conductor end part 110) of the annular conductor part 104. Specifically, as shown in FIG. 13, the conductor feeder line 105 may be a linear conductor such as a copper wire.

Figure 14:
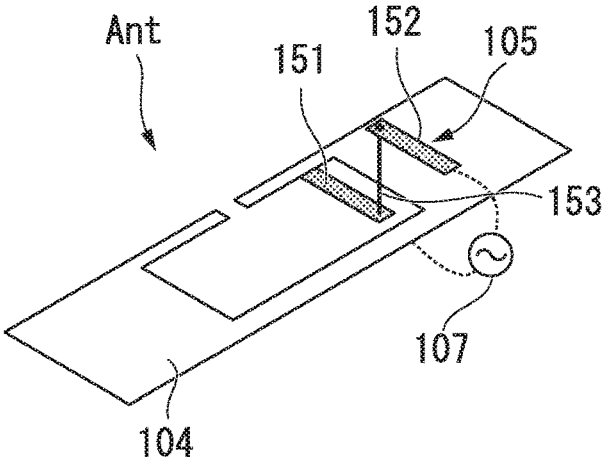
FIG. 14 is a diagram showing a structure of an antenna element according to a fifth modified example of the first exemplary embodiment.

As shown in FIG. 14, the antenna element Ant may be configured with a conductor via 153, and a plurality of conductor lines 151, 152 on each layer of which there is formed the conductor feeder line 105 that connects the conductor end part 110 (conductor end part 111) and the feeding point 107. The conductor via 153 electrically connects the conductor line 151 and the conductor line 152 each formed on a different layer.

Thereby, it is possible to avoid contact between the other end (the end part opposite to the one end connected to the conductor end part 110) of the conductor feeder line 105 and the annular conductor part 104.

Figure 15:
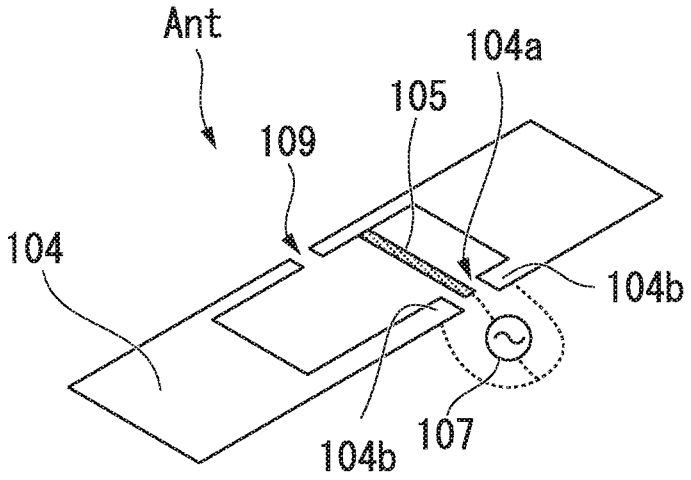
FIG. 15 is a diagram showing a structure of an antenna element according to a sixth modified example of the first exemplary embodiment.

As shown in FIG. 15, the antenna element Ant may be such that a portion of the long edge on the opposite side (the lower side (in the Z axis negative direction) from the long edge on the upper side (in the Z axis positive direction) where the split part 109 is provided in the circumferential direction of the annular conductor part 104 is cut away, and the conductor feeder line 105 is passed through the cutaway portion (missing part 104*a*). In this case, the feeding point 107 is provided so as to electrically excite between the conductor feeder line 105 and the end part (missing part conductor end part 104*b*) in the circumferential direction of the annular conductor part 104 that forms the missing part 104*a*.

In this way, the annular conductor part 104 and the conductor feeder line 105 can be formed in the same layer, making manufacturing easy.

Figure 16:
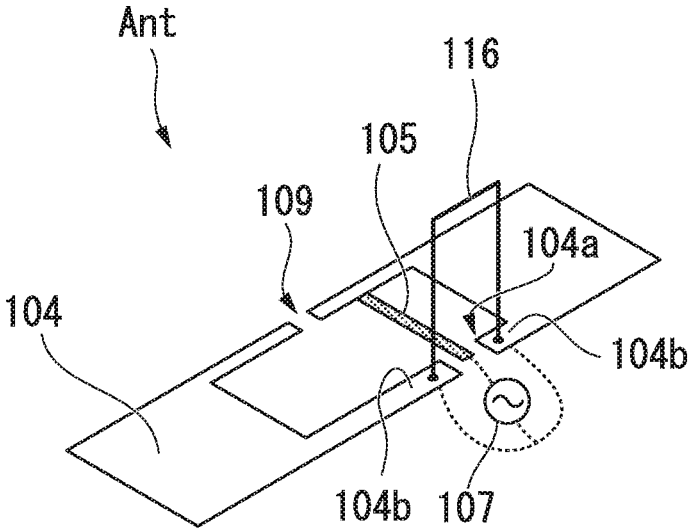
FIG. 16 is a diagram showing a structure of an antenna element according to a seventh modified example of the first exemplary embodiment.

However, in the example shown in FIG. 15, deterioration in the resonance characteristic of the antenna element Ant as a split ring resonator is assumed due to the cutaway in the annular conductor part 104. Accordingly, in order to compensate for the resonance characteristic deterioration, as shown in FIG. 16, the antenna element Ant may include a bridge conductor 116 that conducts the cutaway portion (the missing part 104*a*) of the annular conductor part 104 without contacting the conductor feeder line 105.

FIG. 17 to FIG. 26 are diagrams showing structures of antenna elements according to eighth to seventeenth modified examples of the first exemplary embodiment.

In addition to the above, the antenna element Ant may receive various types of improvements for improving the electric characteristics.

The split ring resonator having the annular conductor part 104 forms an LC serial resonator in which the inductance due to the current flowing along the ring, and the capacitance occurring between the conductor end part 110 and the conductor end part 111 facing each other via the split part 109 are connected in series. In the vicinity of the resonance frequency of the split ring resonator, a large current flows through the annular conductor part 104, and a part of the current component contributes to radiation, thereby operating as an antenna element. At this time, it is the current component in the extending direction (the X axis direction) of the antenna element Ant that mainly contributes to the radiation among the currents flowing through the annular conductor part 104. Therefore, by increasing the length of the annular conductor part 104 in the extending direction, excellent radiation efficiency can be realized. In FIG. 1 and FIG. 2, the two antenna elements Ant are substantially rectangular. However, even if the antenna elements Ant are of another shape, the essential effect of the present exemplary embodiment is not affected. For example, the shape of the antenna elements Ant may be a square, a circle, a triangle, a bow-tie shape, or the like.

Figure 17:
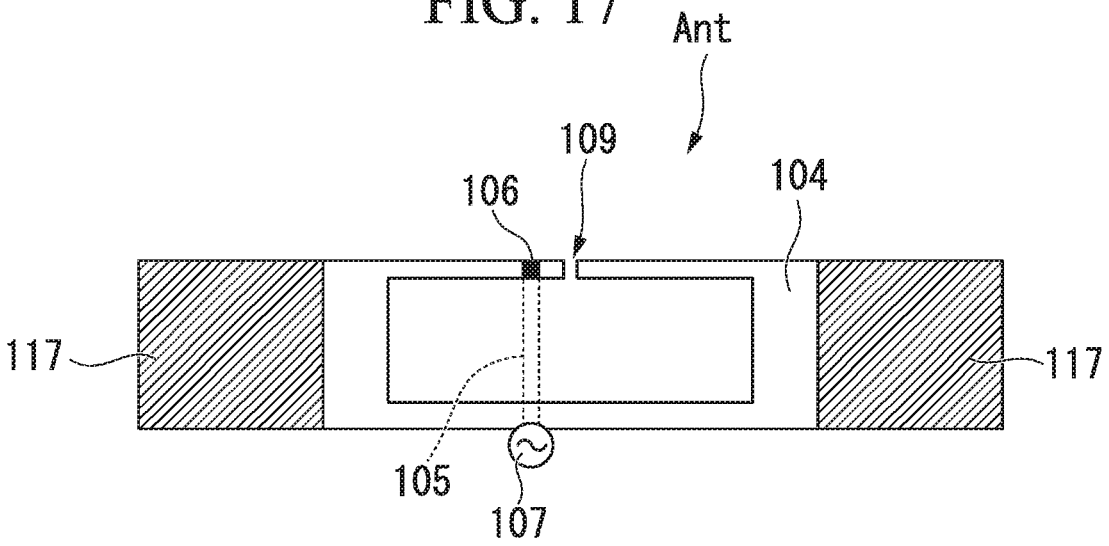
FIG. 17 is a diagram showing a structure of an antenna element according to an eighth modified example of the first exemplary embodiment.

As shown in FIG. 17, the antenna element Ant may include a conductive radiation part 117 at both ends in the extending direction (X axis direction) of the annular conductor part 104. With this type of configuration, the lengthwise current component of the annular conductor part 104 contributing to radiation can be guided to the radiation part 117, and therefore, the radiation efficiency can be improved.

In the example shown in FIG. 17, there is shown a case where the sizes of the edges of the portions where the radiation part 117 and the annular conductor part 104 are connected to each other are the same. However, the shape of the radiation part 117 is not limited to this.

Figure 18:
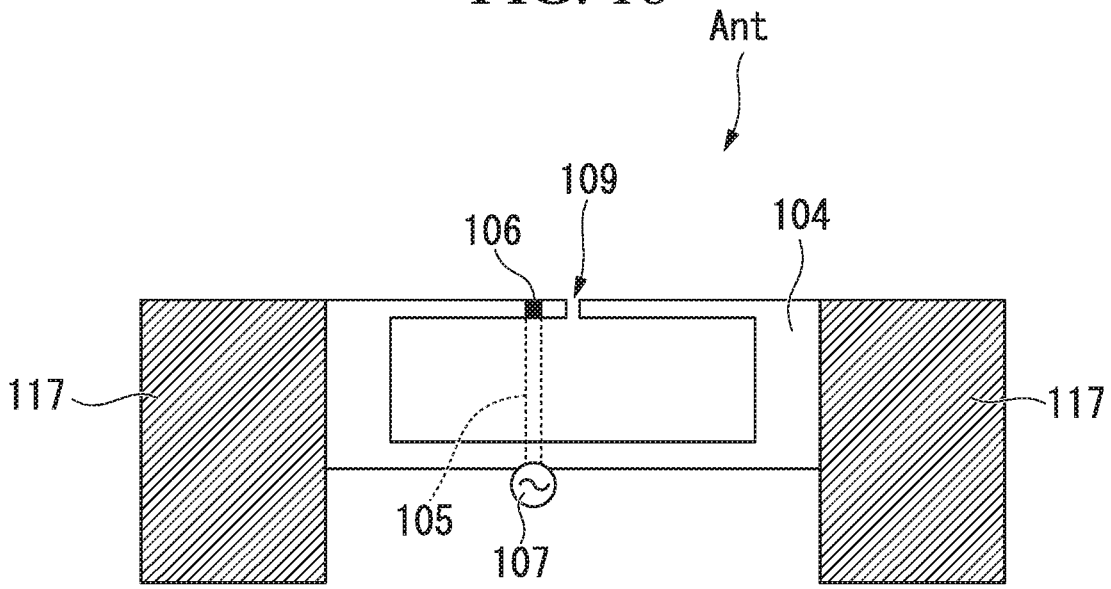
FIG. 18 is a diagram showing a structure of an antenna element according to a ninth modified example of the first exemplary embodiment.
Figure 19:
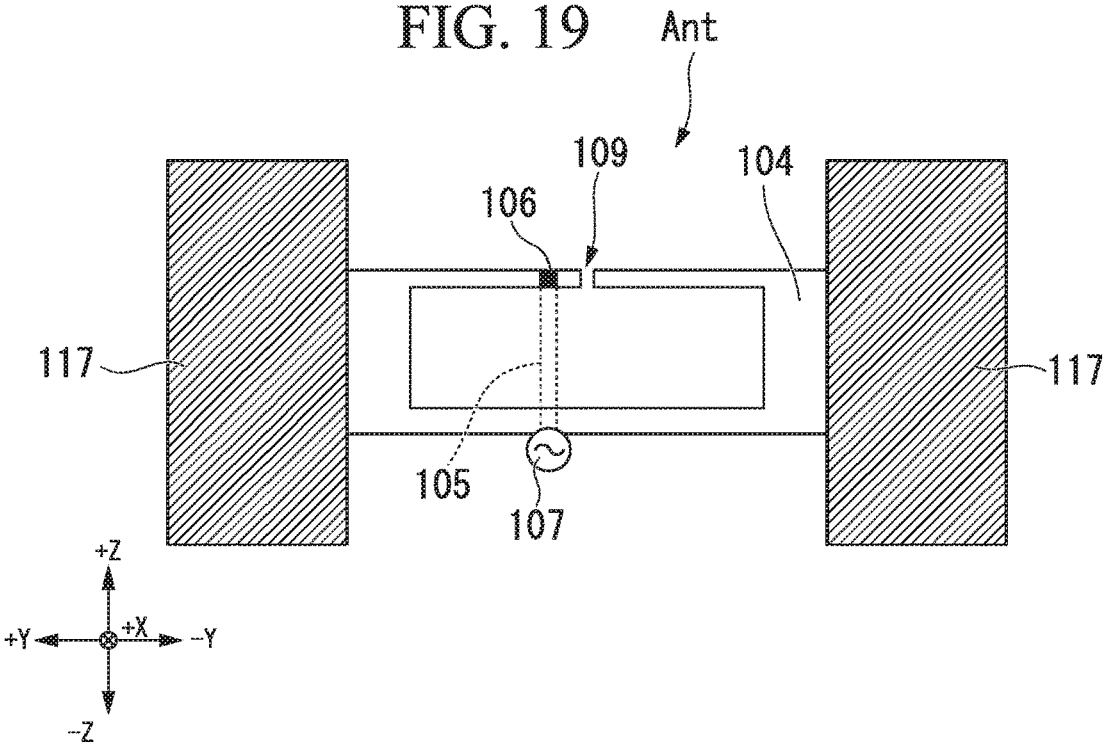
FIG. 19 is a diagram showing a structure of an antenna element according to a tenth modified example of the first exemplary embodiment.

For example, as shown in FIG. 18 and FIG. 19, regarding the size of each edge of the portion where the radiation part 117 and the annular conductor part 104 are connected, the radiation part 117 may be made larger than the annular conductor part 104. In the case of the configuration including the radiation part 117, if it is shaped in the extending direction (the X axis direction) of the antenna element Ant including the annular conductor part 104 and the radiation part 117, better radiation efficiency can be realized.

Figure 20:
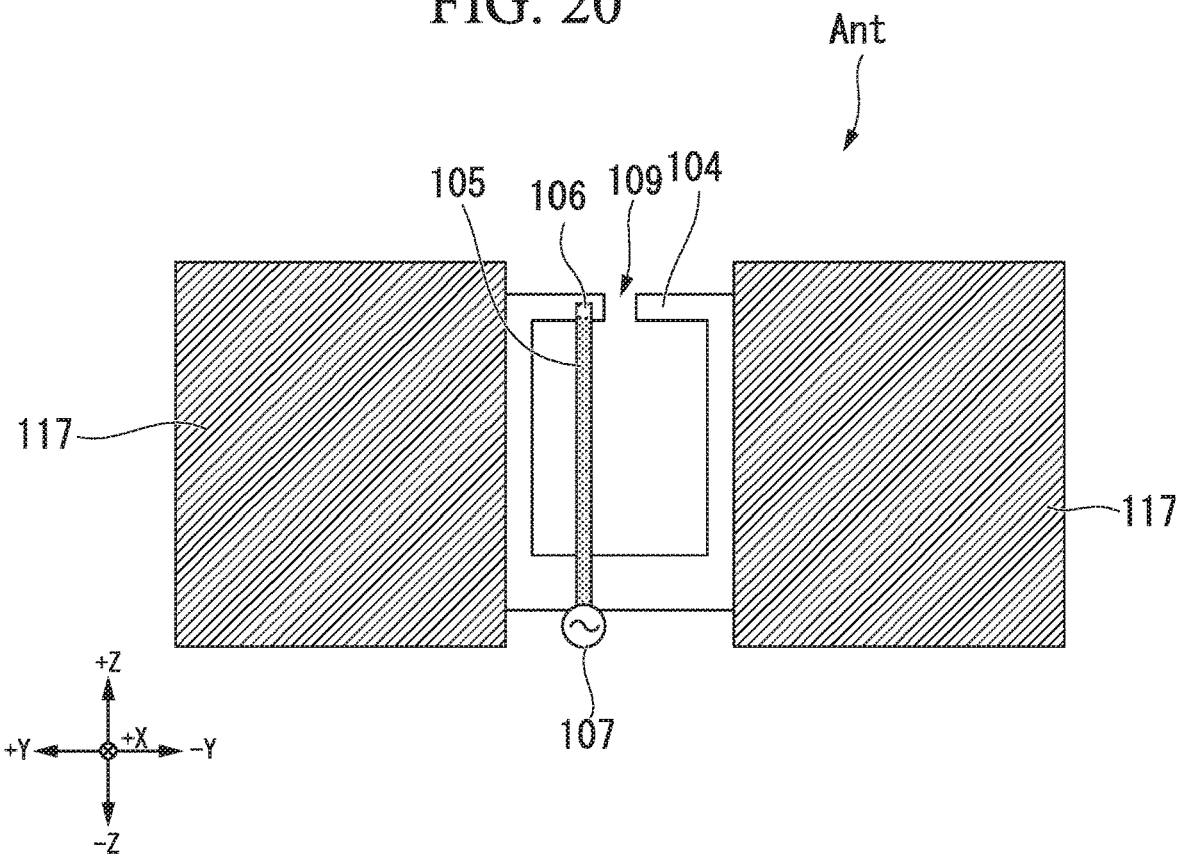
FIG. 20 is a diagram showing a structure of an antenna element according to an eleventh modified example of the first exemplary embodiment.

At this time, the annular conductor part 104 does not necessarily have to be formed in a rectangular shape in which its long edge is in the extending direction of the antenna element Ant. For example, as shown in FIG. 20, the shape of the annular conductor part 104 may be a rectangular shape having a long edge in the perpendicular direction (the Z axis direction in FIG. 1 and FIG. 2), a square shape, a circular shape, or a triangular shape.

As described above, the radiation part 117 is electrically connected to both ends of the annular conductor part 104 in the direction in which the conductor end parts 110, 111 extend in the annular conductor part 104.

The resonance frequency of the split ring resonator formed by the annular conductor part 104 can be increased by increasing the size of the split ring (annular conductor part 104) and thereby lengthening the current path to increase the inductance, or the resonance frequency can be lowered to a lower frequency by narrowing the gap of the split part 109 and thereby increasing the capacitance.

Figure 21:
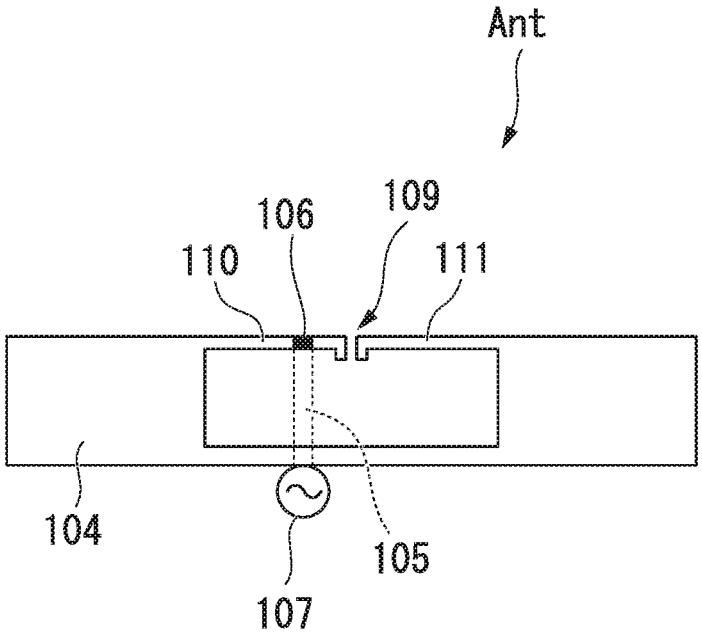
FIG. 21 is a diagram showing a structure of an antenna element according to a twelfth modified example of the first exemplary embodiment.

As a method for increasing the capacitance, for example, as shown in FIG. 21, the facing area of the opposing conductor end parts 110, 111 of the annular conductor part 104 with the split part 109 formed therein may be increased. In the example shown in FIG. 21, both ends of the conductor end parts 110, 111 facing each other via the split part 109 are bent in a direction substantially perpendicular to the opposing direction. With this configuration, the facing area between the conductor end part 110 and the conductor end part 111 facing each other via the split part 109 is increased, and the capacitance is increased.

Figure 22:
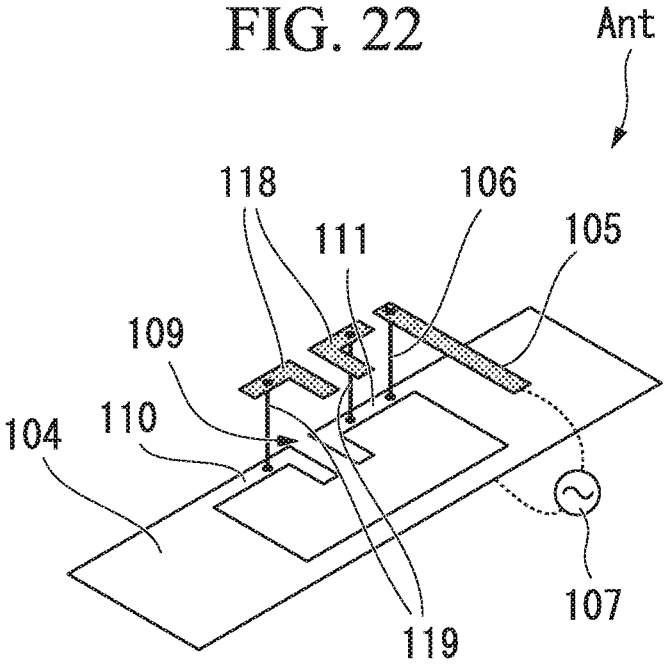
FIG. 22 is a diagram showing a structure of an antenna element according to a thirteenth modified example of the first exemplary embodiment.
Figure 23:
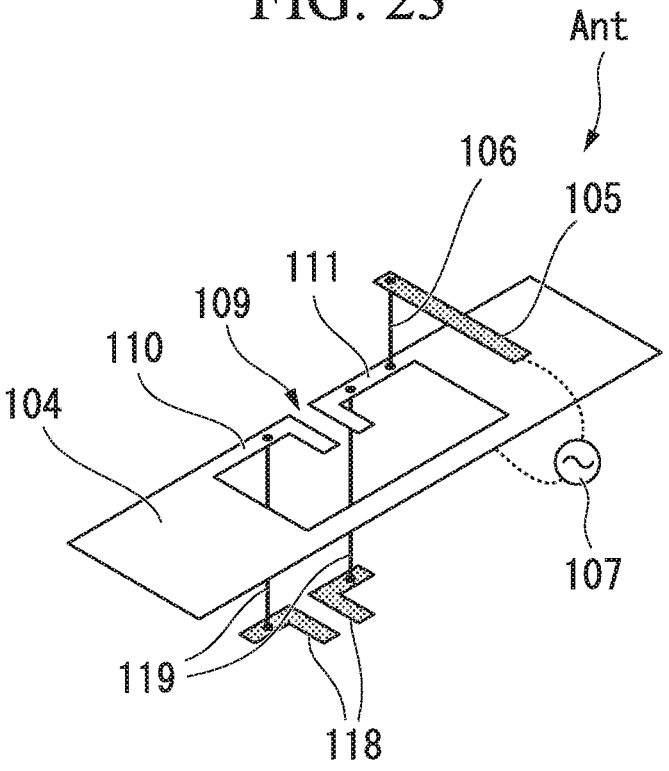
FIG. 23 is a diagram showing a structure of an antenna element according to a fourteenth modified example of the first exemplary embodiment.

Configurations shown in FIG. 22 and FIG. 23 may also be employed. That is to say, auxiliary conductor patterns 118 (auxiliary conductors) are provided in a layer different from the annular conductor part 104. The auxiliary conductor patterns 118 are connected to each of the conductor end parts 110, 111 through conductor vias 119 provided on the conductor end parts 110, 111. The facing area (capacitance) may be increased by using this configuration.

FIG. 22 shows an example of a case where the auxiliary conductor patterns 118 are disposed in the same layer as the conductor feeder line 105. FIG. 23 shows an example of a case where the auxiliary conductor patterns 118 are disposed in a layer different from the annular conductor part 104 and the conductor feeder line 105.

Figure 24:
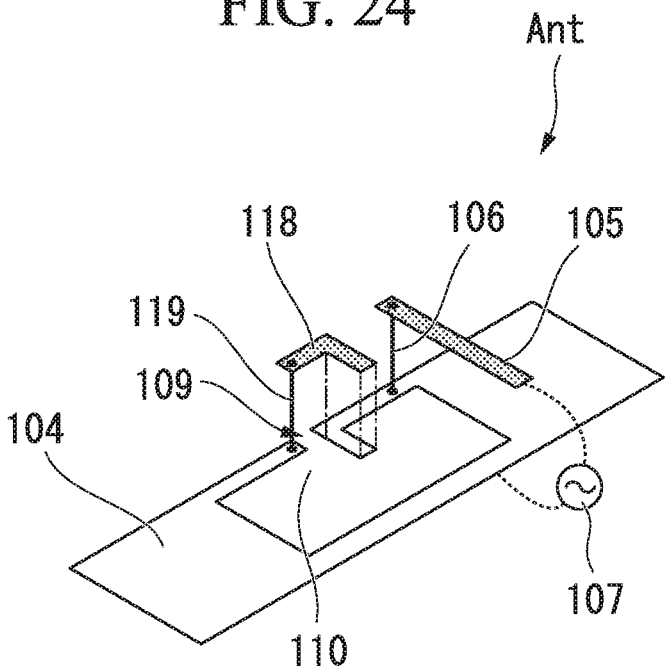
FIG. 24 is a diagram showing a structure of an antenna element according to a fifteenth modified example of the first exemplary embodiment.

As shown in FIG. 24, the auxiliary conductor pattern 118 may be provided on only either one of the conductor end parts 110, 111 (on only the conductor end part 110 in FIG. 24). In this case, the auxiliary conductor pattern 118 and at least a part of the other one of the conductor end parts 110, 111 (the conductor end part 111 in FIG. 24), and the layer of the annular conductor part 104 and the layer of the auxiliary conductor pattern 118 are opposed to each other in the perpendicular direction (Z axis direction). With this configuration, the facing area of the split part 109 is increased.

By changing the connection position between the conductor via 106 (one end of the conductor feeder line 105 when the conductor via 106 is omitted) and the annular conductor part 104, the input impedance of the split ring resonator seen from the feeding point 107 can be changed. By matching the input impedance of the split ring resonator with the impedance of a radio communication circuit unit or transmission line (not shown) connected to the feeding point 107, it is possible to feed wireless communication signals to the antenna without reflection. However, even if the input impedance is not matched, the essential action and effect of the present exemplary embodiment is not affected.

Figure 25:
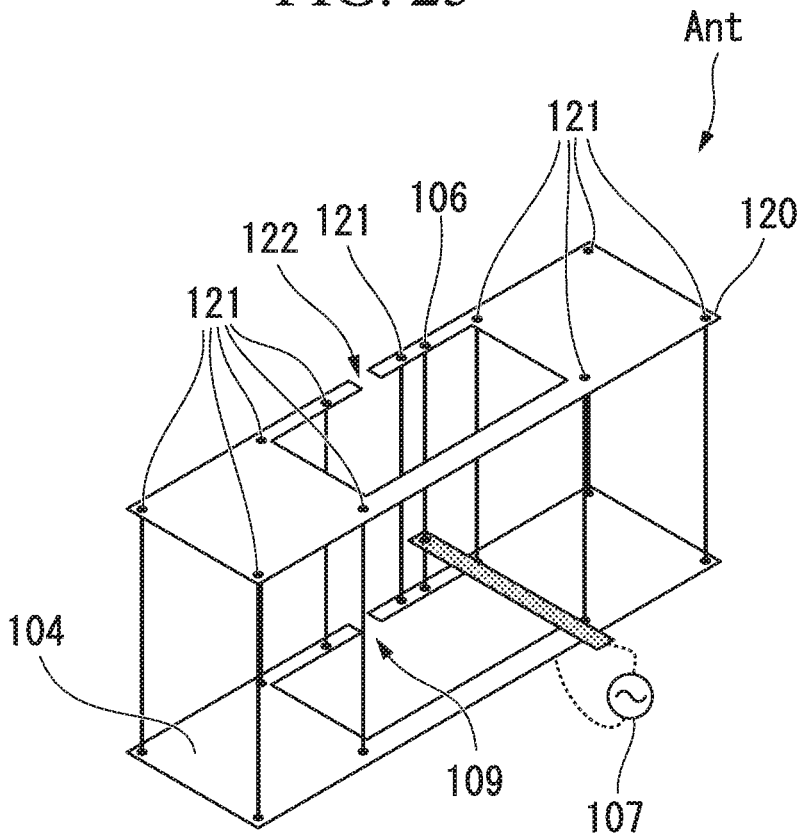
FIG. 25 is a diagram showing a structure of an antenna element according to a sixteenth modified example of the first exemplary embodiment.

As shown in FIG. 25, a second annular conductor part 120 is provided in a layer different from the annular conductor part 104 and the conductor feeder line 105, and the annular conductor part 104 and the second annular conductor part 120 may be electrically connected to each other by means of a plurality of conductor vias 121. In this case, the position where the split portion 109 in the circumferential direction of the annular conductor part 104 is provided, matches with the position where a second split part 122 in the circumferential direction of the second annular conductor part 120 is provided. The annular conductor part 104 and the second annular conductor part 120 operate as a single split ring resonator.

At this time, a substantial portion around the conductor feeder line 105 is surrounded by the annular conductor part 104, the second annular conductor part 120, and the plurality of conductor vias 121 which are conductors connected with each other. As a result, it is possible to reduce unwanted electromagnetic wave radiation from the conductor feeder line 105.

Figure 26:
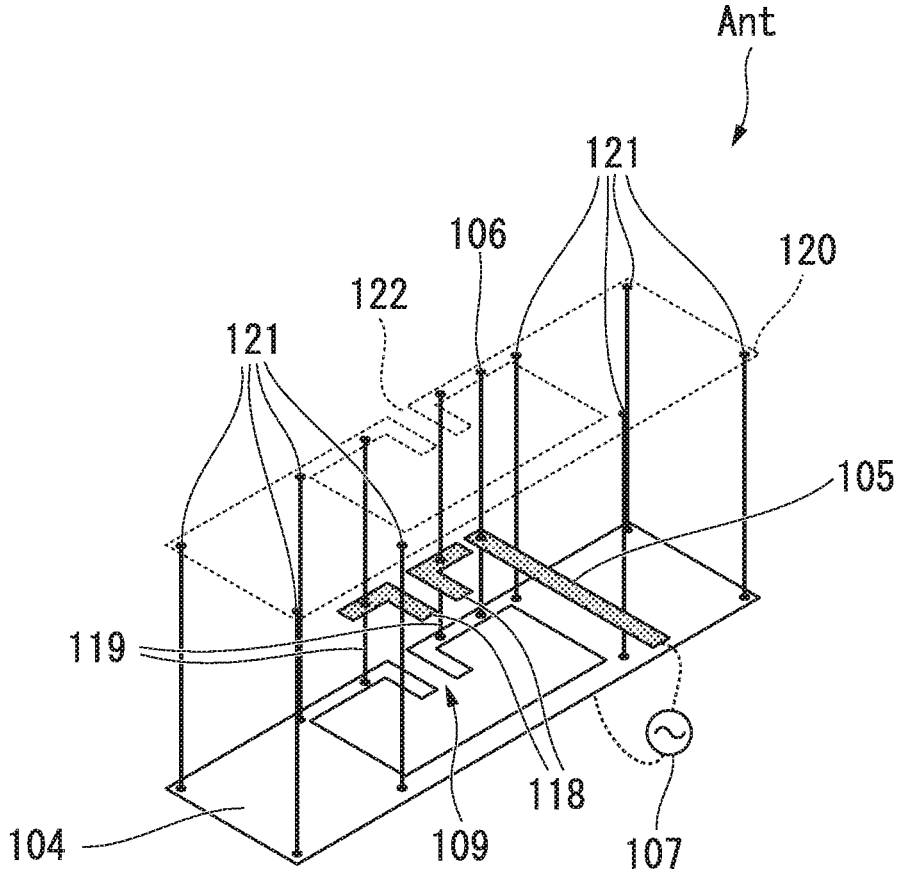
FIG. 26 is a diagram showing a structure of an antenna element according to a seventeenth modified example of the first exemplary embodiment.

As shown in FIG. 26, the configuration may be such that auxiliary conductor patterns 118 similar to those shown in FIG. 22 are provided in a layer different from the annular conductor part 104 and the second annular conductor part 120, and the auxiliary conductor patterns 118 are electrically connected to the annular conductor part 104 and the second annular conductor part 120 via conductor vias 119. The facing conductor areas at the split part 109 and the second split part 122 are increased by the auxiliary conductor patterns 118. Accordingly, capacitance can be increased without increasing the overall size of the split ring resonator.

Figure 27:
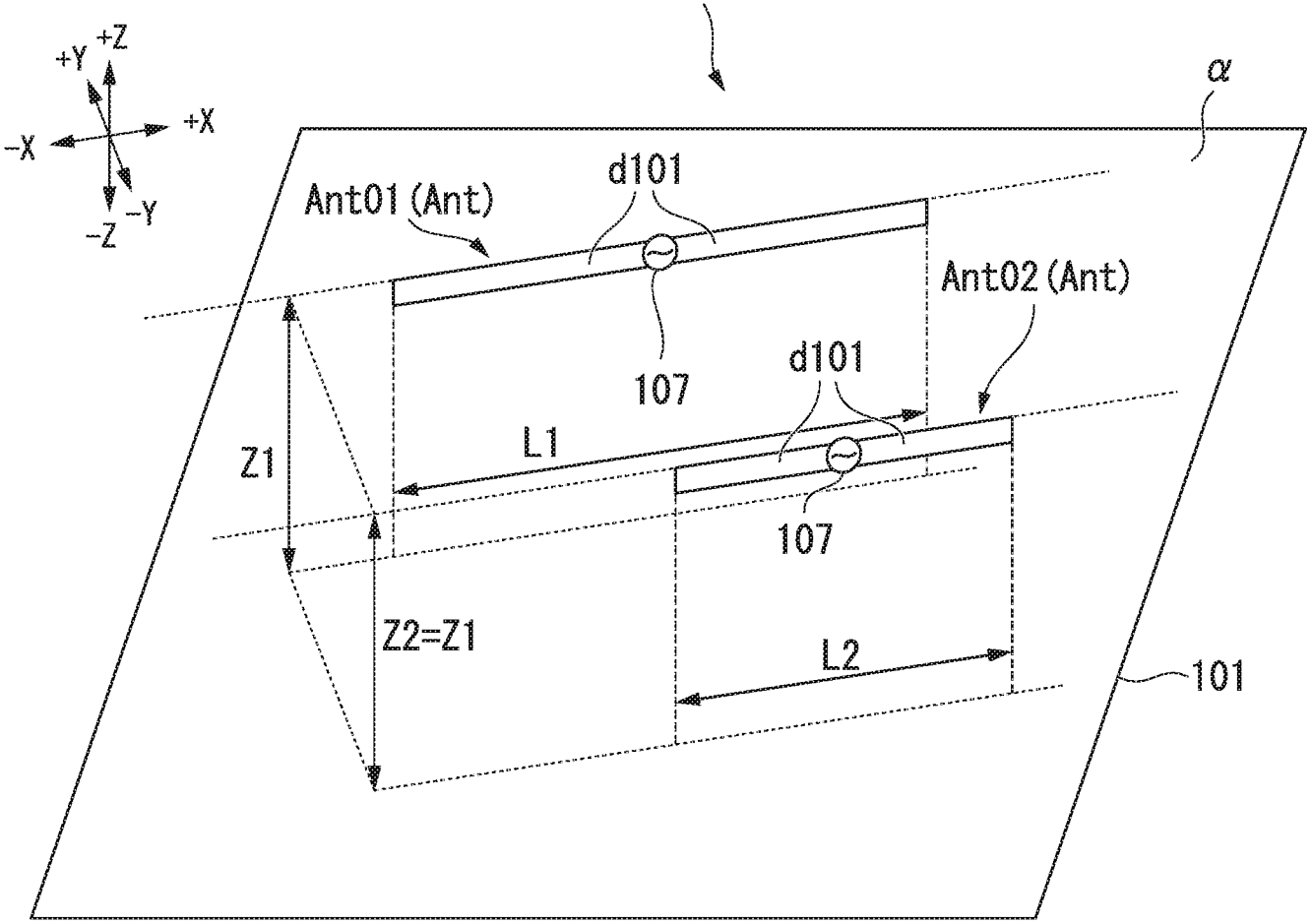
FIG. 27 is a perspective view of a multi-band antenna according to an eighteenth modified example of the first exemplary embodiment.

FIG. 27 is a perspective view of a multi-band antenna according to an eighteenth modified example of the first exemplary embodiment.

There has been described the case where the first antenna element Ant01 and the second antenna element Ant02 according to the first exemplary embodiment constitute a split ring resonator as shown in FIG. 1 and FIG. 2. In other exemplary embodiments, it is not limited to this manner.

For example, the first antenna element Ant01 and the second antenna element Ant02 according to the first exemplary embodiment may be dipole antenna elements as shown in FIG. 27.

As shown in FIG. 27, the first antenna element Ant01, which is a dipole antenna element, has two columnar conductor radiation parts d101 extending on the same axis (on the X axis) along the plate surface $\alpha$, and a feeding point 107. The feeding point 107 can electrically excite between the two conductor radiation parts d101. The length L1 of the conductor radiation parts d101 of the first antenna element Ant01 in the extending direction is set to approximately ½ (one half) of the wavelength λ1.

Similarly, the second antenna element Ant02, which is a dipole antenna element, has two columnar conductor radiation parts d101 extending on the same axis (on the X axis) along the plate surface α, and a feeding point 107. The feeding point 107 can electrically excite between the two conductor radiation parts d101. The length L2 of the conductor radiation parts d101 of the second antenna element Ant02 in the extending direction is set to approximately ½ of the wavelength λ2 (<λ1).

Also in this case, it is possible to suppress the influence of the mutual antenna elements Ant on the radiation pattern by making the distance Z1 and the distance Z2 from the plate surface α of the conductor reflecting plate 101 equal to each other (Z1=Z2).

Similarly, also in the case where the first antenna element Ant01 and the second antenna element Ant02 are dipole antenna elements, when only the influence on the resonance characteristics of the conductor reflecting plate 101 is taken into consideration, the distances Z1, Z2 are preferably arranged at a distance of approximately ¼ of the wavelength of the electromagnetic wave (wavelengths λ1, λ2), away from the reflecting plate. Therefore, when the distance Z1 and the distance Z2 are made approximately equal, in a case where the distance Z1 or the distance Z2 is made smaller than ¼ of the wavelengths λ1, λ2 of the electromagnetic waves, it is more preferable that the designs of the first antenna element Ant01 and the second antenna element Ant02 are finely adjusted, or the metamaterial reflecting plate M (FIG. 6) is used as a reflecting plate.

Second Exemplary Embodiment

Next, a multi-band antenna according to a second exemplary embodiment will be described in detail, with reference to FIG. 28 to FIG. 37. In the following description, of the constituents of the second exemplary embodiment, the same constituents as those of the above-described first exemplary embodiment are denoted by the same reference symbols, and the description thereof will be appropriately omitted.

Figure 28:
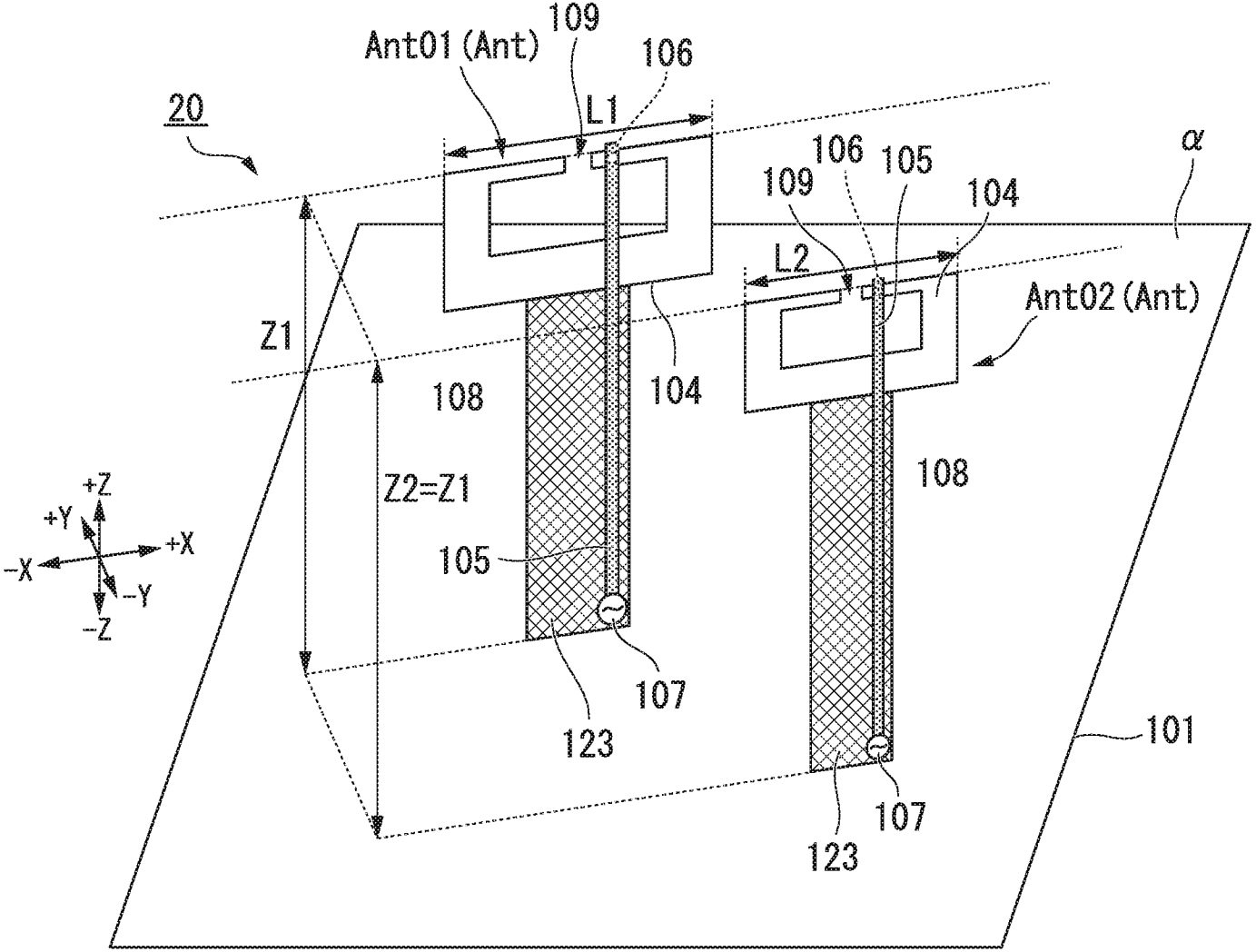
FIG. 28 is a perspective view of a multi-band antenna according to a second exemplary embodiment.

FIG. 28 is a perspective view of the multi-band antenna according to the second exemplary embodiment.

Figure 29:
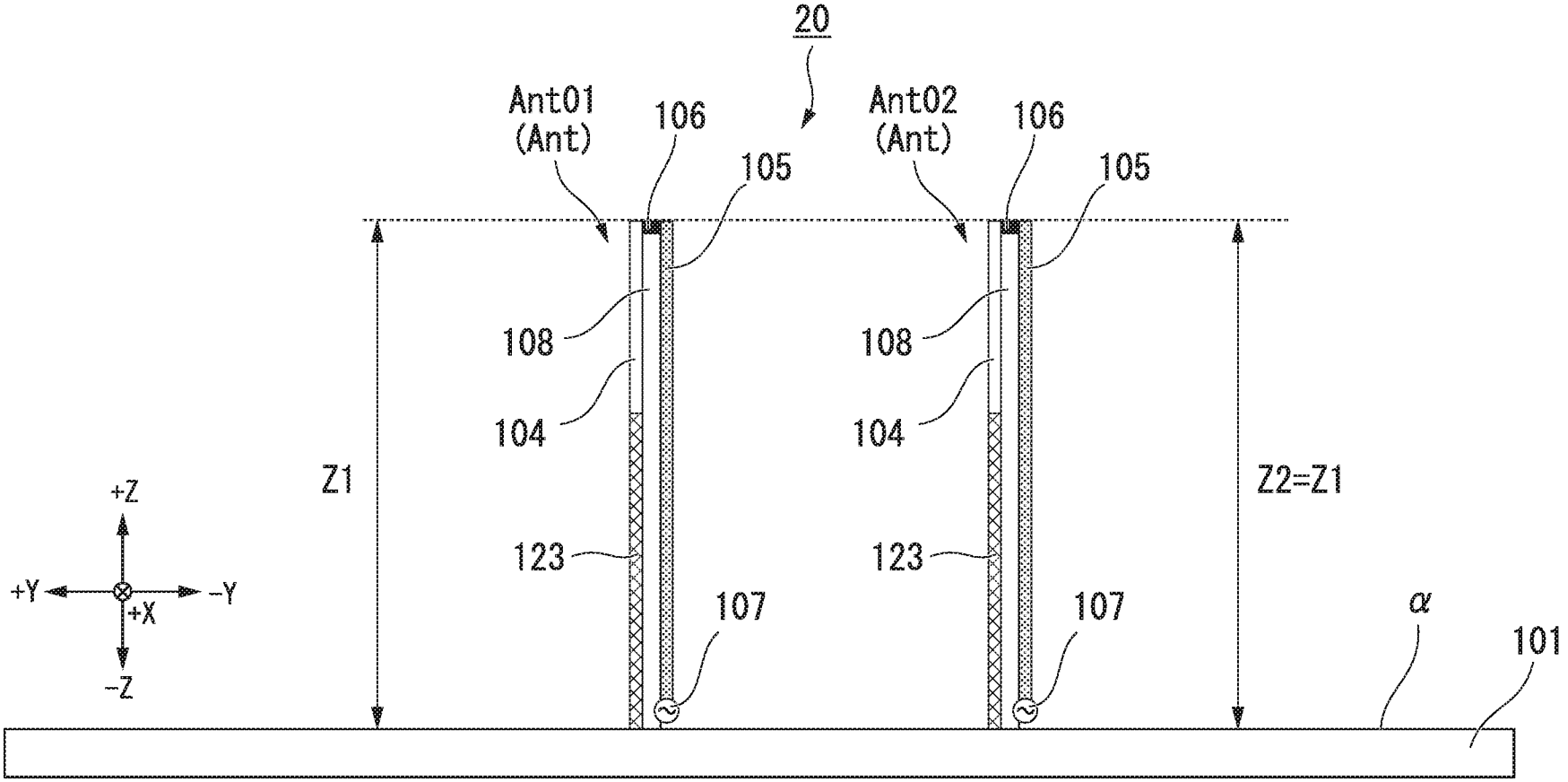
FIG. 29 is a front elevation view of a multi-band antenna according to the second exemplary embodiment.

FIG. 29 is a front elevation view of the multi-band antenna according to the second exemplary embodiment.

As shown in FIG. 28 and FIG. 29, the multi-band antenna 20 according to the second exemplary embodiment includes a conductor feeding GND part 123. One end of the conductor feeding GND part 123 in the perpendicular direction (Z axis direction) is connected to the outer periphery on the opposite side (lower side (Z axis negative direction)) of the annular conductor part 104 of each antenna element Ant to the side where the split part 109 is provided. The conductor feeding GND part 123 extends from the position where the annular conductor part 104 is disposed, to the plate surface α of the conductor reflecting plate 101 positioned on the lower side (Z axis negative direction) thereof. The other end of the conductor feeding GND part 123 is connected to the plate surface α.

A conductor feeder line 105 and a dielectric layer 108 extend in the perpendicular direction from the position where the annular conductor part 104 is disposed, to the vicinity of the plate surface α of the conductor reflecting plate 101 positioned on the lower side thereof. The conductor feeder line 105 extends in the perpendicular direction while facing the conductor feeding GND part 123 via the dielectric layer 108.

The feeding point 107 is arranged at the other end of the conductor feeder line 105 (the end part on the side opposite to the end part connected to the conductor via 106). The feeding point 107 can electrically excite between the other end of the conductor feeder line 105 mentioned above and the conductor feeding GND part 123 in the vicinity thereof. Here, the conductor feeding GND part 123 is connected to the plate surface α of the conductor reflecting plate 101. However, it need not always be connected.

As described above, the multi-band antenna 20 according to the second exemplary embodiment differs from the multi-band antenna 10 according to the first exemplary embodiment in that it includes the conductor feeding GND part 123. The shapes, positional relationships and the like of other constituents in the second exemplary embodiment are similar to those in the first exemplary embodiment.

In the second exemplary embodiment, the conductor feeding GND part 123 is connected to a portion positioned in the vicinity of the center in the extending direction (X axis direction) of the annular conductor part 104 among the lower side outer periphery of the annular conductor part 104. In this manner, the conductor feeding GND part 123 is connected to the annular conductor part 104 within a predetermined range from the center in the extending direction of the annular conductor part 104.

The action and effect of the multi-band antenna 20 according to the second exemplary embodiment will be described below.

In the case of connecting a feeding point and an antenna element via a transmission line transmitting wireless signals, a conductor (transmission line) is connected to a split ring resonator. Therefore, it is assumed that the resonance characteristics of the antenna element may change in some cases due to the arrangement, shape, and the like of the transmission line in the vicinity of the antenna element.

According to the multi-band antenna 20 according to the second exemplary embodiment, the portion where the conductor feeding GND part 123 is connected to the first antenna element Ant01 or the second antenna element Ant02 is positioned in the vicinity of the center in each extending direction.

When each antenna element Ant electromagnetically resonates, the vicinity of both ends in the extending direction of the antenna element Ant (the X axis direction in FIG. 28 and FIG. 29) becomes an electrically open plane, and it is brought into a state where the electric field strength is strong and the magnetic field strength is weak. On the other hand, when each of the antenna elements Ant electromagnetically resonates, the vicinity of the center in the extending direction of the antenna element Ant becomes electrically short-circuited, and it is brought into a state where the magnetic field strength is strong and the electric field strength is weak. Accordingly, the position where the conductor feeding GND part 123 is connected to each antenna element Ant becomes electrically short-circuited and is a portion where the electric field strength is weak at the time of resonance. Therefore, when the conductor feeding GND parts 123 are connected as shown in FIG. 28 and FIG. 29, the conductor feeding GND parts 123 do not increase the extra capacitance or inductance which affects the resonance characteristics. As a result, the inventors have learned that the resonance characteristic of each antenna element Ant hardly changes.

According to the multi-band antenna 20 according to the second exemplary embodiment, the conductor feeder line 105 and the conductor feeding GND part 123 form a transmission line that is connected to the antenna element Ant. The conductor feeder line 105 extends from the conductor via 106 to the vicinity of the plate surface α of the conductor reflecting plate 101 on the lower side thereof. The conductor feeding GND part 123 is arranged side by side with the conductor feeder line 105 via the dielectric layer 108. According to this transmission line, the influence on the resonance characteristic can be suppressed.

By providing the feeding point 107 on the far side from the antenna element Ant in this transmission line, it is possible to increase the distance between the transmission line that is connected ahead of the feeding point 107, and the antenna element Ant. As a result, the influence of the transmission line on the antenna element Ant can be reduced.

As described above, the conductor feeding GND part 123 is preferably connected to the vicinity of the center part in the extending direction (X axis direction) of the outer periphery on the lower side of the antenna element Ant, which is an electrically short-circuited plane at the time of resonating.

More specifically, the plane including the center of the extending direction of the antenna element Ant (X axis direction in FIG. 28 and FIG. 28) and perpendicular to the extending direction of the antenna element Ant (YZ plane in FIG. 28 and FIG. 29) becomes an electrically short-circuited plane at the time of resonating. It can be regarded substantially as a short-circuited plane as long as the distance from this electrically short-circuited plane is within a range of ¼ of the lengths L1, L2 in the extending direction of the antenna element Ant (in the case where the radiation part 117 is provided as a modified example, a size including the radiation part 117).

Therefore, the conductor feeding GND parts 123 are preferably connected within this range, that is, the range of ½ of the lengths L1, L2 in the extending direction of the antenna element Ant (in the case where the radiation part 117 is provided as a modified example, a size including the radiation part 117), while taking the middle part (electrically short-circuited plane) in the extending direction of the antenna element Ant as the center (within the range of ±¼ from the center). It is preferable that the lengths in the width direction (X axis direction) of the conductor feeding GND parts 123 along the extending direction of the antenna element Ant are not more than ½ of the lengths L1, L2 in the extending direction of the antenna element Ant.

However, even if the conductor feeding GND parts 123 are positioned in a range other than the above, the essential action and effect of this exemplary embodiment will not be affected. Moreover, even if the length in the width direction of the conductor feeding GND part 123 in the extending direction of the antenna element Ant is a length other than the above, the essential effect of the present exemplary embodiment will not be affected.

As described above, according to the multi-band antenna 20 of the second exemplary embodiment, in addition to the effect of the first exemplary embodiment, it is possible to provide a multi-band antenna capable of suppressing to a maximum extent the influence of the transmission line on the resonance characteristics of the antenna element Ant.

Moreover, as with the first exemplary embodiment, by configuring the radio communication device 1 (FIG. 4) using the multi-band antenna 20, it is possible to provide a radio communication device that supports multiple bands and that suppresses to a maximum extent the influence of the transmission line on the resonance characteristics of the antenna element Ant.

The antenna element Ant according to each modified example of the first exemplary embodiment can also be applied to the antenna element Ant of the second exemplary embodiment.

Figure 30:
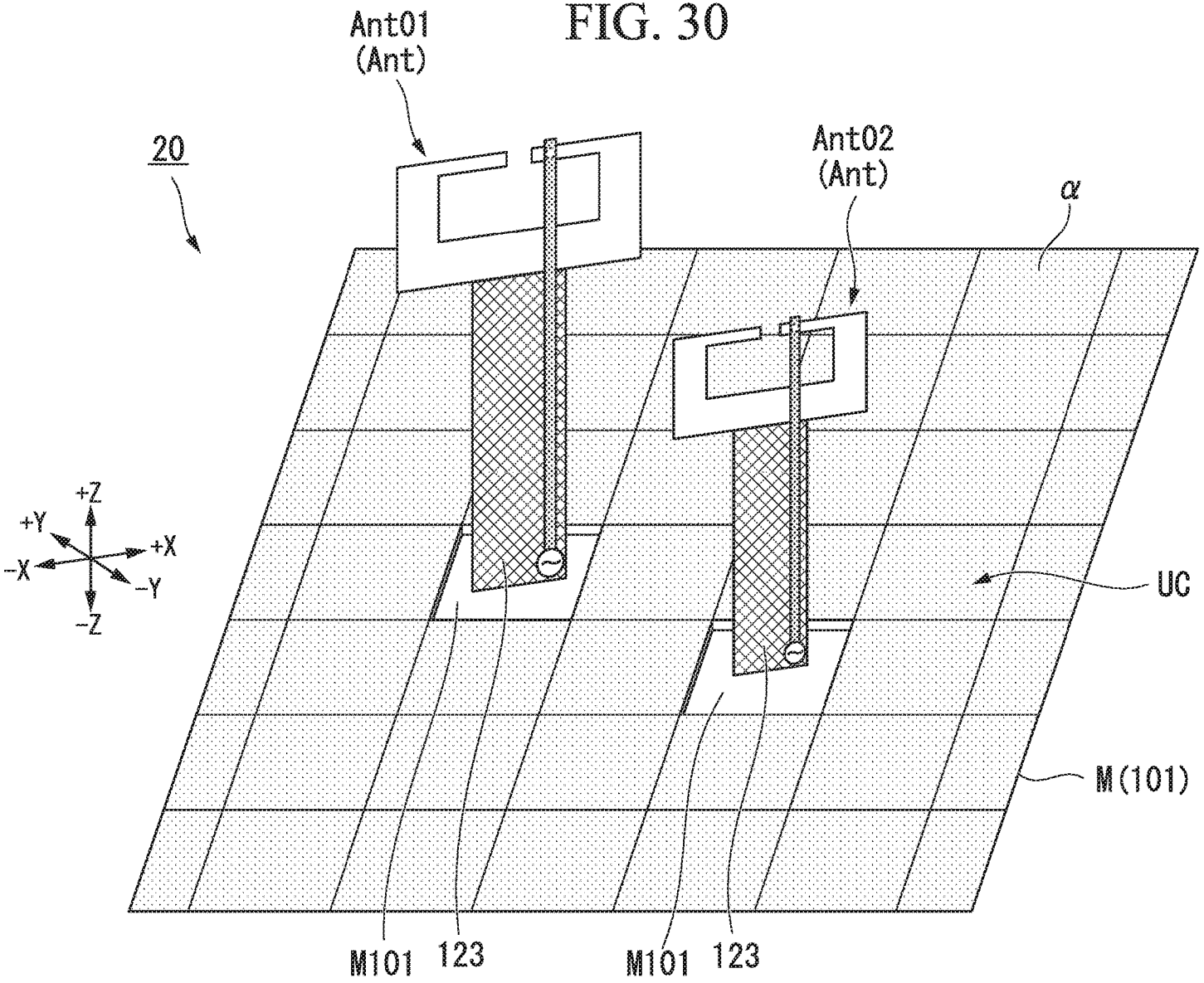
FIG. 30 is a perspective view of a multi-band antenna according to a first modified example of the second exemplary embodiment.

FIG. 30 is a perspective view of a multi-band antenna according to a first modified example of the second exemplary embodiment.

In the case of using the metamaterial reflecting plate M described in the modified example of the first exemplary embodiment as a conductor reflecting plate 101, for example, it may have the following structure.

Specifically, as shown in FIG. 30, among the periodic structures UC constituting the metamaterial reflecting plate M, the conductor pieces that constitute the periodic structures UC positioned right under the first antenna element Ant01 and the second antenna element Ant02 respectively are removed, so that only conductor plates M101 are present. In this way, it is possible to prevent the conductor feeder line 105 and the conductor feeding GND part 123 from overlapping with the periodic structures UC. Even in this case, the reflection phase control performance of the metamaterial reflecting plate M will not deteriorate significantly.

In the case where the antenna elements Ant are in a parallel attitude with respect to the plate surface α of the conductor reflecting plate 101 as in the second modified example of the first exemplary embodiment (FIG. 10), for example, the multi-band antenna 20 may be configured in the following manner.

Specifically, the antenna element Ant and the conductor reflecting plate 101 are respectively formed in different layers in the same substrate. Each conductor feeding GND part 123 is connected to the layer of the conductor reflecting plate 101 by a conductor via in the substrate. Each conductor feeder line 105 is also connected to the layer of the conductor reflecting plate by another conductor via in the substrate. In this manner, the entire multi-band antenna 20 may be formed as an integrated substrate.

As with the third modified example of the first exemplary embodiment (FIG. 11), when the antenna elements Ant are formed in the same substrate, each conductor feeding GND part 123 may also be formed in the same substrate.

Hereunder, various modified examples of the second exemplary embodiment will be described. Those various modified examples described below may be appropriately combined.

Figure 31:
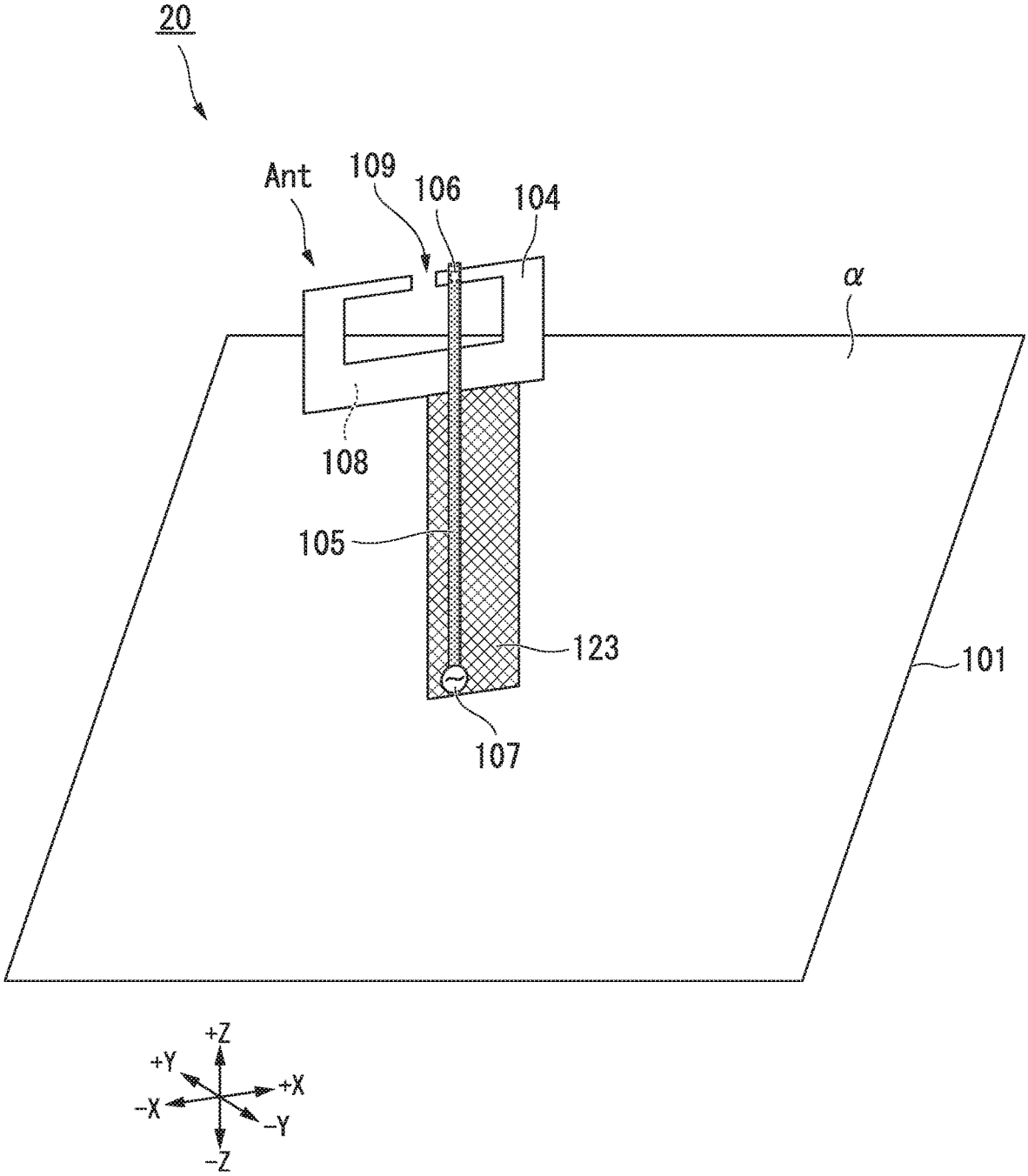
FIG. 31 is a perspective view of a multi-band antenna according to a second modified example of the second exemplary embodiment.

FIG. 31 is a perspective view of a multi-band antenna according to a second modified example of the second exemplary embodiment.

Even if the conductor feeding GND parts 123 are connected outside the range shown in the second exemplary embodiment (FIG. 28, FIG. 29), the essential effect of the present exemplary embodiment will not be affected. In addition, even if the length of the conductor feeding GND part 123 in the width direction (X axis direction) is outside the range shown in the second exemplary embodiment, the essential effect of the present exemplary embodiment will not be affected.

In the example shown in FIG. 31, one end of the conductor feeding GND part 123 in the width direction (X axis direction) thereof is in contact with the lower outer periphery of the annular conductor part 104, within the range of ±¼ from the center (electrically short-circuited plane) in the extending direction. On the other hand, the other end of the conductor feeding GND part 123 in the width direction (X axis direction) thereof is connected from the electrically short-circuited plane outside the range of ¼ of the lengths L1, L2 in the extending direction of the antenna element Ant. Also in this type of exemplary embodiment, it is sufficient that the influence of the conductor feeding GND part 123 on the resonance characteristics of the antenna element Ant is within an allowable range.

In the multi-band antenna according to the second exemplary embodiment (FIG. 28 and FIG. 29), the conductor feeding GND part 123 of each of the first antenna element Ant01 and the second antenna element Ant02 is each provided individually and is separated from each other. However, in the multi-band antenna 20 according to another exemplary embodiment, the conductor feeding GND part 123 may be connected within an allowable range of the influence on the resonance characteristics of the first antenna element Ant01 and the second antenna element Ant02.

As described in the first exemplary embodiment (FIG. 1 and FIG. 2), the input impedance to the antenna element Ant as seen from the feeding point 107 is dependent on the connection position of the conductor via 106 (in the case where the conductor via 106 is omitted, one end of the conductor feeder line 105) and the annular conductor part 104. In the multi-band antenna 20 according to the second exemplary embodiment, this input impedance is dependent also on the characteristic impedance of the transmission line composed of the conductor feeder line 105 extending in the perpendicular direction (Z axis direction) and the conductor feeding GND part 123. By matching the characteristic impedance of the transmission line mentioned above with the input impedance of the split ring resonator, it is possible to feed radio communication signals to the antenna without reflection between the transmission line and the split ring resonator. However, even if the input impedance is not matched, the essential effect of the present exemplary embodiment is not affected.

Figure 32:
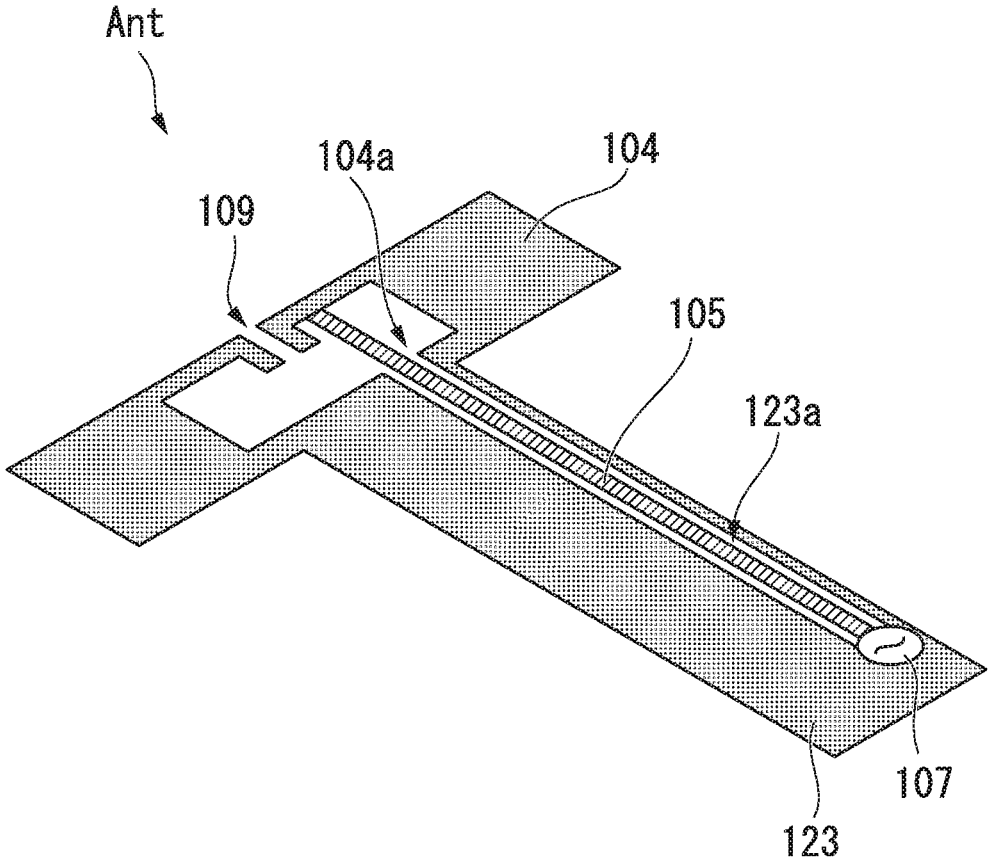
FIG. 32 is a diagram showing a structure of an antenna element according to a third modified example of the second exemplary embodiment.

FIG. 32 is a diagram showing a structure of an antenna element according to a third modified example of the second exemplary embodiment.

As shown in FIG. 32, the antenna element Ant may be such that the transmission line configured with the extending conductor feeder line 105 and the conductor feeding GND part 123 is a coplanar line, and the annular conductor part 104, the conductor feeder line 105, and the conductor feeding GND part 123 are formed in the same layer.

Specifically, as described in the sixth modified example and the seventh modified example of the first exemplary embodiment (FIG. 15, FIG. 16), the antenna element Ant is such that a part of the long edge of the side closer to conductor reflecting plate 101 in the circumferential direction of the annular conductor part 104 (the lower side (Z axis negative direction in FIG. 28 and FIG. 29)) is cut away. The conductor feeder line 105 passes through the cutaway part (missing part 104*a*). The missing part 104*a* communicates with a slit 123*a* which is formed by cutting away a part of the plane of the conductor feeding GND part 123. The conductor feeder line 105 is inserted through the inside of the slit 123*a* toward the plate surface α of the conductor reflecting plate 101 (the Z axis negative direction in FIG. 28 and FIG. 29). With this configuration, the transmission line configured with the conductor feeder line 105 and the conductor feeding GND part 123 can serve as a coplanar line.

Figure 33:
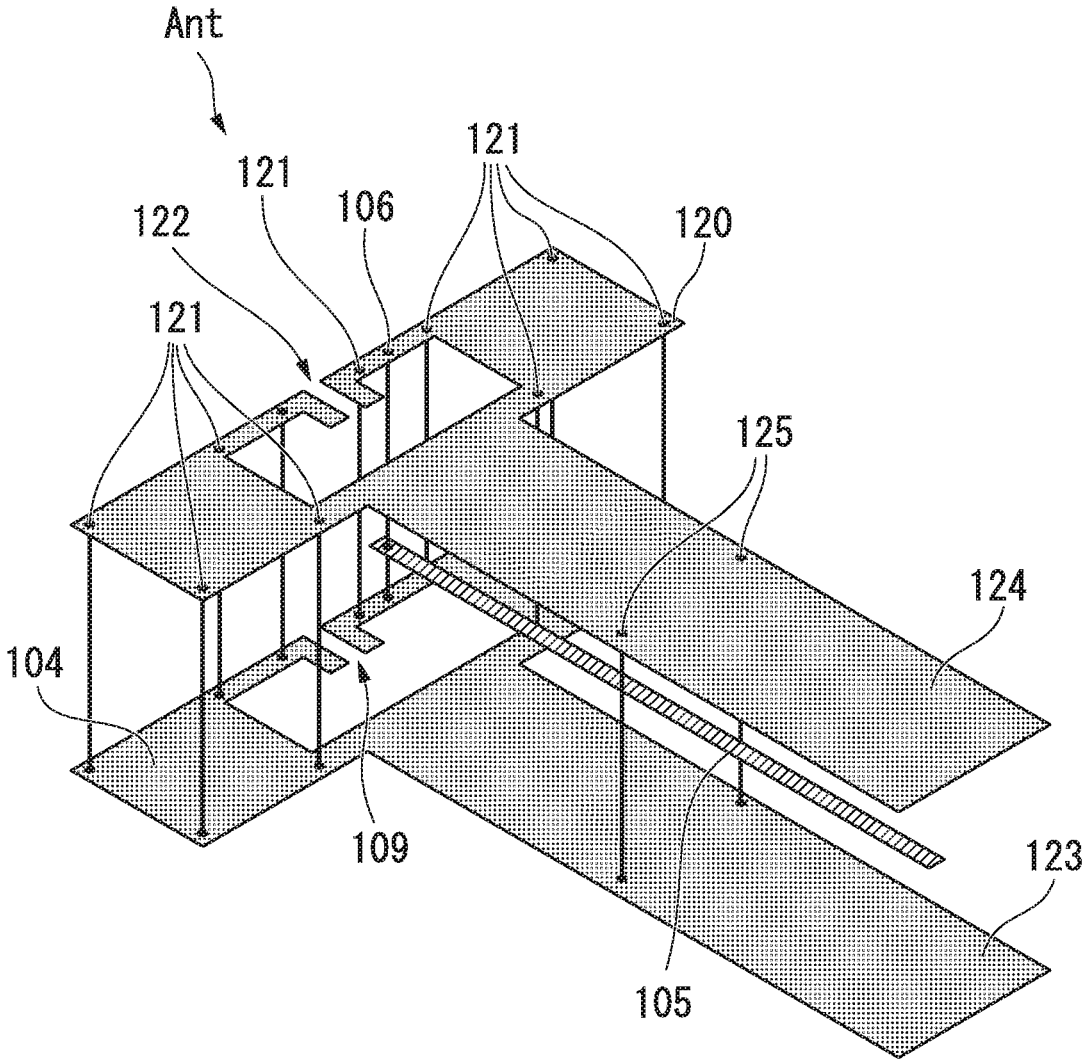
FIG. 33 is a diagram showing a structure of an antenna element according to a fourth modified example of the second exemplary embodiment.

FIG. 33 is a diagram showing a structure of an antenna element according to a fourth modified example of the second exemplary embodiment.

As shown in FIG. 33, the antenna element Ant may include a second annular conductor part 120 similar to that in the sixteenth modified example and the seventeenth modified example of the first exemplary embodiment (FIG. 25 and FIG. 26), and a plurality of conductor vias 121, and may further include a second conductor feeding GND part 124 and a plurality of conductor vias 125. In the example shown in FIG. 33, the second annular conductor part 120 is provided in a layer different from the annular conductor part 104 and the conductor feeder line 105. The second conductor feeding GND part 124 is connected to the second annular conductor part 120 in the same layer as the second annular conductor part 120 as in the case where the conductor feeding GND part 123 is connected to the annular conductor part 104, and faces the conductor feeder line 105. The plurality of conductor vias 125 electrically connect the conductor feeding GND part 123 and the second conductor feeding GND part 124.

At this time, a substantial portion around the conductor feeder line 105 is surrounded by the second conductor feeding GND part 124 and the plurality of conductor vias 125, in addition to the annular conductor part 104, the second annular conductor part 120, and the plurality of conductor vias 121, which are conductors connected with each other. As a result, it is possible to reduce unwanted signal electromagnetic wave radiation from the conductor feeder line 105.

Figure 34:
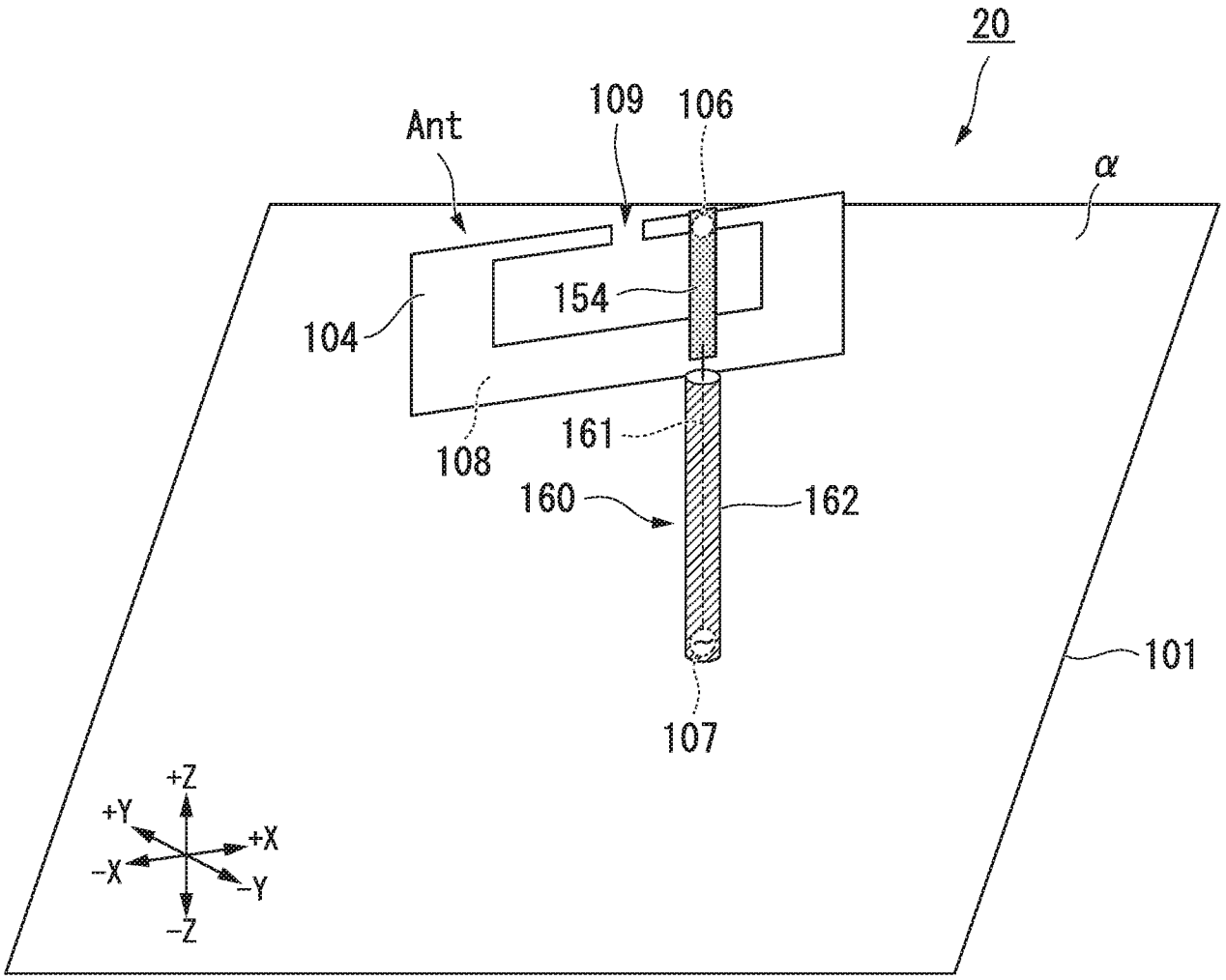
FIG. 34 is a perspective view of a multi-band antenna according to a fifth modified example of the second exemplary embodiment.

FIG. 34 is a perspective view of a multi-band antenna according to a fifth modified example of the second exemplary embodiment.

The transmission line configured with the conductor feeder line 105 and the conductor feeding GND part 123 described in the second exemplary embodiment may be a coaxial line.

As shown in FIG. 34, the antenna element Ant has a conductor feeder line 154 having a structure similar to that of the conductor feeder line 105 according to the first exemplary embodiment (FIG. 1 and FIG. 2). A coaxial cable 160 is connected to the antenna element Ant. The coaxial cable 160 is composed of a core wire 161 and an outer conductor 162. The core wire 161 is connected to the conductor feeder line 154. The outer conductor 162 is connected to the outer periphery on the lower side of the annular conductor part 104. The feeding point 107 is provided so as to electrically excite between the core wire 161 and the outer conductor 162. The core wire 161 and the conductor feeder line 154 connected to each other correspond to the conductor feeder line 105. The outer conductor 162 corresponds to the conductor feeding GND part 123 formed in a cylindrical shape.

Figure 35:
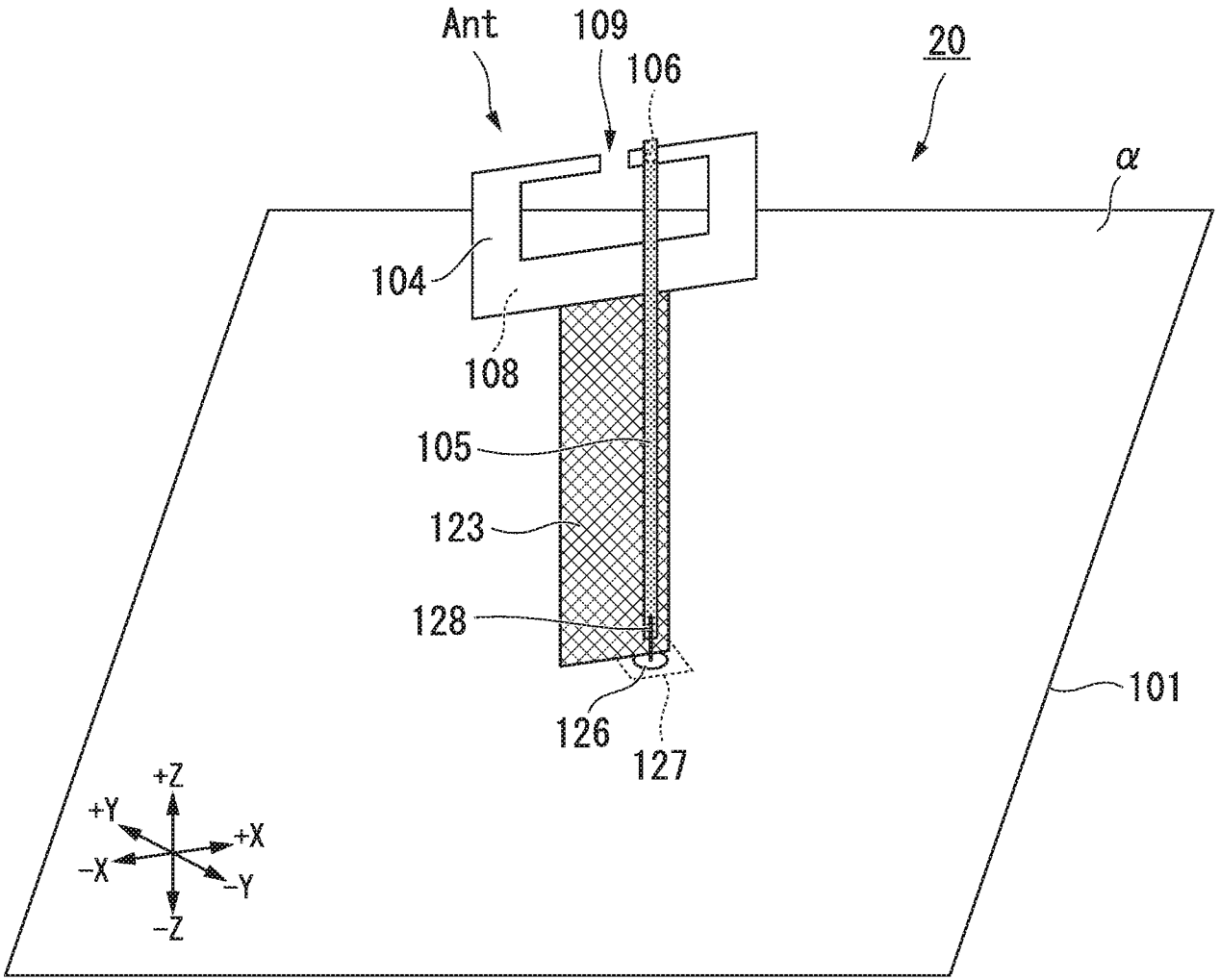
FIG. 35 is a perspective view of a multi-band antenna according to a sixth modified example of the second exemplary embodiment.

FIG. 35 is a perspective view of a multi-band antenna according to a sixth modified example of the second exemplary embodiment.

Figure 36:
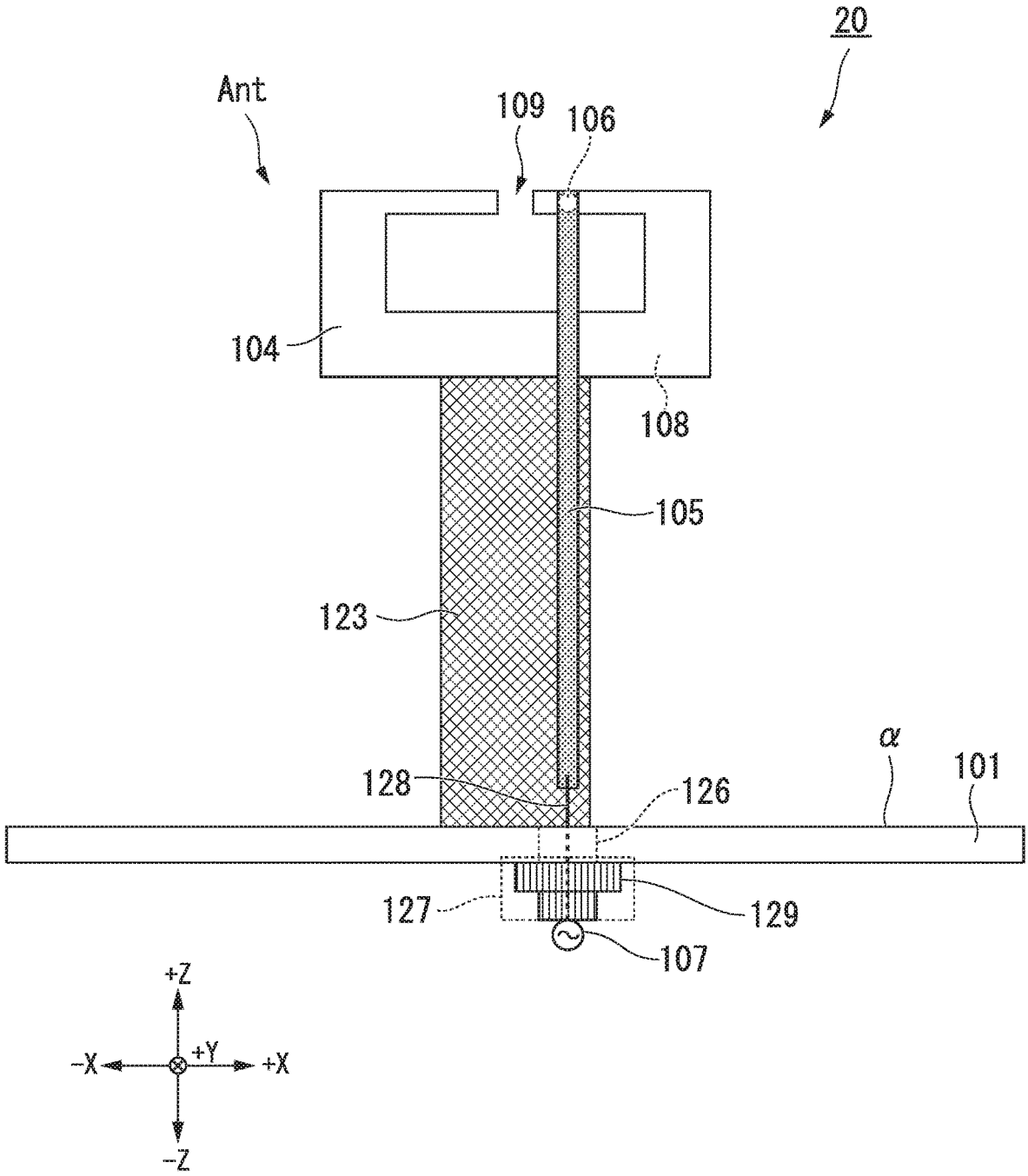
FIG. 36 is a front elevation view of the multi-band antenna according to the sixth modified example of the second exemplary embodiment.

FIG. 36 is a front elevation view of the multi-band antenna according to the sixth modified example of the second exemplary embodiment.

When a coaxial cable is used, the coaxial cable may be provided on the back side (the Z axis negative direction side) of the plate surface α of the conductor reflecting plate 101.

As shown in FIG. 35 and FIG. 36, in the conductor reflecting plate 101, there is provided a clearance 126 which is a through-hole. A connector 127 is provided at a position on the back side (the Z axis negative direction side) of the plate surface α of the conductor reflecting plate 101 corresponding to the position of the clearance 126. The connector 127 is a connector for connecting a coaxial cable (not shown in the figure).

The outer conductor 129 of the connector 127 is electrically connected to the conductor reflecting plate 101. The core wire 128 of the connector 127 is inserted into the clearance 126 and passes completely through to the front side (the Z axis positive direction side) of the plate surface α of the conductor reflecting plate 101, and is electrically connected to the conductor feeder line 105 of the antenna element Ant. The feeding point 107 can electrically excite between the core wire 128 of the connector 127 and the outer conductor 129.

With this type of configuration, it is possible to supply electric power to the antenna element Ant on the front side of the conductor reflecting plate 101 from the radio communication circuit (the radio communication circuit section 114 mentioned above) and a digital circuit or the like arranged on the back side of the conductor reflecting plate 101. As a result, the radio communication device 1 can be configured without significantly affecting the radiation pattern and radiation efficiency.

In the example shown in FIG. 35 and FIG. 36, the coaxial cable is provided on the back side of the conductor reflecting plate 101, but the exemplary embodiment is not limited to such a configuration. It suffices that the conductor constituting the transmission line is provided on the back side of the conductor reflecting plate 101, and the conductor need not necessarily be a coaxial cable.

Figure 37:
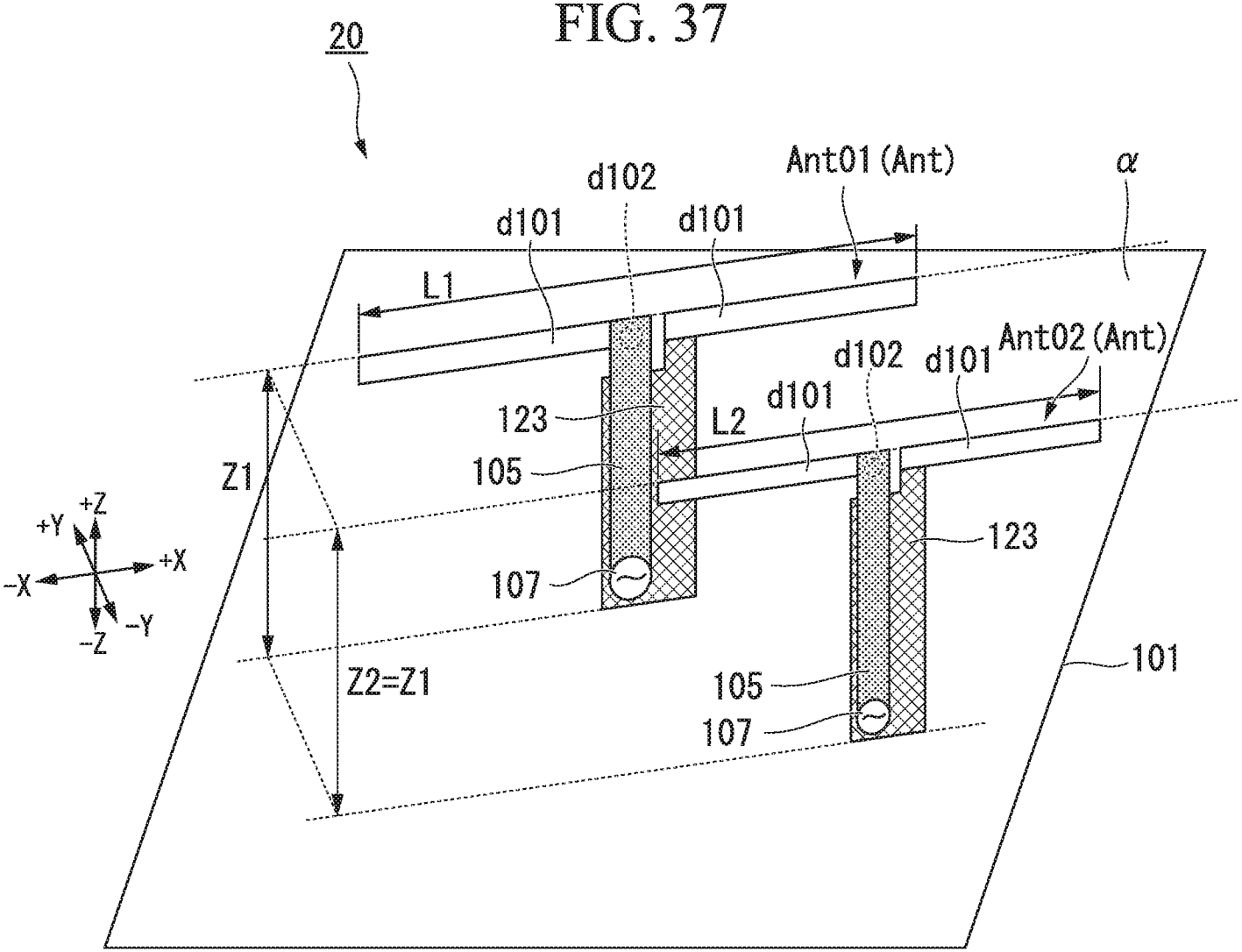
FIG. 37 is a perspective view of a multi-band antenna according to a seventh modified example of the second exemplary embodiment.

FIG. 37 is a perspective view of a multi-band antenna according to a seventh modified example of the second exemplary embodiment.

The antenna element Ant according to another exemplary embodiment may be a dipole antenna element. Even in the case of a dipole antenna element, the vicinity of both ends in the extending direction can be electrically regarded as an open plane at the time of resonance, and the vicinity of the center can be regarded as an electrically short-circuited plane.

Specifically, the conductor feeding GND part 123 is connected near the center in the extending direction of the antenna element Ant which is a dipole antenna element. With this configuration, it is possible to form a transmission line connected to the antenna element Ant without affecting the resonance characteristics.

Specifically, as shown in FIG. 37, one end of the conductor feeder line 105 is connected to one of the two conductor radiation parts d101 arranged on the same axis through a connection point d102. The conductor feeder line 105 extends to the vicinity of the plate surface α on the lower side (the Z axis negative direction) of the connection point d102. The other end of the conductor feeder line 105 is connected to the feeding point 107.

One end of the conductor feeding GND part 123 is connected to the other one of the two conductor radiation parts d101 arranged on the same axis. The conductor feeding GND part 123 extends from the conductor radiation part d101 to the plate surface α on the lower side. The other end of the conductor feeding GND part 123 is connected to the plate surface α.

The conductor feeder line 105 and the conductor feeding GND part 123 extend side by side in the same direction (Z axis direction) with a space therebetween.

The feeding point 107 electrically excites between the other end of the conductor feeder line 105 mentioned above and the conductor feeding GND part 123 in the vicinity thereof.

The other configurations are the same as those of the multi-band antenna 10 (FIG. 27) according to the eighteenth modified example of the first exemplary embodiment.

Third Exemplary Embodiment

Next, a multi-band antenna according to a third exemplary embodiment will be described in detail, with reference to FIG. 38 to FIG. 47. In the following description, of the constituents of the third exemplary embodiment, the same constituents as those of the first and second exemplary embodiments described above are denoted by the same reference symbols, and the description thereof will be appropriately omitted.

Figure 38:
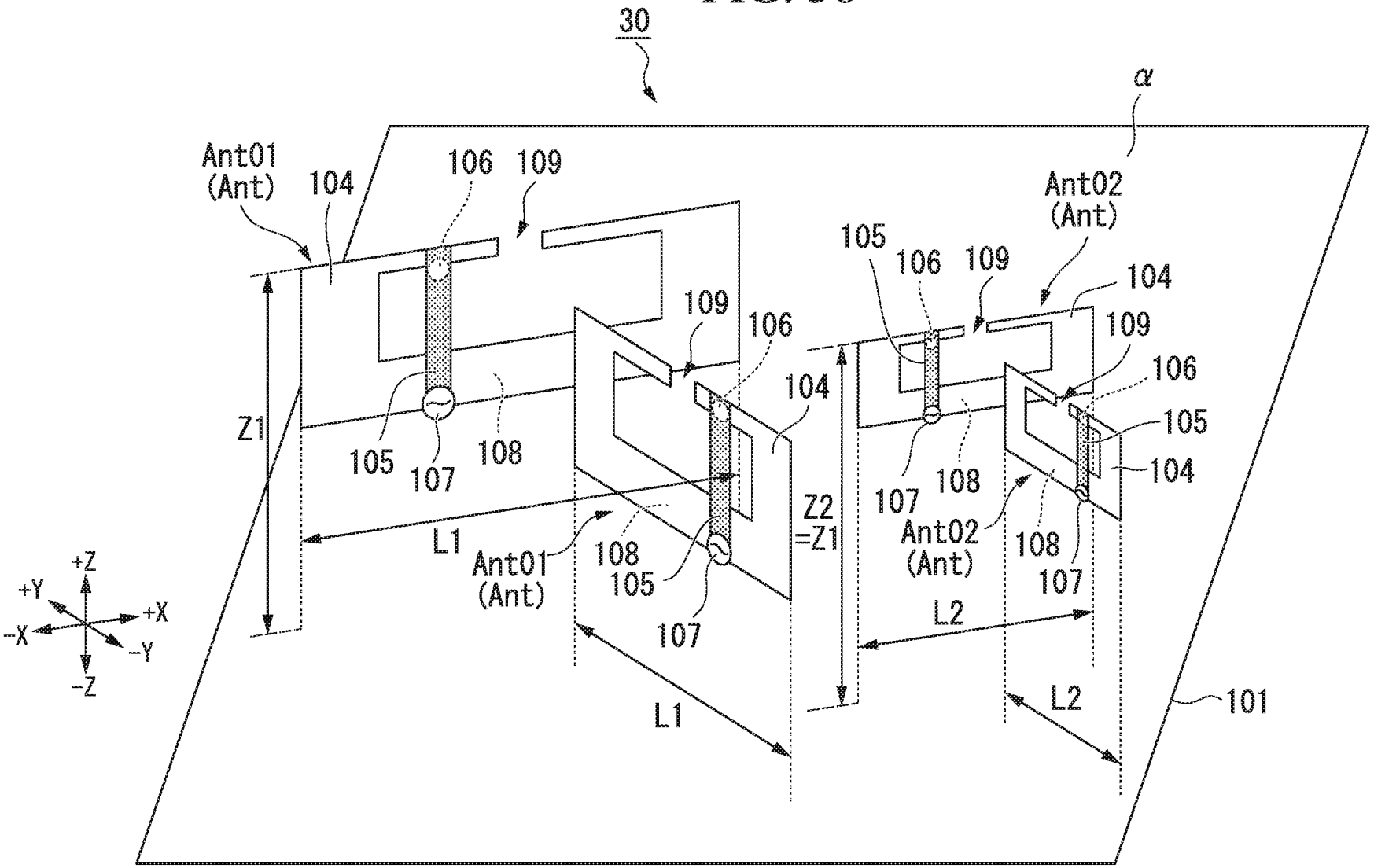
FIG. 38 is a perspective view of a multi-band antenna according to a third exemplary embodiment.

FIG. 38 is a perspective view of the multi-band antenna according to the third exemplary embodiment.

Figure 39:
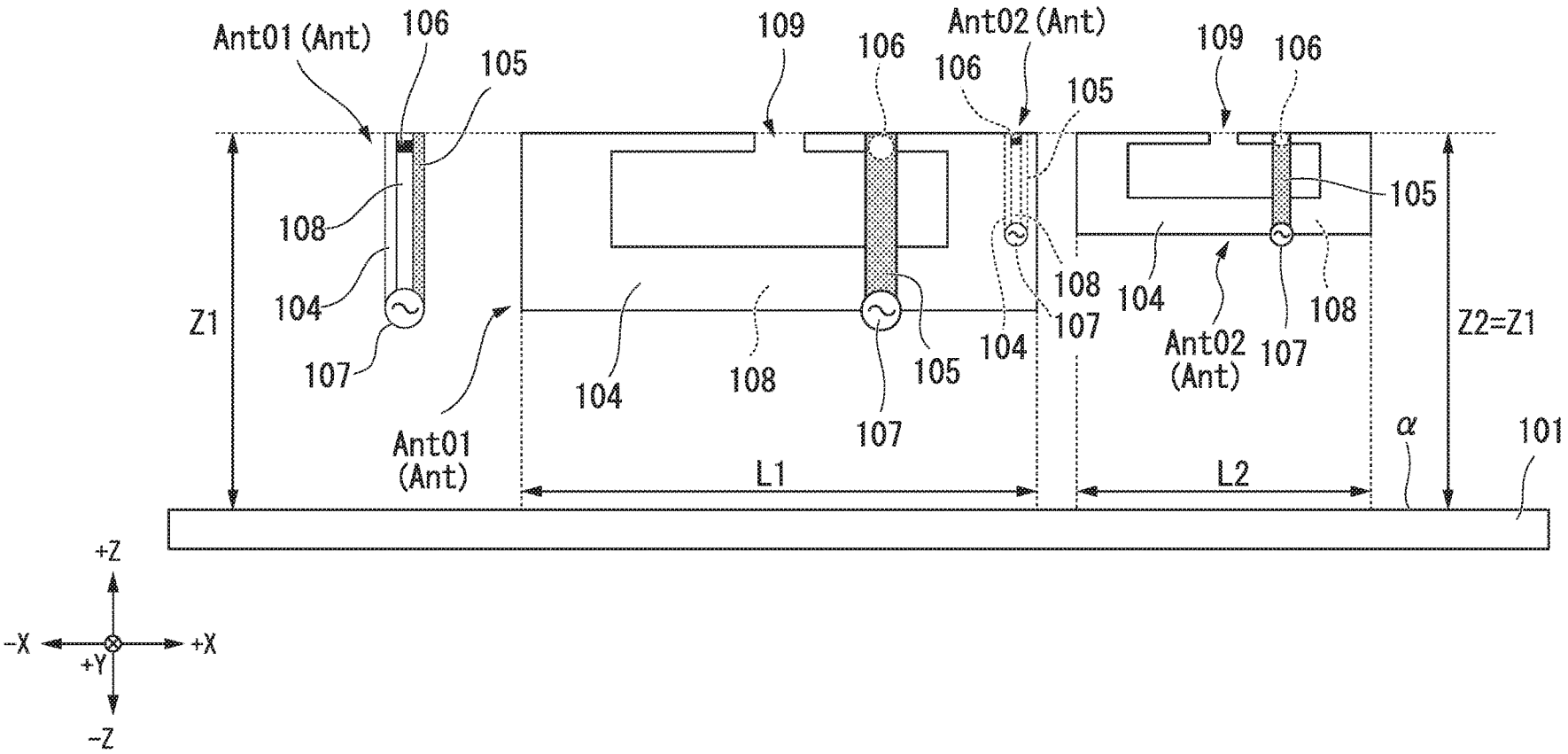
FIG. 39 is a front elevation view of the multi-band antenna according to the third exemplary embodiment.

FIG. 39 is a front elevation view of the multi-band antenna according to the third exemplary embodiment.

Figure 40:
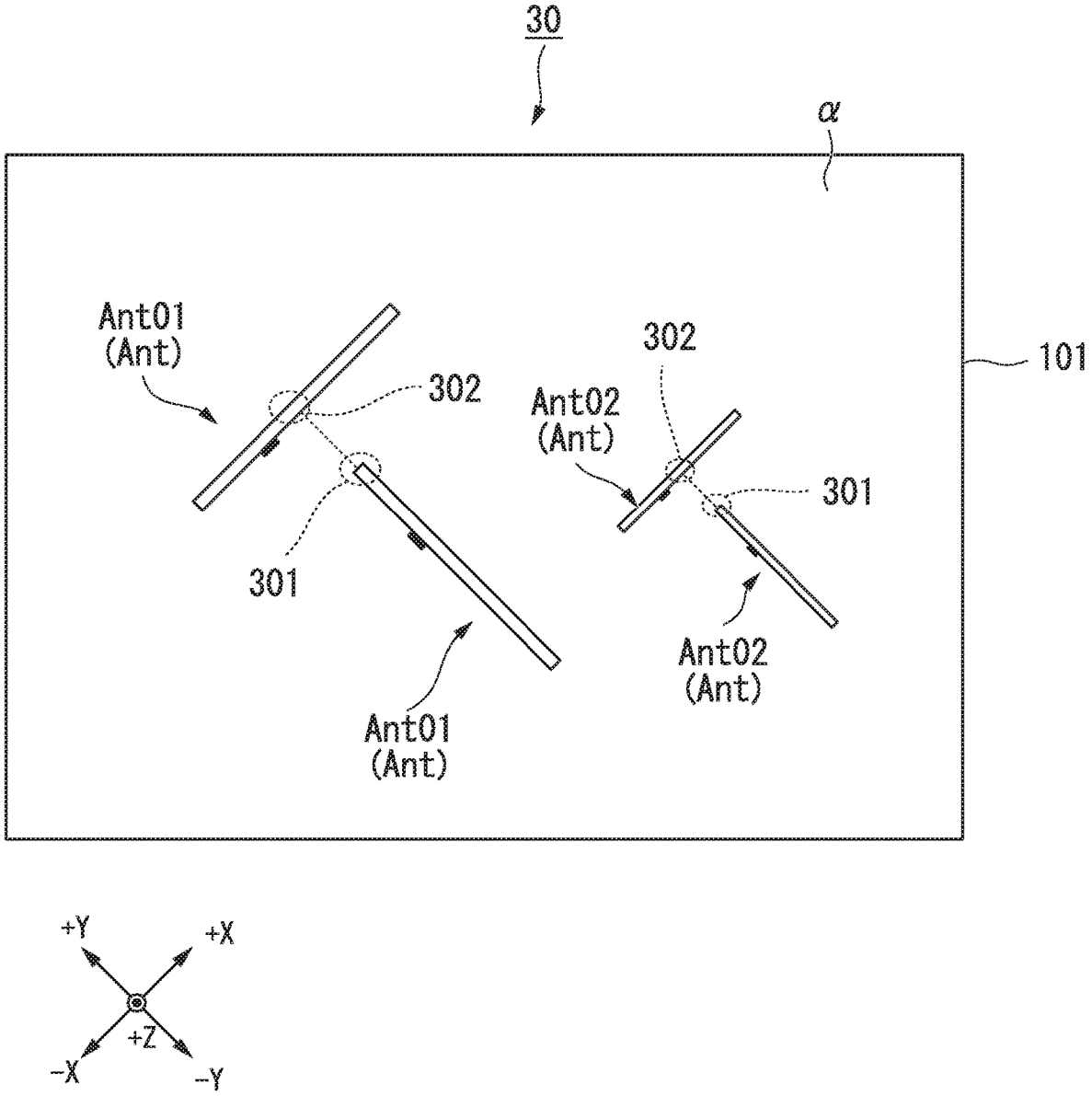
FIG. 40 is a top view of the multi-band antenna according to the third exemplary embodiment.

FIG. 40 is a top view of the multi-band antenna according to the third exemplary embodiment.

As shown in FIG. 38 to FIG. 40, a multi-band antenna 30 has two first antenna elements Ant01 and two second antenna elements Ant02 each having the same distance in the perpendicular direction from the plate surface α of the conductor reflecting plate 101.

Referring to the top view shown in FIG. 40, the two first antenna elements Ant01 are set to extend in directions orthogonal to each other (X axis direction, Y axis direction) along the plate surface α. Similarly, the two second antenna elements Ant02 are set to extend in directions orthogonal to each other (X axis direction, Y axis direction) along the plate surface α.

In the top view (FIG. 40), the two first antenna elements Ant01 are arranged such that on the extended line from the tip end (tip end part 301) in the extending direction of the first antenna element Ant01 having the extending direction in one direction (Y axis direction), there is positioned the center (center part 302) in the extending direction of the first antenna element Ant01 having the extending direction in the other direction (X axis direction).

Similarly, the two second antenna elements Ant02 are arranged such that on the extended line from the tip end (tip end part 301) in the extending direction of the second antenna element Ant02 having the extending direction in one direction (Y axis direction), there is positioned the center (center part 302) in the extending direction of the second antenna element Ant02 having the extending direction in the other direction (X axis direction).

The multi-band antenna 30 having the above configuration includes the two first antenna elements Ant01 that are substantially orthogonal to each other in the in-plane direction of the plate surface α, and the two second antenna elements Ant02 substantially orthogonal to each other in the in-plane direction of the plate surface α. Therefore, a multi-band antenna that supports orthogonal dual polarized waves can be provided.

As described in the second exemplary embodiment (FIG. 28 and FIG. 29), when each of the antenna elements Ant resonates electromagnetically, the vicinities of both ends (the tip end parts 301) in the extending direction (the X axis direction or the Y axis direction) thereof become electrically open planes, and the electric field strength is strong and the magnetic field strength is weak. On the other hand, the vicinity of the center (the center part 302) in the extending direction of each antenna element Ant becomes an electrically short-circuited plane, and the magnetic field strength is strong and the electric field strength is weak.

Hence, the tip end part 301 of one of the first antenna elements Ant01 (second antenna elements Ant02) is positioned substantially perpendicular so as to be positioned in the vicinity of the center part 302 of the other first antenna element Ant01 (second antenna element Ant02). As a result, one of the first antenna element Ant01 and the other first antenna element Ant01 are arranged to be orthogonal to each other so that portions having strong intensities do not come close to each other in the electric field and the magnetic field. Therefore, it is possible to arrange the two first antenna elements Ant01 (second antenna elements Ant02) close to each other while suppressing electromagnetic coupling therebetween. That is to say, when dual polarization is carried out using the two first antenna elements Ant01 (second antenna element Ant02), the electromagnetic coupling between the polarized waves is suppressed, and the first antenna elements Ant01 (second antenna elements Ant02) supporting each polarized wave can be arranged close to each other. As a result, it is possible to suppress an increase in the size of the entire antenna associated with dual polarization.

As described above, according to the multi-band antenna 30 of the third exemplary embodiment, it is possible to provide a multi-band antenna that supports orthogonal dual polarized waves and that suppresses an increase in the size of the entire antenna due to dual polarization while suppressing coupling between polarized waves, in addition to the effects of the first exemplary embodiment and the second exemplary embodiment.

Further, as with the first exemplary embodiment, it is possible to provide a radio communication device that supports multiple bands and orthogonal dual polarization by configuring the radio communication device 1 (FIG. 4) using the multi-band antenna 30.

The antenna element Ant according to each modified example of the first exemplary embodiment and each modified example of the second exemplary embodiment can also be applied to the antenna element Ant of the third exemplary embodiment.

Figure 41:
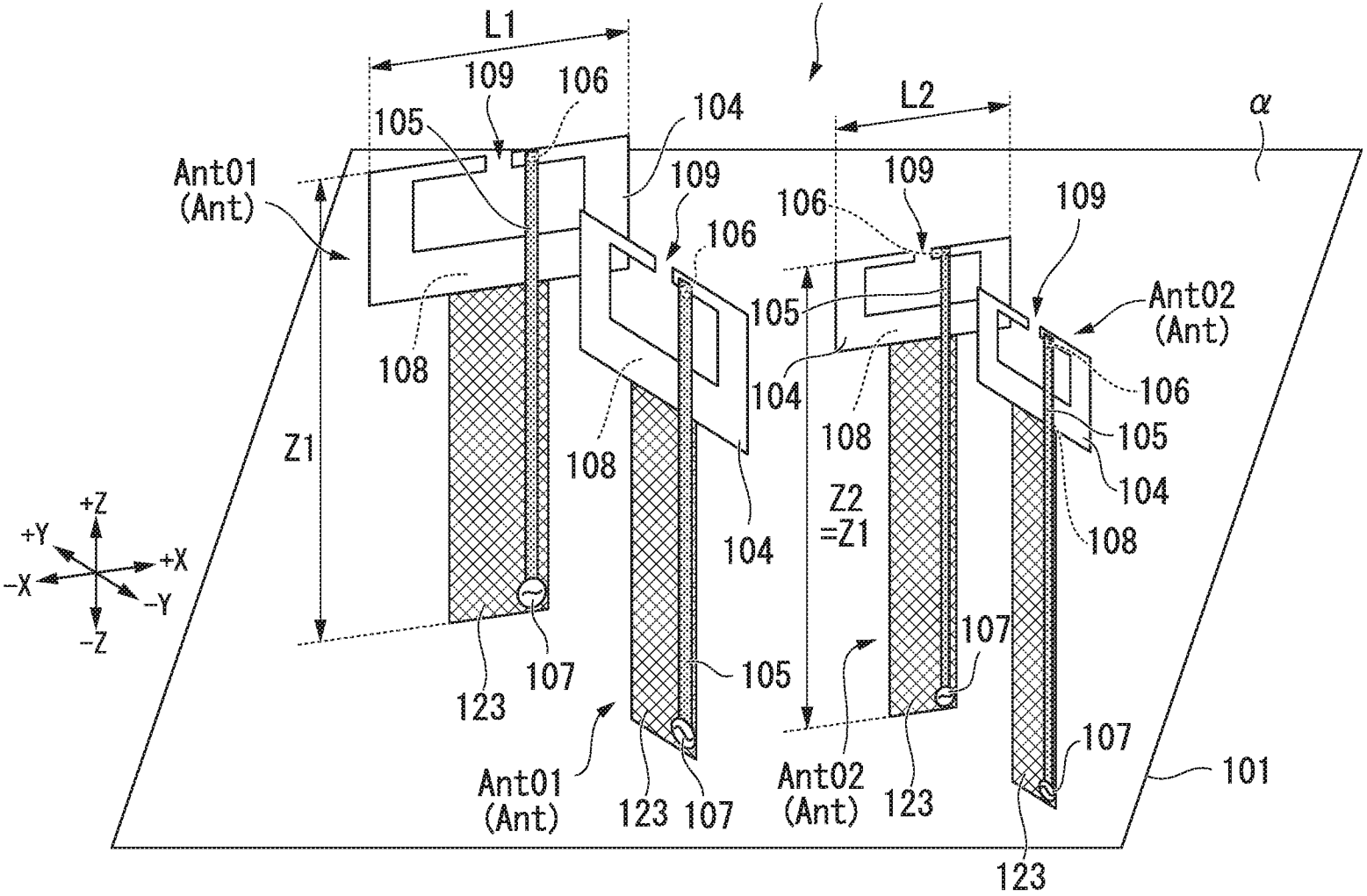
FIG. 41 is a perspective view of a multi-band antenna according to a first modified example of the third exemplary embodiment.

FIG. 41 is a perspective view of a multi-band antenna according to a first modified example of the third exemplary embodiment.

As shown in FIG. 41, in the multi-band antenna 30, each of the two first antenna elements Ant01 and the two second antenna elements Ant02 described in the third exemplary embodiment (FIG. 38 to FIG. 40) may include the conductor feeding GND part 123 described in the second exemplary embodiment.

Figure 42:
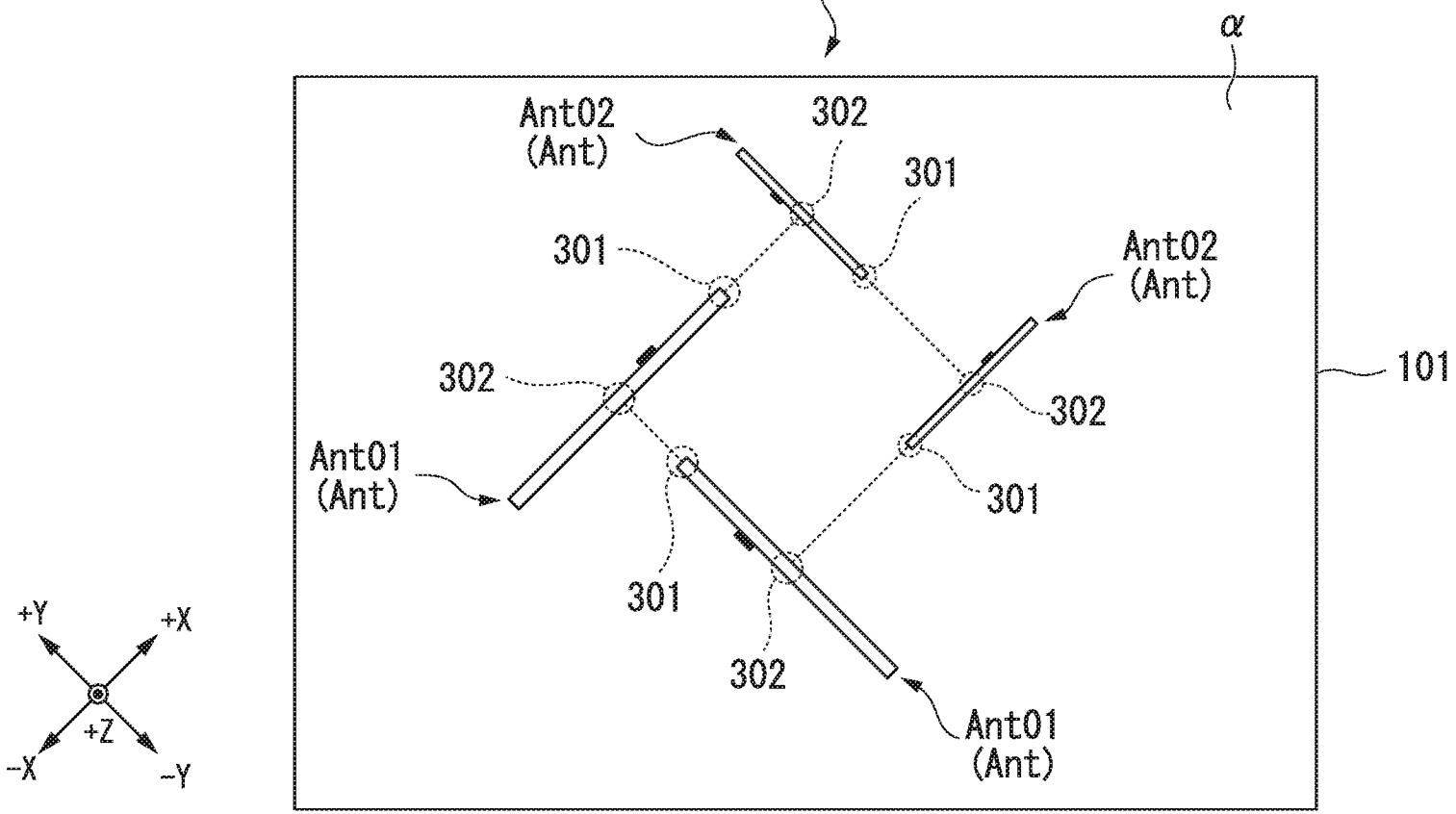
FIG. 42 is a top view of a multi-band antenna according to a second modified example of the third exemplary embodiment.

FIG. 42 is a top view of a multi-band antenna according to a second modified example of the third exemplary embodiment.

As shown in FIG. 42, in the multi-band antenna 30, the two first antenna elements Ant01 and the two second antenna elements Ant02 in the vicinity of each other may all be arranged orthogonal to each other so that the tip end part 301 of one antenna element Ant faces the center part 302 of the other antenna element Ant. Thereby, it is possible to suppress, not only coupling between polarized waves of the two first antenna elements Ant01 or the two second antenna elements Ant02, but also the influence on the mutual resonance characteristic between the first antenna element Ant01 and the second antenna element Ant02 in the vicinity of each other.

Figure 43:
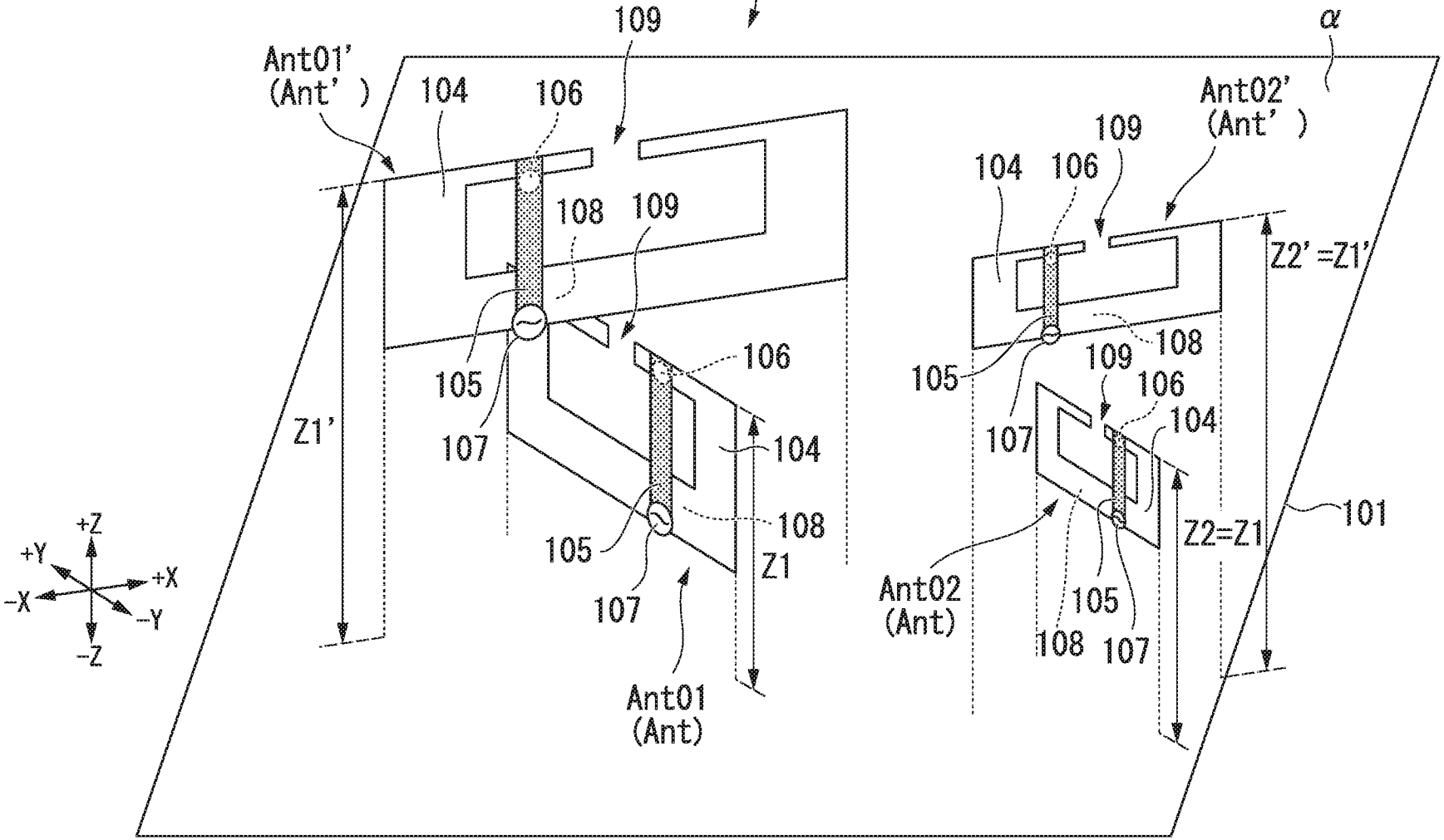
FIG. 43 is a perspective view of a multi-band antenna according to a third modified example of the third exemplary embodiment.

FIG. 43 is a perspective view of a multi-band antenna according to a third modified example of the third exemplary embodiment.

Figure 44:
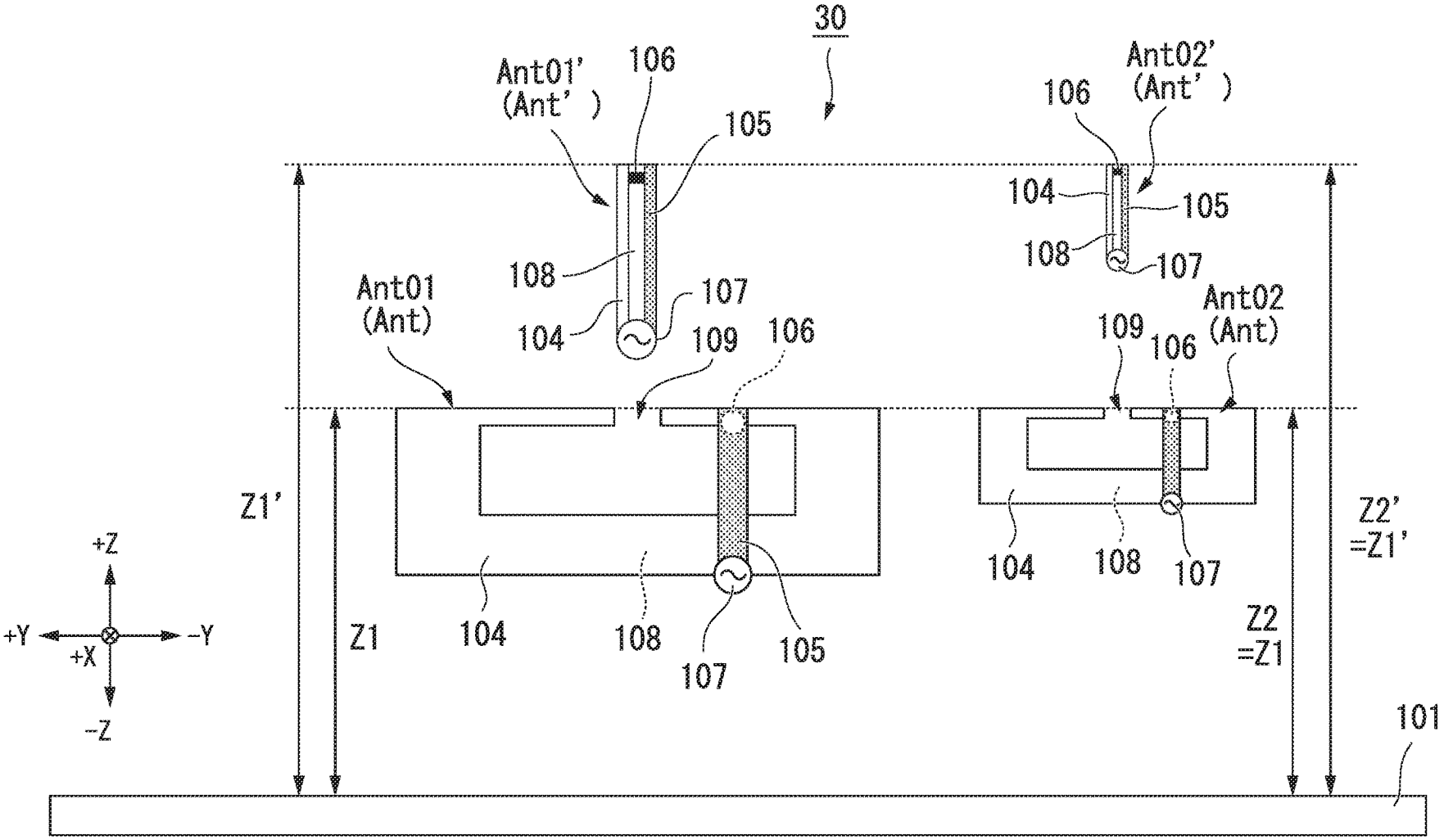
FIG. 44 is a front elevation view of the multi-band antenna according to the third modified example of the third exemplary embodiment.

FIG. 44 is a front elevation view of the multi-band antenna according to the third modified example of the third exemplary embodiment.

Figure 45:
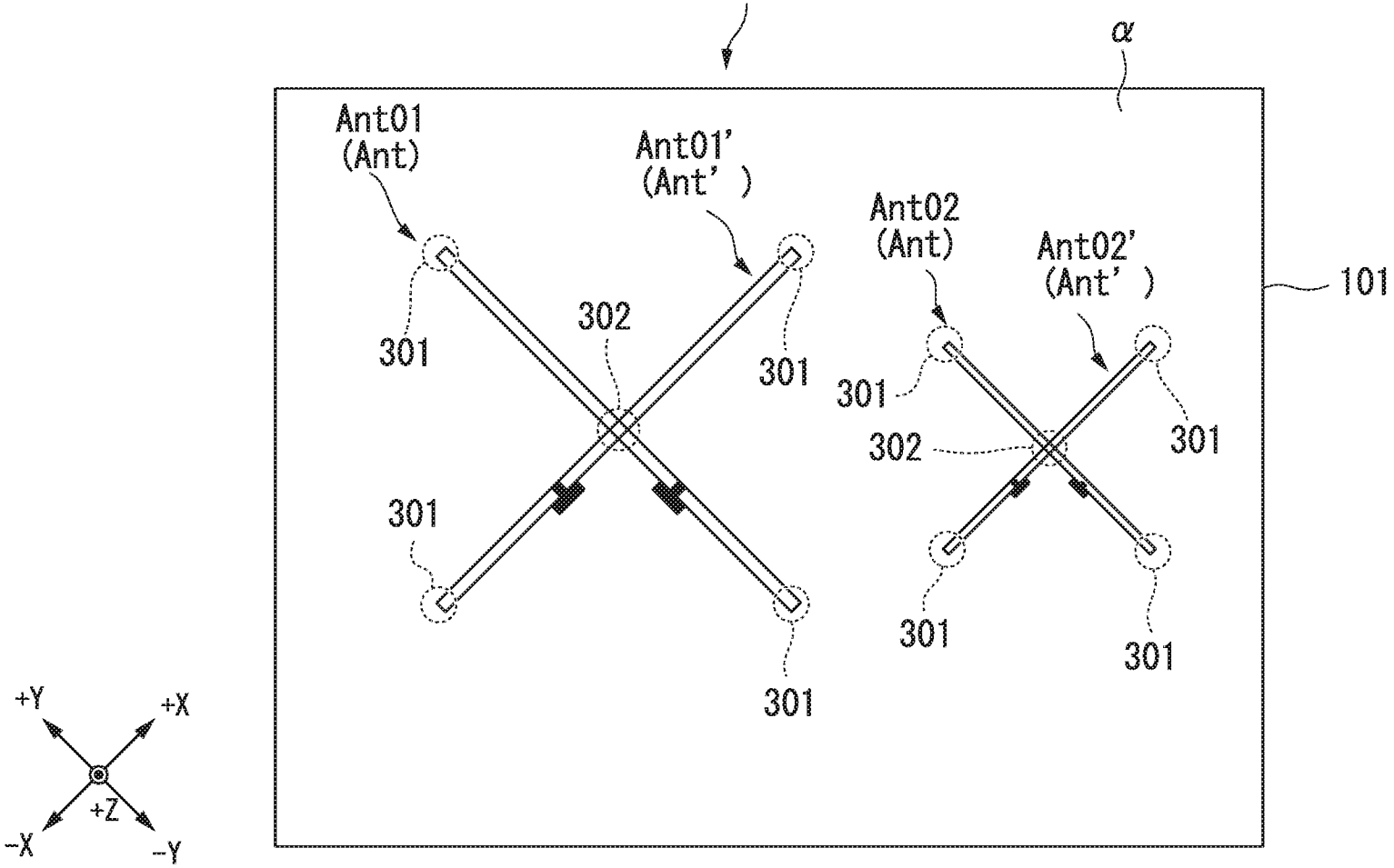
FIG. 45 is a top view of the multi-band antenna according to the third modified example of the third exemplary embodiment.

FIG. 45 is a top view of the multi-band antenna according to the third modified example of the third exemplary embodiment.

As shown in FIG. 43 to FIG. 45, the multi-band antenna 30 includes a first antenna element Ant01 of a first group and a second antenna element Ant02 of the first group. The first antenna element Ant01 and the second antenna element Ant02 may be collectively referred to as antenna elements Ant in some cases. The multi-band antenna 30 includes a first antenna element Ant01' of a second group and a second antenna element Ant02' of the second group. The first antenna element Ant01' and the second antenna element Ant02' may be collectively referred to as antenna elements Ant' in some cases.

The configuration of the first antenna element Ant01 of the first group and the configuration of the first antenna element Ant01' of the second group are identical to each other. Also, the configuration of the second antenna element Ant02 of the first group and the configuration of the second antenna element Ant02' of the second group are identical to each other.

The first antenna element Ant01 of the first group and the second antenna element Ant02 of the first group are arranged such that the distances thereto from the plate surface $\alpha$ in the perpendicular direction (Z axis direction) (to be precise, the distances Z1, Z2 (first distances) to the upper long edges of the annular conductor parts 104) are equal to each other (Z1=Z2). Also, the first antenna element Ant01' of the second group and the second antenna element Ant02' of the second group are arranged such that the distances thereto from the plate surface $\alpha$ in the perpendicular direction (Z axis direction) (to be precise, the distances Z1', Z2' (second distances) to the upper long edges of the annular conductor parts 104) are equal to each other (Z1'=Z2').

As shown in FIG. 43 to FIG. 45, the distance Z1' (Z2') is greater than the distance Z1. That is to say, the antenna elements Ant' of the second group are arranged on the upper side (Z axis positive direction) of the antenna elements Ant of the first group with a space in the perpendicular direction (Z axis direction).

As shown in FIG. 45, the first antenna element Ant01 of the first group and the first antenna element Ant01' of the second group are arranged orthogonal to each other at the center (the center part 302) in each extending direction thereof when viewed from the upper plane (Z axis positive direction) side. Moreover, the second antenna element Ant02 of the first group and the second antenna element Ant02' of the second group are arranged orthogonal to each other at the center (the center part 302) in each extending direction thereof when viewed from the upper plane (Z axis positive direction) side.

As a result, the antenna elements Ant of the first group support one polarized wave, and the antenna elements Ant' of the second group support the polarized wave orthogonal to the one polarized wave.

In this manner, both ends (tip end parts 301) in the extending direction (the X axis direction, the Y axis direction) of the antenna elements Ant, Ant', which are electrically open planes and have high electric field strength during resonance, are distanced from each other. Also, the orthogonality between the magnetic fields generated by the two orthogonal antenna elements Ant, Ant' becomes high. Therefore, the two first antenna elements Ant01, Ant01' whose respective extending directions are perpendicular to each other and the two second antenna elements Ant02, Ant02' whose extending directions are perpendicular to each other can be arranged close to each other while suppressing coupling therebetween.

In this case, as shown in FIG. 44, the distances Z1, Z2 from the plate surface α to the first antenna element Ant01 (second antenna element Ant02) of the first group, and the distances Z1', Z2' from the plate surface α to the first antenna element Ant01' (second antenna element Ant02') of the second group are different from each other by approximately the width of the first antenna element Ant01 in the perpendicular direction (Z axis direction). Here, even if one of the antenna elements Ant, Ant' supporting each of the different polarized waves is on the direction of radiation of the electromagnetic wave of the other, the influence of the antenna elements Ant, Ant' on each other's radiation pattern is insignificant. For example, the first antenna element Ant01' of the second group is present on the direction of radiation of the electromagnetic wave of the second antenna element Ant02 of the first group. However, the extending directions of the first antenna element Ant01' and the second antenna element Ant02 are orthogonal to each other so as to support different polarized waves. Therefore, the influence of the first antenna element Ant01' on the radiation pattern of the second antenna element Ant02 is insignificant.

As described above, if the distances Z1, Z2 between the antenna elements Ant (of the first group) supporting one polarized wave and the plate surface α are equal and also if the distances Z1', Z2' between the antenna elements Ant (of the second group) supporting the other polarized wave and the plate surface α are equal, it is possible to suppress the influence on the mutual radiation patterns between the antenna elements Ant, Ant' operating at different frequencies.

Figure 46:
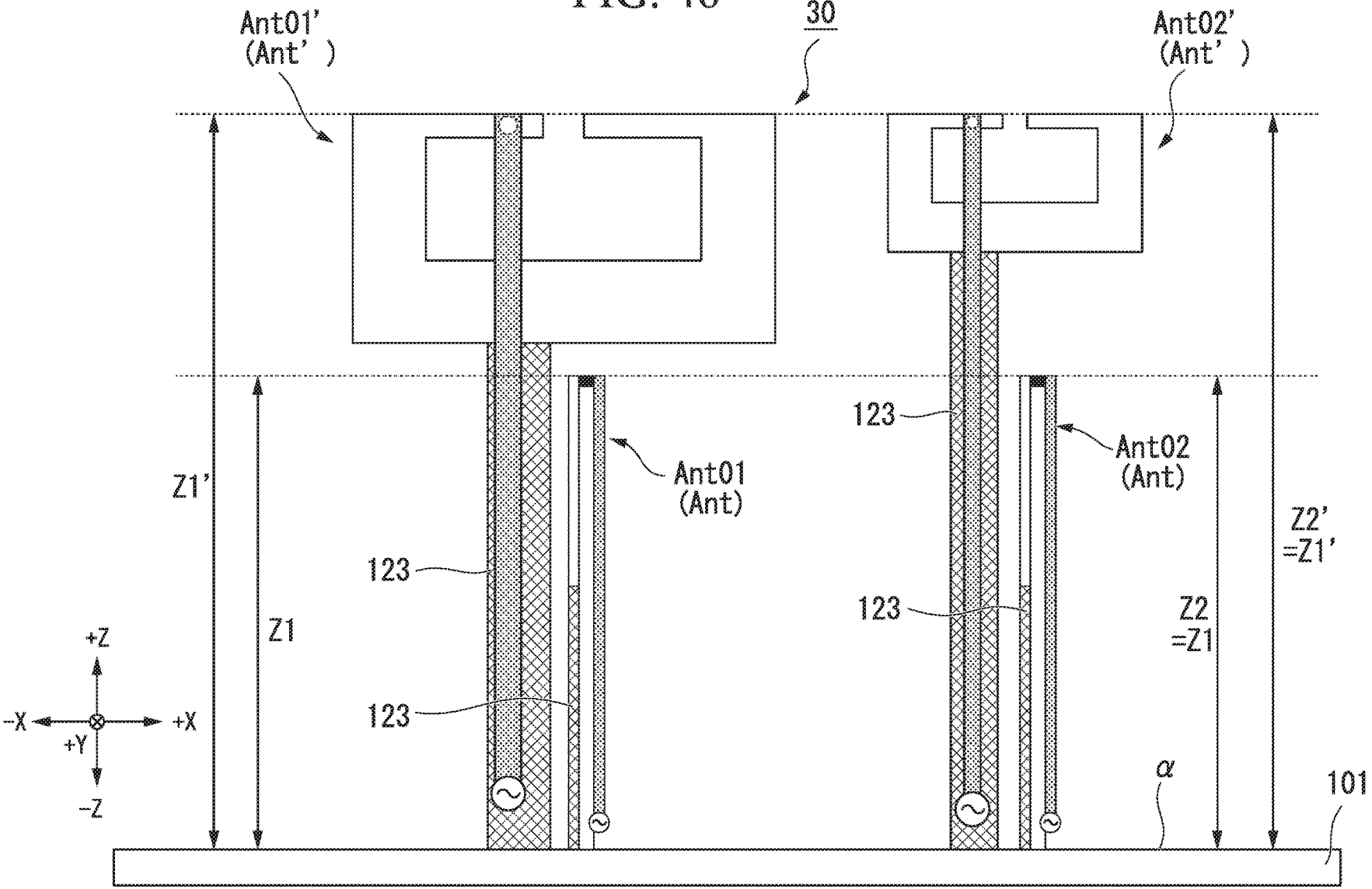
FIG. 46 is a front elevation view of a multi-band antenna according to a fourth modified example of the third exemplary embodiment.

FIG. 46 is a front elevation view of a multi-band antenna according to a fourth modified example of the third exemplary embodiment.

As shown in FIG. 46, in the multi-band antenna 30, each of the two first antenna elements Ant01 and the two second antenna elements Ant02 described in the third modified example of the third exemplary embodiment (FIG. 43 to FIG. 45) may include the conductor feeding GND part 123 described in the second exemplary embodiment.

In this case, as shown in FIG. 46, the conductor feeding GND part 123 that is connected to the antenna element Ant' positioned on the upper side (Z axis positive direction) may be deformed so as not to overlap with the antenna element Ant positioned on the lower side (Z axis negative direction) thereof. That is to say, the position of the conductor feeding GND part 123 of the antenna element Ant' arranged on the upper side to be connected to the annular conductor part 104 may be shifted from the center of the annular conductor part 104, so as not to overlap with the antenna element Ant on the lower side.

The arrangement of the two antenna elements Ant (antenna elements Ant') whose extending directions are perpendicular to each other is not limited to the modified example above. The two antenna elements Ant may be arranged in any way as long as the level of influence of the electromagnetic coupling between the respective antenna elements Ant, Ant' on each resonance characteristic is within an allowable range.

Figure 47:
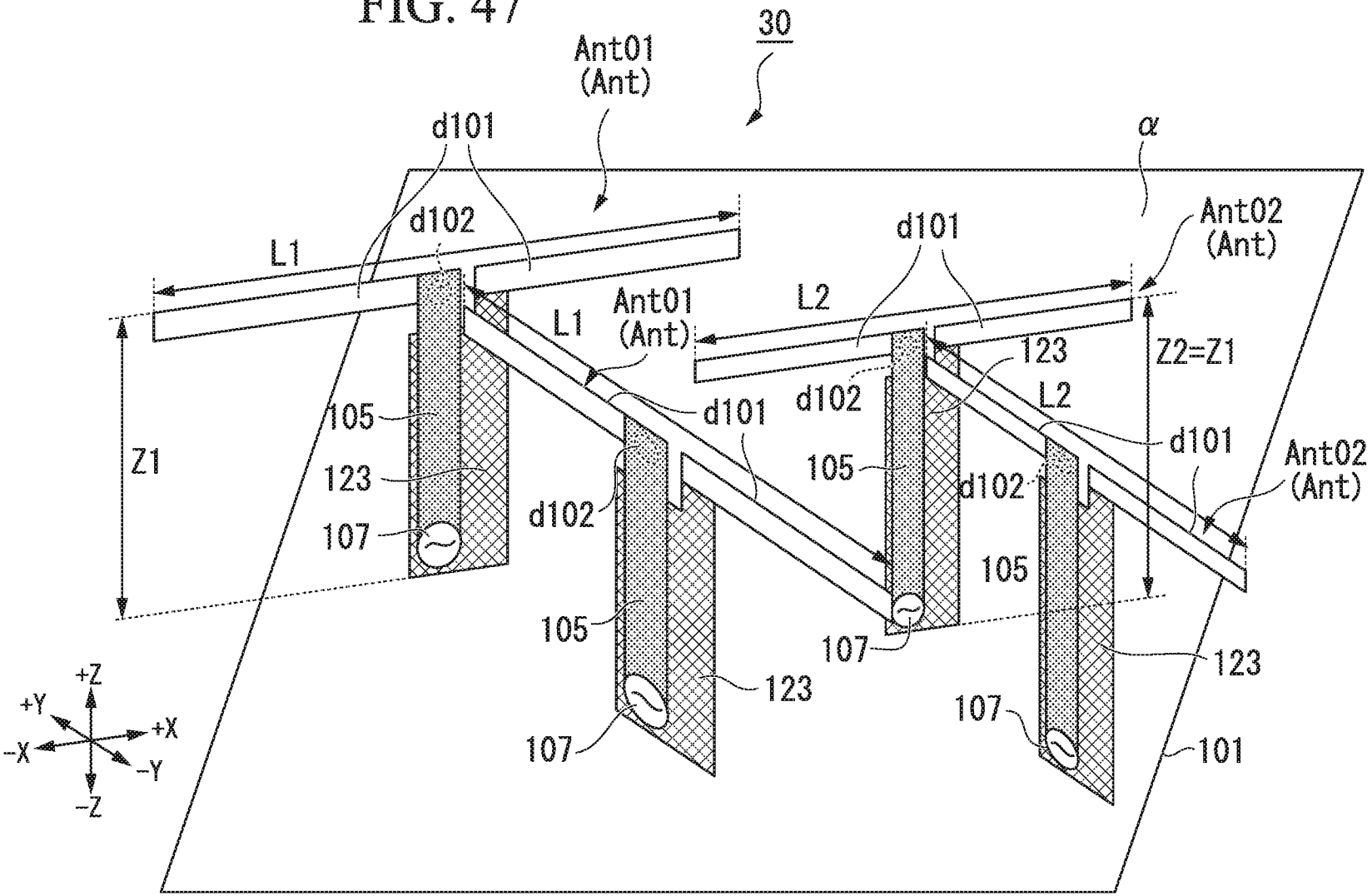
FIG. 47 is a perspective view of a multi-band antenna according to a fifth modified example of the third exemplary embodiment.

FIG. 47 is a perspective view of a multi-band antenna according to a fifth modified example of the third exemplary embodiment.

The antenna element Ant according to another exemplary embodiment may be a dipole antenna element. In this case, in the multi-band antenna 30, each of the two first antenna elements Ant01 and the two second antenna elements Ant02 described in the third exemplary embodiment (FIG. 38 to FIG. 40) may have the same mode as that of the seventh modified example of the second exemplary embodiment (FIG. 37).

As described above, even if the antenna element Ant is a dipole antenna element, the vicinity of both ends can be electrically regarded as an open plane at the time of resonance, and the vicinity of the center can be regarded as an electrically short-circuited plane. Therefore, it is possible to provide the multi-band antenna 30 supporting dual polarized waves that suppresses coupling between the antenna elements Ant corresponding to different polarized waves, that increases the level of integration of the antenna element Ant, and that is reduced in its overall size.

Fourth Exemplary Embodiment

Next, a multi-band antenna according to a fourth exemplary embodiment will be described in detail, with reference to FIG. 48 to FIG. 57. In the following description, of the constituents of the fourth exemplary embodiment, the same constituents as those of the first to third exemplary embodiments described above are denoted by the same reference symbols, and the description thereof will be appropriately omitted.

Figure 48:
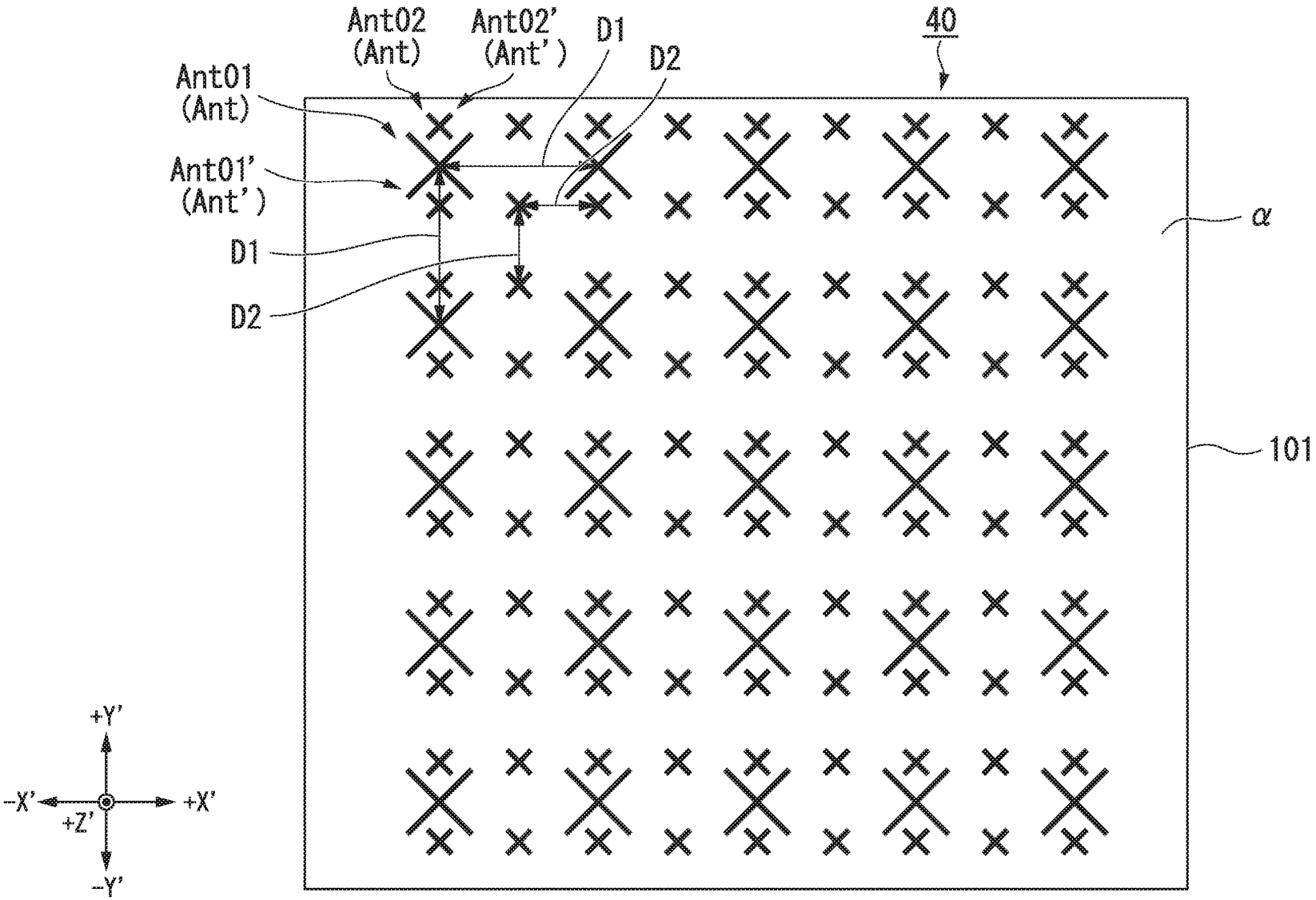
FIG. 48 is a top view of a multi-band antenna according to a fourth exemplary embodiment.

FIG. 48 is a top view of the multi-band antenna according to the fourth exemplary embodiment.

As shown in FIG. 48, a multi-band antenna 40 includes a plurality of groups (first groups) of a first antenna element Ant01 and a second antenna element Ant02 that are arranged so that distances thereto in the perpendicular direction (Z axis direction) from the plate surface α of the conductor reflecting plate 101 are equal to each other. Moreover, the multi-band antenna 40 includes a plurality of groups (second groups) of a first antenna element Ant01' and a second antenna element Ant02' that are arranged so that distances thereto in the perpendicular direction from the plate surface α are equal to each other.

The first antenna element Ant01, the first antenna element Ant01', the second antenna element Ant02, and the second antenna element Ant02' are all arranged in the manner described in the third modified example of the third exemplary embodiment (FIG. 43, FIG. 44, and FIG. 45).

The first antenna elements Ant01, Ant01' are periodically arranged at predetermined intervals D1 in the longitudinal direction (Y' axis direction) and the lateral direction (X' axis direction) of the plate surface α. The second antenna elements Ant02, Ant02' are periodically arranged at predetermined intervals D2 in the longitudinal direction and the lateral direction of the plate surface α.

That is to say, the first antenna elements Ant01, Ant01' are arranged in a square lattice pattern at intervals D1 along the plate surface α. The second antenna elements Ant02, Ant02' are arranged in a square lattice pattern at intervals D2 along the plate surface α.

In the present exemplary embodiment, the intervals D1, D2 are set to approximately ½ of the wavelength λ1 and approximately ½ of the wavelength λ2, respectively. The interval D1 is equal to twice the interval D2.

In this manner, the multi-band antenna 40 is such that array antennas (groups of the first antenna elements Ant01, Ant01') supporting the operating frequency f1 and array antennas (groups of the second antenna elements Ant02, Ant02') supporting the operating frequency f2 can be formed on the same plane, sharing the conductor reflecting plate 101.

As described above, the multi-band antenna 40 is configured such that each of the first antenna elements Ant01, Ant01' and the second antenna elements Ant02, Ant02' is made to support dual-polarized waves in the arrangement described in the third modified example of the third exemplary embodiment. Moreover, the multi-band antenna 40 includes an array antenna for each polarization of each frequency. Therefore, in the multi-band antenna 40, it is possible to configure multi-band and dual polarized array antennas on the same plane, and it is possible to perform multi-band and dual-polarized beam forming operations.

Further, as with the first exemplary embodiment, it is possible to provide a radio communication device that supports multiple bands and orthogonal dual polarization and that is capable of performing beam forming, by configuring the radio communication device 1 (FIG. 4) using the multi-band antenna 40.

When performing beam forming, the spaces D1, D2 between the antenna elements Ant, Ant' of the array antenna is preferably about a half of the wavelengths λ1, λ2 of the electromagnetic waves of the operating frequencies f1, f2 in the case of a square lattice array. At this time, as described in the first exemplary embodiment, in the first antenna element Ant01 and the second antenna element Ant02, the lengths L1, L2 in the extending direction are respectively ¼ of the wavelength λ1 and ¼ of the wavelength λ2 approximately. Accordingly, the first antenna element Ant01 and the second antenna element Ant02 are small in size while having excellent radiation efficiency. Therefore, in the multi-band antenna 40, even if the first antenna elements Ant01, Ant01' are arranged in an array at intervals of approximately D1 (=λ1·½), there is some gap between the respective first antenna elements Ant01, Ant01'. Therefore, the second antenna elements Ant02, Ant02' can be arranged without overlapping with the first antenna elements Ant01, Ant01' in the region between the first antenna elements Ant01, Ant01'. As a result, manufacturing can be made more convenient.

Furthermore, the first antenna elements Ant01, Ant01' and the second antenna elements Ant02, Ant02' are each small in size. Therefore, the gap between the antenna elements Ant, Ant' increases, and mutual influence thereof on the resonance characteristics can be reduced.

Also, as shown in FIG. 44, the interval D1 is equal to twice the interval D2. Therefore, the period of the arrangement of the first antenna elements Ant01, Ant 01' is an integral multiple of the period of the arrangement of the second antenna elements Ant02, Ant02'. Therefore, it is possible to arrange the second antenna elements Ant02, Ant02' so as not to overlap with the first antenna elements Ant01, Ant01' while maintaining the interval D2 (=λ2·½).

However, the interval D1 between the first antenna elements Ant01 or the interval D2 between the second antenna elements Ant02 is not necessarily limited to "λ1·½" or "λ2·½". Also, the interval D1 need not necessarily be equal to twice the interval D2.

The first antenna elements Ant01, Ant01' and the second antenna elements Ant 02, Ant02' may be dipole antenna elements as described in the eighteenth modified example of the first exemplary embodiment (FIG. 27).

The multi-band antenna 40 need not necessarily be an antenna that supports dual polarized waves. The multi-band antenna 40 may support only one polarized wave depending on the application and each of the first antenna element Ant and the second antenna element Ant02 may constitute an array antenna that supports each of the operating frequencies f1, f2.

As shown in FIG. 48, the first antenna elements Ant01, Ant01' and the second antenna elements Ant02, Ant02' are periodically arranged in a square lattice pattern, respectively. However, in another exemplary embodiment, the first antenna elements Ant01, Ant01' and the second antenna elements Ant02, Ant02' may be periodically arranged in a lattice pattern of other shapes such as a rectangle, a triangle or the like as a unit lattice, to form an array antenna. In addition, the multi-band antenna 40 may be an array antenna having a configuration in which one edge is shorter than the other edge, such as a one-row array or a two-row array, making the overall shape thereof elongated.

Figure 49:
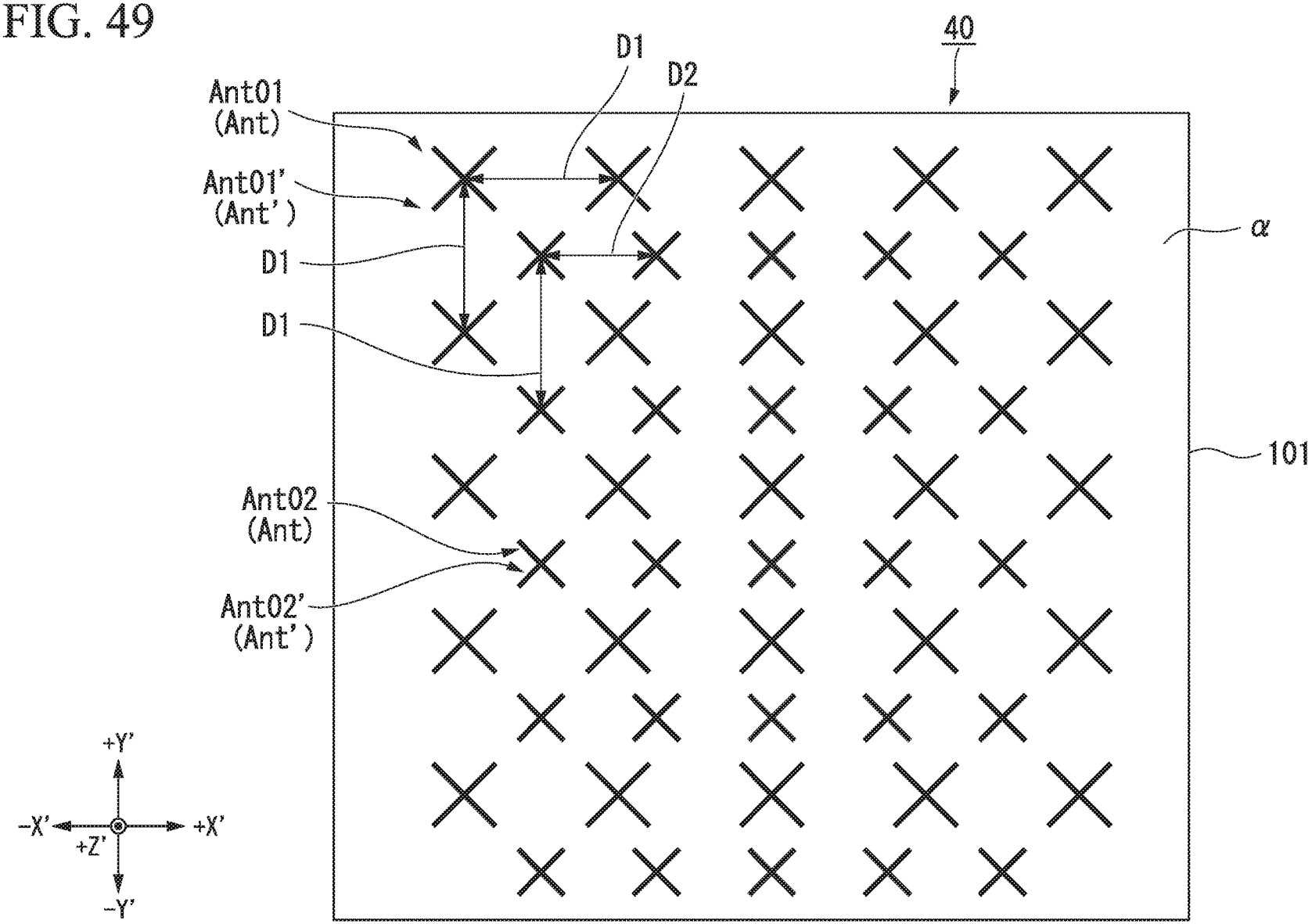
FIG. 49 is a top view of a multi-band antenna according to a first modified example of the fourth exemplary embodiment.

FIG. 49 is a top view of a multi-band antenna according to a first modified example of the fourth exemplary embodiment.

As shown in FIG. 49, in the multi-band antenna 40, the intervals D1, D2 of one of the first antenna elements Ant01, Ant01' and the second antenna elements Ant02, Ant02' (here, the interval D2 of the second antenna elements Ant02, Ant02') may be changed from the fourth exemplary embodiment (FIG. 48).

More specifically, as shown in FIG. 49, the interval in the longitudinal direction (Y' axis direction) of the second antenna elements Ant02, Ant02' is set to be not the interval D2 (=λ2·½) but the interval D1 (=λ1·½). Each of the second antenna elements Ant02, Ant02' may be arranged in each gap arranged in the longitudinal direction between the first antenna elements Ant01, Ant01' so that the first antenna elements Ant01, Ant01' and the second antenna elements Ant02, Ant02' do not overlap with each other. However, when performing beam forming on a plane (y'z' plane) including a direction in which the inter-element distance is widened, it is assumed that the side-lobe may become greater in some cases, depending on how beam formation is performed.

The combination of the method of dual polarization by means of the first antenna elements Ant01, Ant01, and the second antenna elements Ant02, Ant02' described in the third exemplary embodiment and the modified examples thereof, and the method of periodic arrangement of the respective antenna elements Ant, Ant' in the multi-band antenna 40 need not necessarily be as described above (FIG. 48, FIG. 49).

Figure 50:
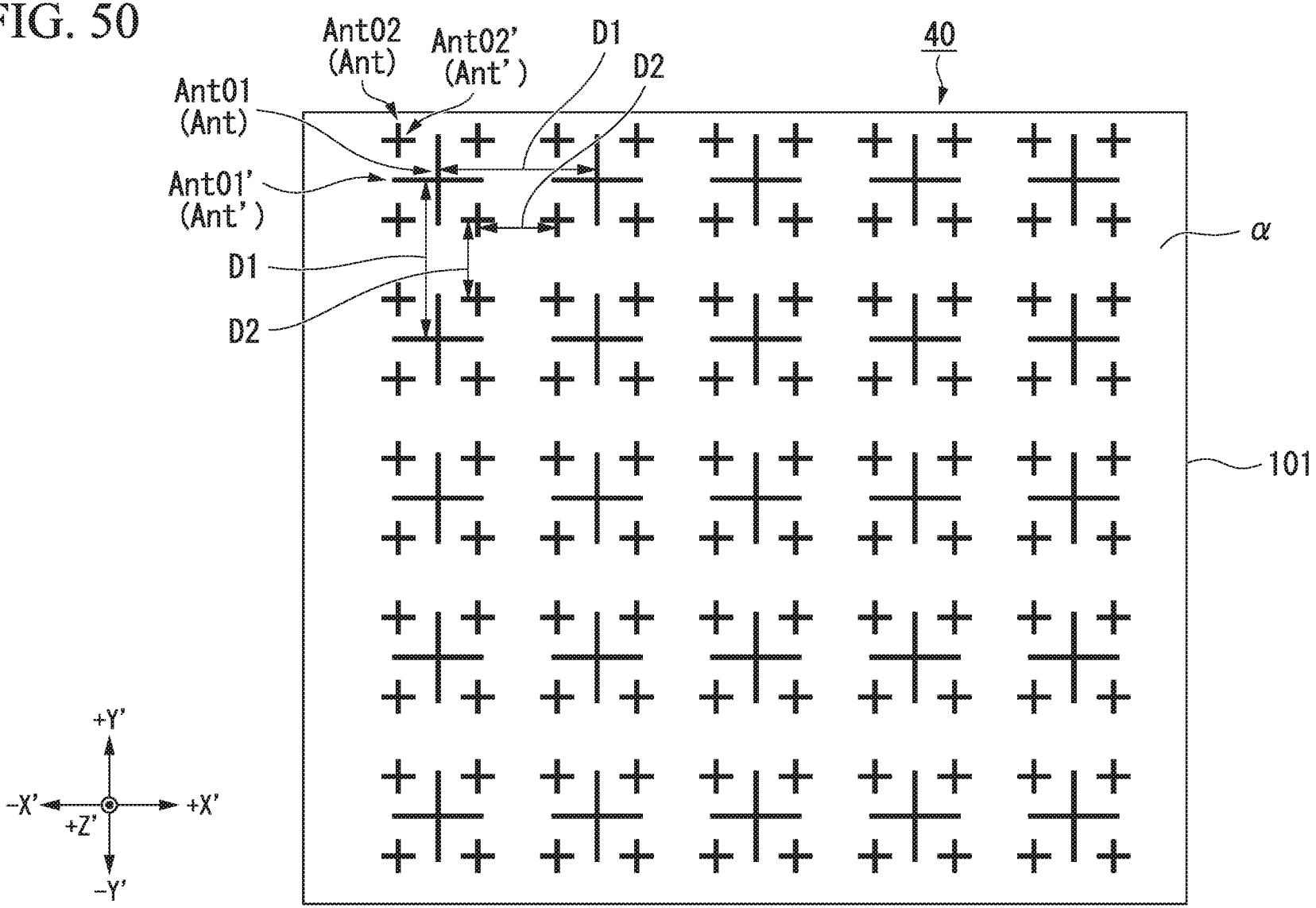
FIG. 50 is a top view of a multi-band antenna according to a second modified example of the fourth exemplary embodiment.

FIG. 50 is a top view of a multi-band antenna according to a second modified example of the fourth exemplary embodiment.

As shown in FIG. 50, in the multi-band antenna 40, the first antenna element Ant01 and the second antenna element Ant02 may support dual polarized waves by means of the cross-shaped arrangement shown in FIG. 43, FIG. 44, and FIG. 45, and at the same time, the direction of the periodic array as an array antenna may be the same as the extending direction of the cross shape formed by each of the antenna elements Ant and Ant'.

Figure 51:
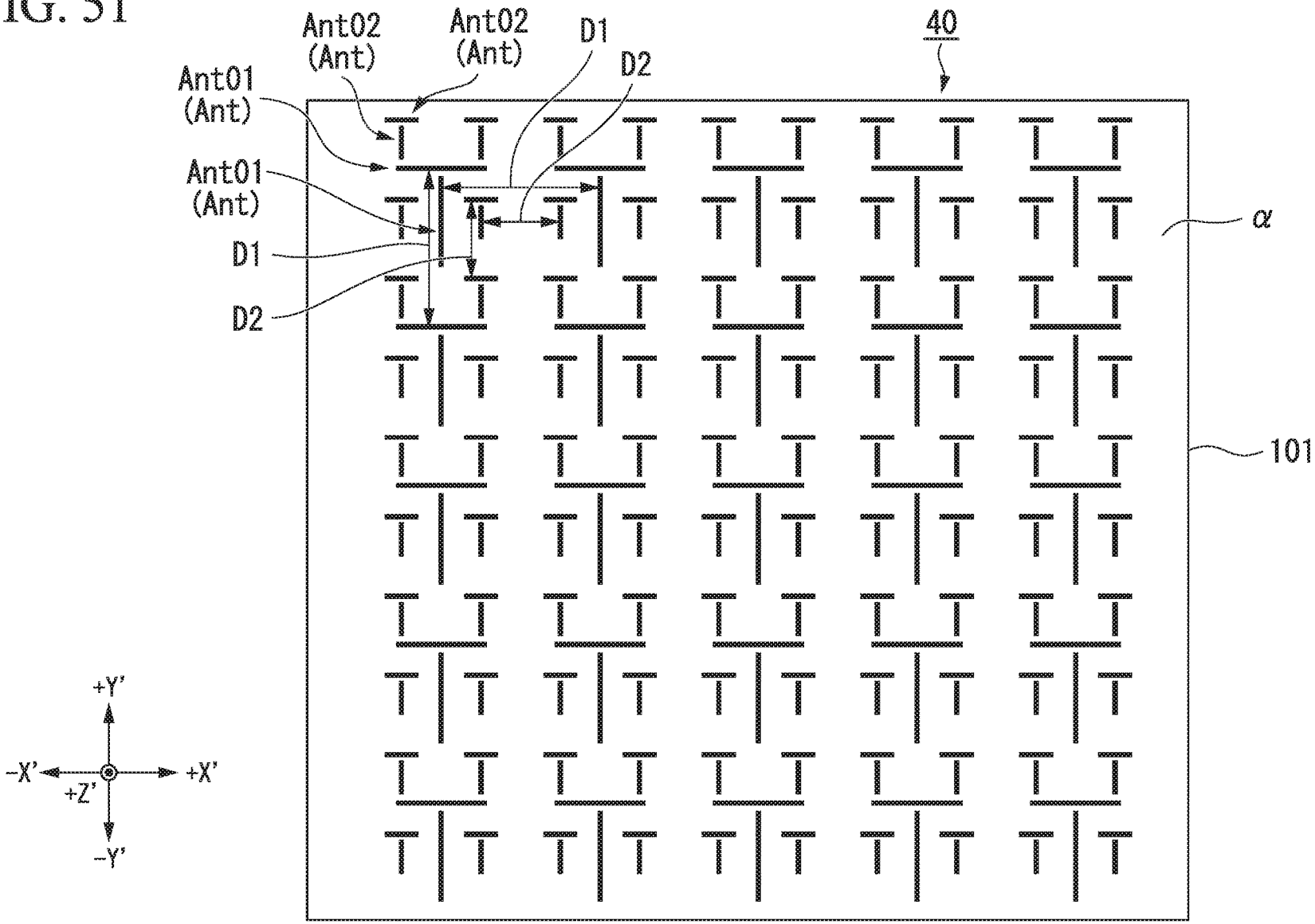
FIG. 51 is a top view of a multi-band antenna according to a third modified example of the fourth exemplary embodiment.
Figure 52:
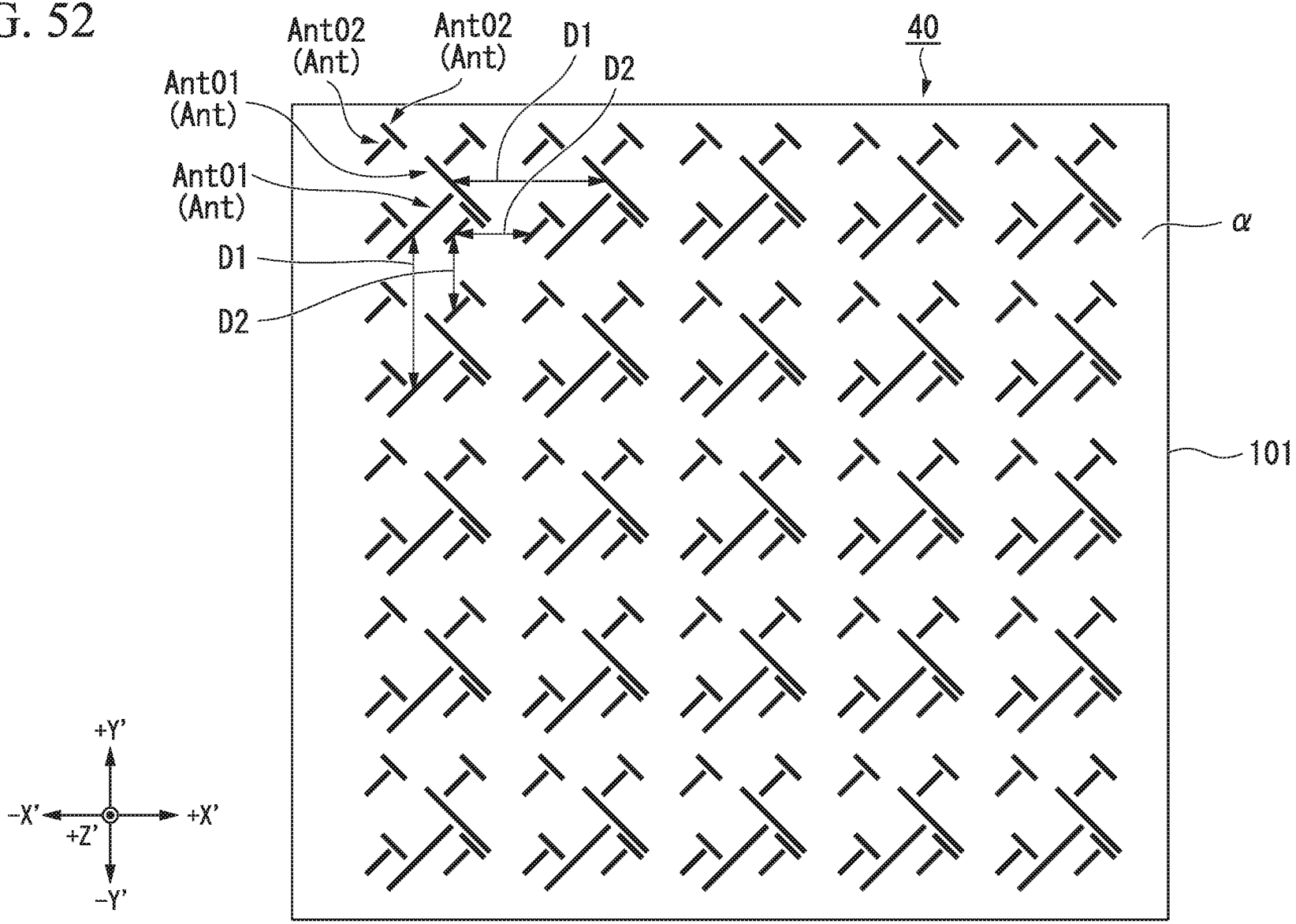
FIG. 52 is a top view of a multi-band antenna according to a fourth modified example of the fourth exemplary embodiment.
Figure 53:
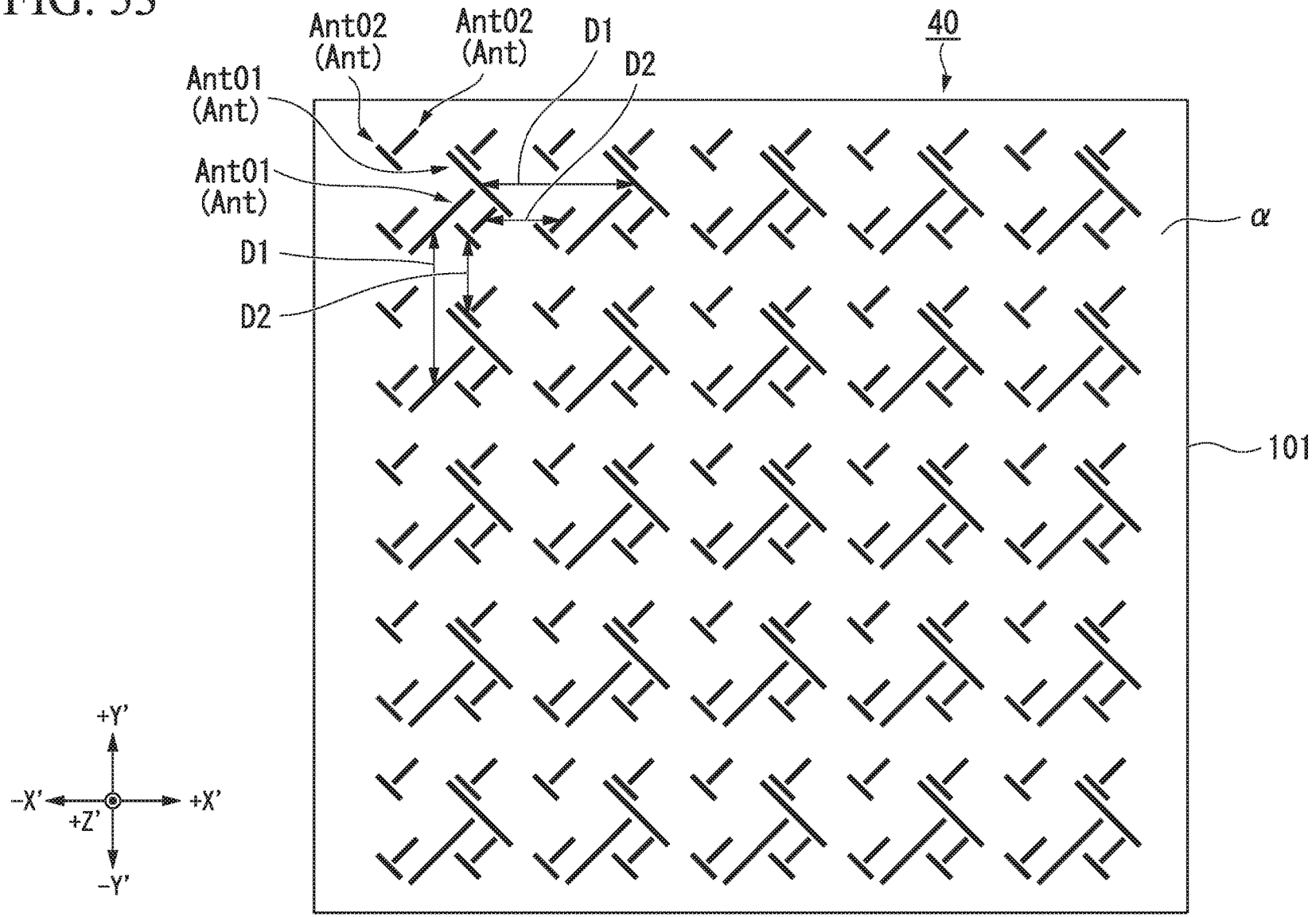
FIG. 53 is a top view of a multi-band antenna according to a fifth modified example of the fourth exemplary embodiment.

FIG. 51 to FIG. 53 are top views of a multi-band antenna according to a third modified example to a fifth modified example of the fourth exemplary embodiment.

The multi-band antenna 40 shown in FIG. 51 to FIG. 53 includes a plurality of first antenna elements Ant01 and a plurality of second antenna elements Ant02 that are arranged so that distances thereto in the perpendicular direction (Z axis direction) from the plate surface α of the conductor reflecting plate 101 are equal to each other. Both the first antenna element Ant01 and the second antenna element Ant02 are arranged in the manner described in the third exemplary embodiment (FIG. 38, FIG. 39, and FIG. 40).

That is to say, as shown in FIG. 51, the first antenna element Ant01 and the second antenna element Ant02 may respectively support dual polarized waves by means of the T-shaped arrangement shown in FIG. 38 to FIG. 40, and at the same time, the direction of the periodic array as an array antenna may be the same as the extending direction of the cross shape formed by each antenna element Ant As shown in FIG. 52 and FIG. 53, the first antenna element Ant01 and the second antenna element Ant02 may respectively support two polarized waves by means of the T-shaped arrangement, and at the same time, each extending direction of the T shape formed by each antenna Ant may be inclined by 45° from the direction of the periodic array as an array antenna.

Figure 54:
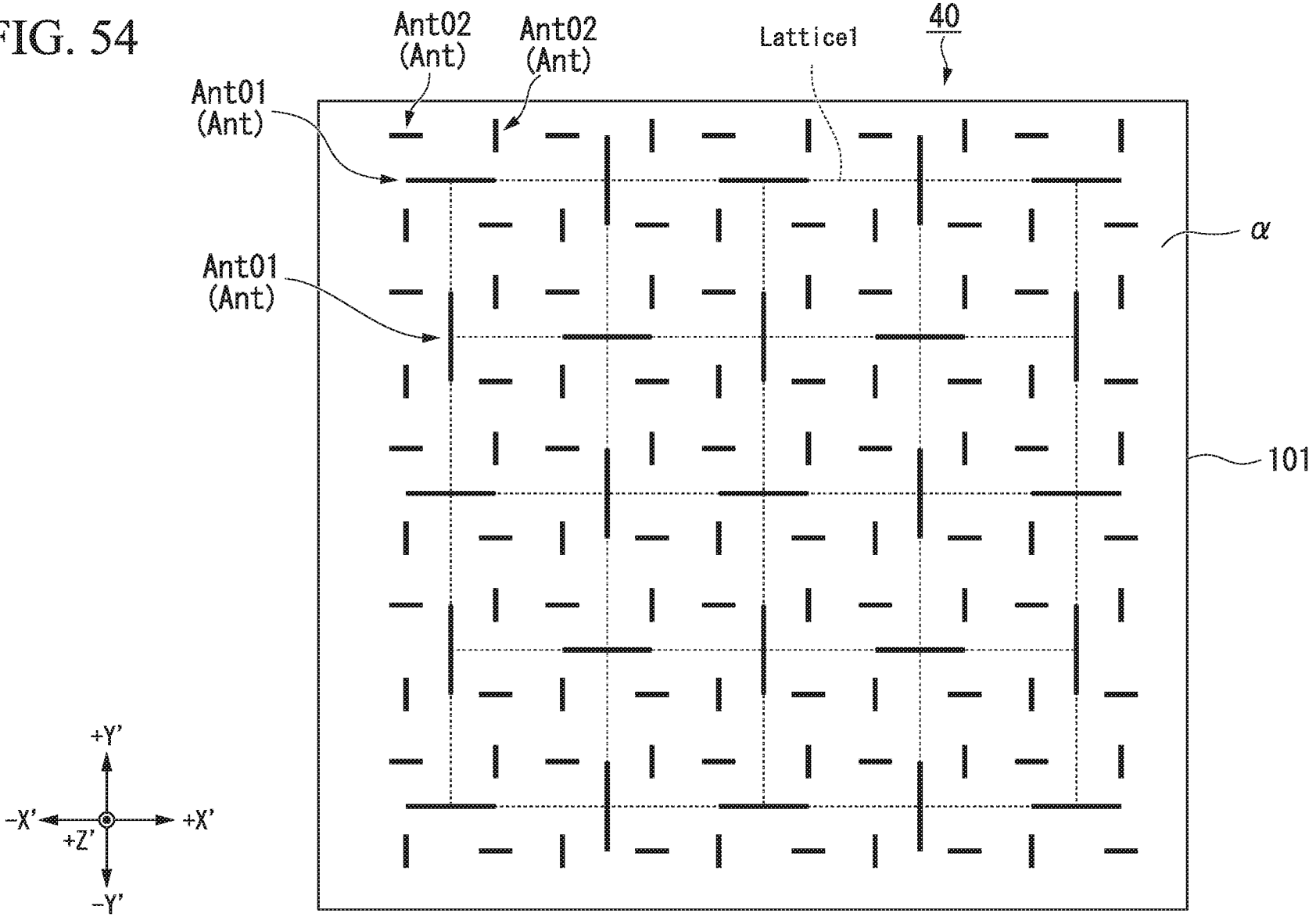
FIG. 54 is a top view of a multi-band antenna according to a sixth modified example of the fourth exemplary embodiment.

FIG. 54 is a top view of a multi-band antenna according to a sixth modified example of the fourth exemplary embodiment.

As shown in FIG. 54, the first antenna elements Ant01 are periodically arranged such that the center of each thereof in the extending direction (the center part 302 shown in FIG. 40) aligns with each lattice point of a square lattice Lattice1 defined on the plate surface α of the conductor reflecting plate 101. Furthermore, the extending directions of the adjacent first antenna elements Ant01 are orthogonal to each other.

In other words, the respective first antenna elements Ant01 positioned on adjacent lattice points have their extending directions orthogonal to each other, and are arranged so that the portion in the vicinity of the center of the other first antenna element Ant01 in the extending direction is positioned on the extended line of the extending direction of one first antenna element Ant01.

In this manner, the one first antenna element Ant01 can suppress electromagnetic coupling with the surrounding four other first antenna elements Ant01 in a perpendicular positional relationship, by means of the effect described in the second exemplary embodiment.

In the present modified example, the second antenna elements Ant02 are also arranged in the same manner as that of the first antenna elements Ant01 mentioned above. In this case, as shown in FIG. 54, the respective second antenna elements Ant02 are periodically arranged so that the first antenna element Ant01 and the second antenna element Ant02 do not overlap with each other.

The unit lattice of the square lattice Lattice1 need not necessarily be of a square shape. For example, the unit lattice may be a rectangular lattice. Also in this manner, it is possible to suppress electromagnetic coupling between one first antenna element Ant01 and the other four first antenna elements Ant01 therearound.

The intervals between the periodic arrays of the antenna elements Ant need not be constant. If the plurality of antenna elements Ant are arranged parallel to the plate surface α of the conductor reflecting plate 101 and spaced apart in two mutually perpendicular directions, each antenna element Ant can take the same orientation as described above, and the effect described above can be achieved.

Figure 55:
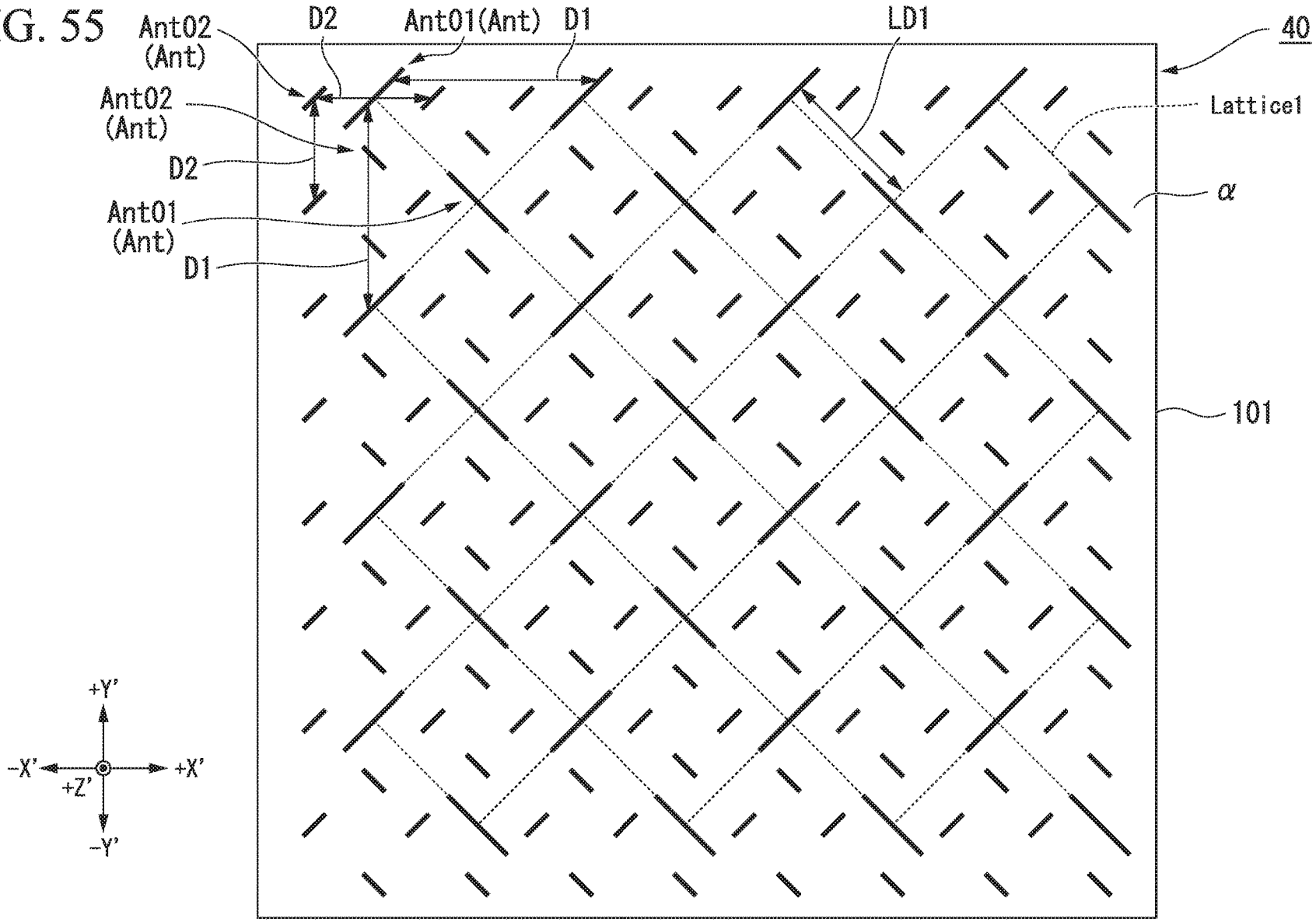
FIG. 55 is a top view of a multi-band antenna according to a seventh modified example of the fourth exemplary embodiment.

FIG. 55 is a top view of a multi-band antenna according to a seventh modified example of the fourth exemplary embodiment.

As shown in FIG. 55, the first antenna elements Ant01 can be arranged in a square lattice shape with intervals D1 while maintaining the positional relationship shown in FIG. 54. At this time, an inter-lattice point distance LD1 of the square lattice Lattice1 is "$1/(\sqrt{2})\times D1$".

In the present modified example, the second antenna elements Ant02 are also arranged in the same manner as that of the first antenna elements Ant01 mentioned above.

Figure 56:
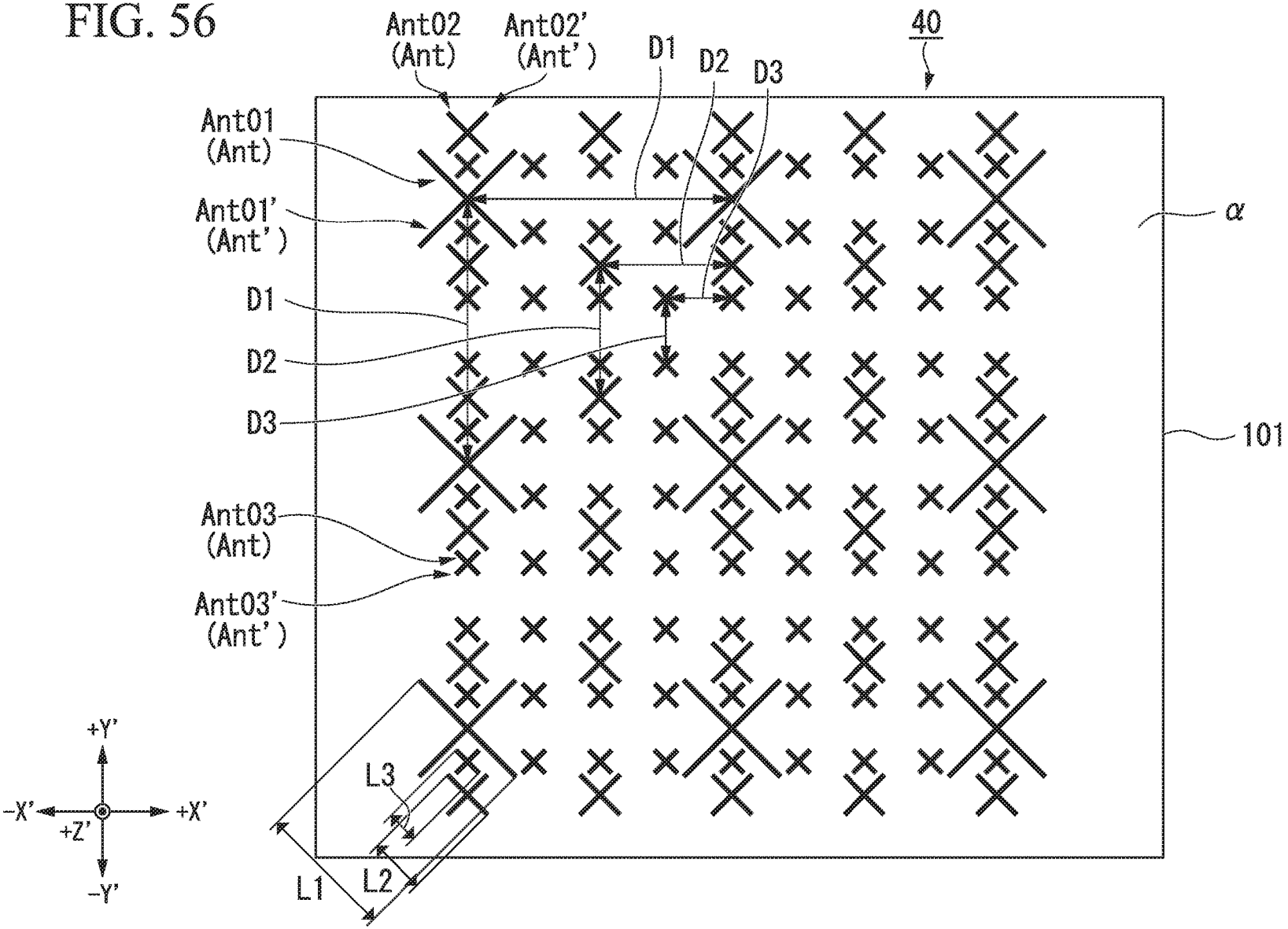
FIG. 56 is a top view of a multi-band antenna according to an eighth modified example of the fourth exemplary embodiment.
Figure 57:
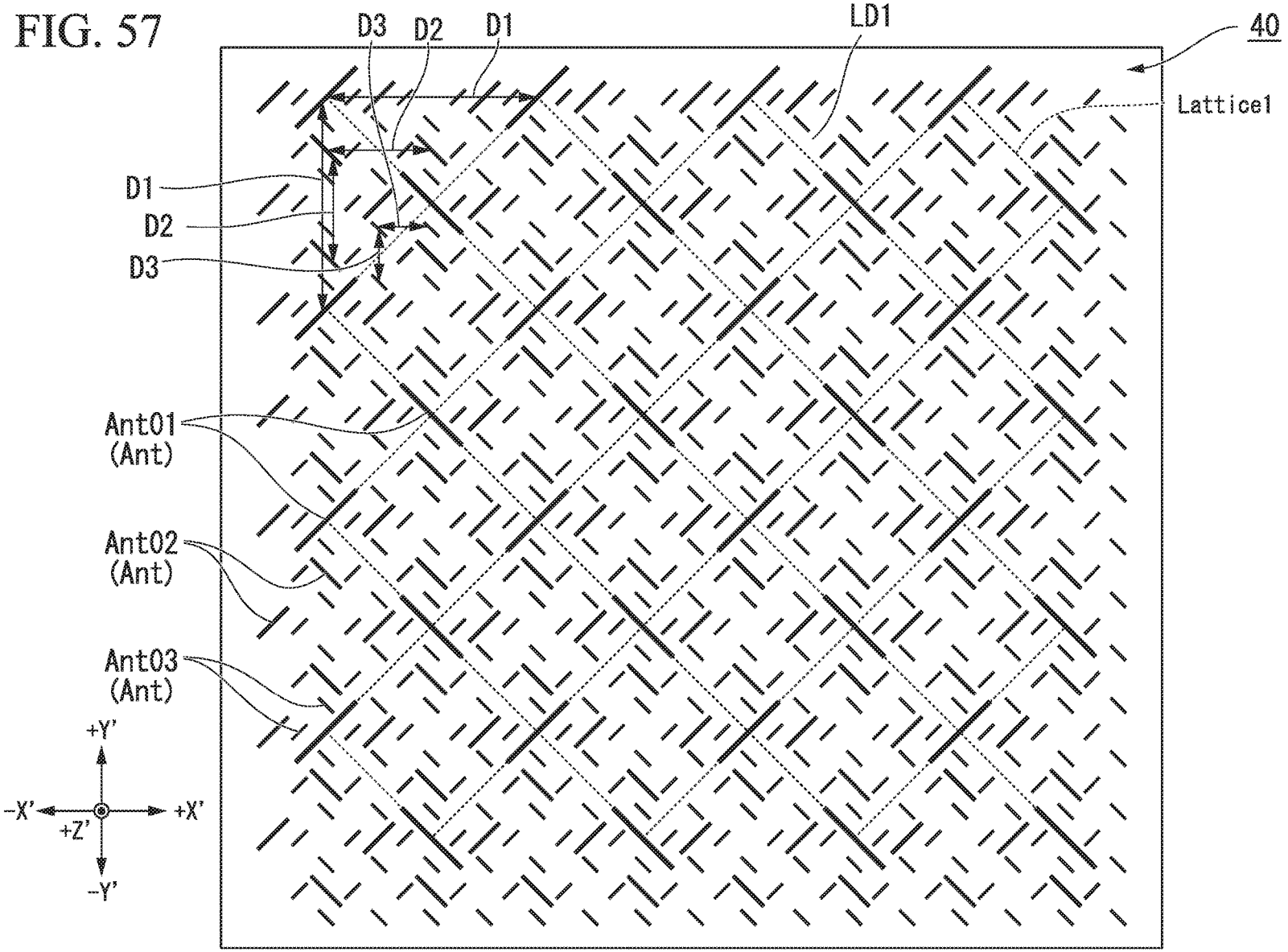
FIG. 57 is a top view of a multi-band antenna according to a ninth modified example of the fourth exemplary embodiment.

FIG. 56 and FIG. 57 are top views of a multi-band antenna according to an eighth modified example and a ninth modified example of the fourth exemplary embodiment.

In the multi-band antenna 40, there may be configured an array antenna that supports dual polarization by means of several types of antenna elements Ant that support not only two different frequencies f1, f2 but also three or more different frequencies f1, f2, f3, and that have equal distances thereto from the plate surface α of the conductor reflecting plate 101.

For example, as shown in FIG. 56, the multi-band antenna 40 includes third antenna elements Ant03, Ant03' in addition to the configuration shown in the fourth exemplary embodiment (FIG. 48). The third antenna elements Ant03, Ant03' have a resonance frequency at an operating frequency f3 that is higher than the operating frequency f2, and have a configuration similar to that of the first antenna elements Ant01, Ant01', and the second antenna elements Ant02, Ant02'.

The first antenna element Ant01, the second antenna element Ant02, and the third antenna element Ant03 of a first group are all arranged so that distances thereto from the plate surface α in the perpendicular direction are equal. Also, the first antenna element Ant01, the second antenna element Ant02, and the third antenna element Ant03 of a second group are all arranged so that distances thereto from the plate surface α in the perpendicular direction are equal.

The third antenna elements Ant03, Ant03' are arranged in a manner similar to that of the first antenna elements Ant01, Ant01' (the second antenna elements Ant02, Ant02') to thereby support dual polarization, and are, at the same time, arranged periodically at intervals D3 in a square lattice form.

The length L3 of the third antenna elements Ant03, Ant03' in the extending direction is, for example, approximately ¼ of a wavelength λ3 according to the frequency f3. Further, in the present modified example, the interval D3 is set to approximately ½ of the wavelength λ3.

The wavelength λ3 indicates the wavelength at which the electromagnetic waves of the operating frequency f3 coinciding with the resonance frequency of the third antenna element Ant03, travel through a substance that fills a region.

Even in this case, as shown in FIG. 56, it is also possible to make the arrangement periodically so that each of the antenna elements Ant (the first antenna element Ant01, the second antenna element Ant02, and the third antenna element Ant03) does not overlap with each other. In the present modified example, the intervals D1, D2, D3 are defined so as to satisfy the relational equation "$D1=2\times D2=4\times D3$", for example.

As shown in FIG. 57, in addition to the configuration shown in the seventh modified example of the fourth exemplary embodiment (FIG. 55), the multi-band antenna 40 may include the third antenna element Ant03 mentioned above.

In the manner described above, a dual polarized array antenna capable of transmitting and receiving electromagnetic waves of three or more frequencies can be provided.

The expressions used in the above description such as "have distances Z1, Z2 (distances Z1', Z2') made equal" and "Z1=Z2 (Z1'=Z2')" are not to be considered limiting to make each distance exactly the same, and include those cases where there is a certain degree of error to the extent that the substantial effect can be obtained based on each exemplary embodiment. Also, the same applies to the expressions such as "center", "perpendicular", "parallel", "orthogonal", and "square".

Having thus described several exemplary embodiments of the present invention, these exemplary embodiments are illustrative and do not limit the scope of the invention. These exemplary embodiments can be implemented in various other forms, and various omissions, substitutions, and changes may be made without departing from the gist of the invention. These exemplary embodiments and modified examples thereof are included in the scope and gist of the invention, as well as within the scope of the invention described in the claims and their equivalents.

This application is based upon and claims the benefit of priority from Japanese patent application No. 2015-075790, filed Apr. 2, 2015, the disclosure of which is incorporated herein in its entirety by reference.

INDUSTRIAL APPLICABILITY

The present invention may be applied to a multi-band antenna and a radio communication device.

REFERENCE SYMBOLS

1 Radio communication device
10, 20, 30, 40 Multi-band antenna
Ant, Ant' Antenna element
Ant01, Ant01' First antenna element
Ant02, Ant02' Second antenna element
Ant03, Ant03' Third antenna element
101 Conductor reflecting plate
α Plate surface
104 Annular conductor part
104*a* Missing part
104*b* Missing part conductor end part
105 Conductor feeder line
106 Conductor via
107 Feeding point
108 Dielectric layer
109 Split part
110, 111 Conductor end part
112 Dielectric radome
113 Transmission line
114 Radio communication circuit unit
116 Bridge conductor
117 Radiation part
118 Auxiliary conductor pattern
119 Conductor via
120 Second annular conductor part
121 Conductor via
122 Second split part
123 Conductor feeding GND part
123*a* Slit
124 Second conductor feeding GND part
125 Conductor via
126 Clearance
127 Connector
128 Core wire
129 Outer conductor
151, 152 Conductor line
153 Conductor via
154 Conductor feeder line
160 Coaxial cable
161 Core wire
162 Outer conductor
301 Tip end part
302 Center part
M Metamaterial reflecting plate
UC Periodic structure
M101 Conductor plate
M102 Dielectric plate
M103 Small conductor plate
M104 Conductor via
M105 Small conductor plate
d100, d200 Dipole antenna element
d101 Conductor radiation part
d102 Connection point
Lattice1 Square lattice

What is claimed is:

1. A multi-band antenna comprising:

a conductor reflecting plate having a plate surface;

a first antenna element that extends along the plate surface of the conductor reflecting plate to a length according to a first wavelength; and a second antenna element that extends along the plate surface of the conductor reflecting plate to a length according to a second wavelength shorter than the first wavelength, wherein a distance between the first antenna element and the plate surface in a perpendicular direction is equal to a distance between the second antenna element and the plate surface in the perpendicular direction, the perpendicular direction being a direction perpendicular to the plate surface;

wherein each of the first and second antenna elements comprises: an annular conductor part that comprises a conductor, extends along the plate surface, and has an annular shape, the annular conductor part having two end parts opposed to each other in a circumferential direction of the annular conductor part; and a split part that is a gap between the two end parts.

2. The multi-band antenna according to claim 1, wherein the annular conductor part has a surface having the annular shape and inclined with respect to the plate surface, the annular conductor part of the first antenna element has a first most distanced portion that is a portion furthest from the plate surface, the annular conductor part of the second antenna element has a second most distanced portion that is a portion furthest from the plate surface, and a distance between the first most distanced portion and the plate surface in the perpendicular direction is equal to a distance between the second most distanced portion and the plate surface in the perpendicular direction.

3. The multi-band antenna according to claim 1, wherein the first antenna element comprises a first conductor feeding ground part, the first conductor feeding ground part comprising a conductor and connecting the conductor reflecting plate and the annular conductor part of the first antenna element, and the second antenna element comprises a second conductor feeding ground part, the second conductor feeding ground part comprising a conductor and connecting the conductor reflecting plate and the annular conductor part of the second antenna element.

4. The multi-band antenna according to claim 1, wherein the distance between the plate surface and the first antenna element in the perpendicular direction is shorter than a quarter of a length of the first wavelength.

5. The multi-band antenna according to claim 1, wherein the first antenna element comprises at least two first antenna elements, the second antenna element comprises at least two second antenna elements, on an extended line in an extending direction of one of the two first antenna elements, there is positioned a center in an extending direction, of one of the other of the two first antenna elements and the two second antenna elements, and on an extended line in an extending direction of one of the two second antenna elements, there is positioned a center in an extending direction, of one of the other of the two second antenna elements and the two first antenna elements.

6. The multi-band antenna according to claim 1, wherein the first antenna element comprises at least two first antenna elements, the second antenna element comprises at least two second antenna elements, a first group is composed of one of the two first antenna elements and one of the two second antenna elements, a second group is composed of the other of the two first antenna elements and the other of the two second antenna elements, a center of the first antenna element of the first group in an extending direction thereof is orthogonal to a center of the first antenna element of the second group in an extending direction thereof, a center of the second antenna element of the first group in an extending direction thereof is orthogonal to a center of the second antenna element of the second group in an extending direction thereof, a distance between the first antenna element of the first group and the plate surface in the perpendicular direction is equal to a distance between the second antenna element of the first group and the plate surface in the perpendicular direction, a distance between the first antenna element of the second group and the plate surface in the perpendicular direction is equal to a distance between the second antenna element of the second group and the plate surface in the perpendicular direction, and a distance between the first antenna element of the first group and the plate surface in the perpendicular direction is different from a distance between the first antenna element of the second group and the plate surface in the perpendicular direction.

7. The multi-band antenna according to claim 1, wherein the first antenna element comprises a plurality of first antenna elements, the second antenna element comprises a plurality of second antenna elements, the plurality of first antenna elements are periodically arranged at intervals according to the first wavelength in a longitudinal direction and a lateral direction of the plate surface, and the plurality of second antenna elements are periodically arranged at intervals according to the second wavelength in a longitudinal direction and a lateral direction of the plate surface.

8. The multi-band antenna according to claim 1, wherein the conductor reflecting plate is a metamaterial reflecting plate, the metamaterial reflecting plate comprises a plurality of small pieces having a predetermined shape and comprising a conductor or a dielectric body, and the plurality of small pieces are periodically arranged in a longitudinal direction and a lateral direction of the plate surface.

9. A radio communication device comprising the multi-band antenna according to claim 1.

* * * * *